US012569775B2

(12) United States Patent
Li et al.

(10) Patent No.: US 12,569,775 B2
(45) Date of Patent: Mar. 10, 2026

(54) VARIABLE HAIR LENGTH APPARATUS FOR HAIR ROOTING

(71) Applicant: Hasbro Toys (Shenzhen) Limited, Shenzhen (CN)

(72) Inventors: Baoting Li, Zhongshan (CN); Sze Wing Ling, Hong Kong (HK)

(73) Assignee: Hasbro Toys (Shenzhen) Limited, Guangdong (CN)

( * ) Notice: Subject to any disclaimer, the term of this patent is extended or adjusted under 35 U.S.C. 154(b) by 277 days.

(21) Appl. No.: 18/269,329

(22) PCT Filed: Dec. 25, 2020

(86) PCT No.: PCT/CN2020/139306
§ 371 (c)(1),
(2) Date: Jun. 23, 2023

(87) PCT Pub. No.: WO2022/133983
PCT Pub. Date: Jun. 30, 2022

(65) Prior Publication Data

US 2024/0050868 A1 Feb. 15, 2024

(51) Int. Cl.
*A63H 9/00* (2006.01)
*A63H 3/44* (2006.01)

(52) U.S. Cl.
CPC ..... *A63H 9/00* (2013.01); *A63H 3/44* (2013.01)

(58) Field of Classification Search
CPC ..... A63H 9/00
See application file for complete search history.

(56) References Cited

U.S. PATENT DOCUMENTS 1,783,721 A * 12/1930 Keney ..... A41G 3/00 446/394
2,626,619 A 1/1953 Sievers
(Continued)

FOREIGN PATENT DOCUMENTS

CN 1326481 C 7/2007
CN 102245273 A 11/2011
(Continued)

OTHER PUBLICATIONS

National Intellectual Property Administration, China, International Search Report and Written Opinion, counterpart PCT Application No. PCT/CN2020/139306, mailed Sep. 27, 2021, 9 pages total.

*Primary Examiner* — Eugene L Kim
*Assistant Examiner* — Matthew B Stanczak
(74) *Attorney, Agent, or Firm* — DiBerardino McGovern IP Group LLC

(57) ABSTRACT

An apparatus includes: a variable hair length module configured to adjust the lengths of hair strands that are rooted in a head by a hair rooting machine from a supply of hair thread, the variable hair length module including two arms configured to move relative to each other along respective continuous paths; and a control system configured to input programs of instruction to the variable hair length module to automatically control the relative movement of the two arms during operation of the hair rooting machine to root hair strands into the head. The hair thread is configured to engage with each of the two arms such that a relative movement of the two arms varies the length of each hair strand continuously within a hair length range that is defined by two extreme lengths.

24 Claims, 28 Drawing Sheets

(56) References Cited

U.S. PATENT DOCUMENTS 2,686,305 A 8/1954 Hall
2,698,019 A 12/1954 Sotzky
2,728,314 A 12/1955 Richards
2,747,530 A * 5/1956 Goldberg ..... A63H 9/00 112/80.02
2,780,190 A 2/1957 Lenoble
2,828,702 A 4/1958 Hall
RE24,546 E 10/1958 Hall
2,977,906 A 4/1961 Follender
3,109,396 A 11/1963 Kirschenmann
3,165,079 A 1/1965 Richards et al.
3,225,724 A 12/1965 Klassert
3,273,280 A * 9/1966 Karton ..... A63H 3/44 132/201
3,276,407 A 10/1966 Klassert et al.
3,490,397 A 1/1970 Klassert
3,500,578 A * 3/1970 Irving ..... A63H 3/44 446/394
3,670,451 A * 6/1972 Groves ..... A63H 3/44 446/319
3,694,957 A * 10/1972 Houghton ..... A63H 3/44 446/319
3,696,552 A * 10/1972 Gunther ..... A63H 3/44 446/361
3,710,740 A * 1/1973 Canziani ..... D05C 15/02 112/242
3,903,903 A * 9/1975 Matsumura ..... D05C 15/02 132/201
3,977,335 A 8/1976 Bonham
4,188,894 A 2/1980 Matsumura
4,450,129 A * 5/1984 Dunn ..... A63H 3/44 264/246
4,674,169 A * 6/1987 Katzman ..... A63H 3/44 29/451
4,841,886 A * 6/1989 Watkins ..... D05C 15/145 112/80.52
5,116,277 A * 5/1992 Kelley ..... A63H 3/44 446/296
6,071,171 A * 6/2000 George ..... A63H 3/365 446/268
6,105,584 A * 8/2000 Williams ..... A41G 3/0016 132/54
6,217,407 B1 * 4/2001 Laursen ..... A63H 3/44 446/394
6,446,634 B2 * 9/2002 Fukuyama ..... A41G 3/0075 132/200
10,163,243 B2 * 12/2018 Witkin ..... G06T 11/203
11,950,651 B2 * 4/2024 Obama ..... A41G 3/0075
12,089,675 B2 * 9/2024 Obama ..... A41G 3/0075
12,434,163 B2 * 10/2025 Williams ..... D05C 15/02
2001/0035190 A1 * 11/2001 Fukuyama ..... A41G 3/0075 132/53
2004/0168696 A1 9/2004 Cox
2004/0250829 A1 * 12/2004 Fukuyama ..... A41G 3/0075 132/56
2005/0061346 A1 3/2005 Song
2005/0223956 A1 * 10/2005 Fukuyama ..... D05C 15/02 112/222
2007/0238389 A1 10/2007 Kobayashi
2008/0011313 A1 * 1/2008 Gildenberg ..... A41G 3/0075 901/41
2008/0171489 A1 * 7/2008 Kim ..... A63H 3/44 112/475.04
2008/0254292 A1 * 10/2008 Kim ..... D06M 15/65 428/391
2008/0284062 A1 11/2008 Simpson
2010/0178842 A1 * 7/2010 Thompson ..... D04H 1/4266 446/385
2010/0330869 A1 * 12/2010 Jung ..... A63H 3/44 446/319
2011/0180091 A1 7/2011 Wilson
2011/0271976 A1 * 11/2011 Sasayama ..... A41G 5/0046 132/201
2016/0050996 A1 2/2016 Kwon
2017/0079354 A1 3/2017 Tao et al.
2017/0215504 A1 * 8/2017 Alex ..... A41G 3/0075
2017/0273380 A1 9/2017 Tao et al.
2017/0280801 A1 10/2017 Dozier
2021/0145099 A1 * 5/2021 Obama ..... A41G 3/0075
2021/0145101 A1 * 5/2021 Obama ..... A41G 5/0046
2021/0282485 A1 * 9/2021 Reed ..... D04G 5/00
2023/0200476 A1 * 6/2023 Lee ..... D04C 1/06 132/53
2024/0050868 A1 * 2/2024 Li ..... A63H 3/44
2024/0115963 A1 * 4/2024 Williams ..... D05C 15/02
2024/0390810 A1 * 11/2024 Khalsa ..... A63H 9/00
2025/0049158 A1 * 2/2025 Kim ..... A41G 3/0066
2025/0072541 A1 * 3/2025 Abdulsalam ..... A41G 3/0075

FOREIGN PATENT DOCUMENTS

CN 105483953 A 4/2016
CN 205272161 U 6/2016
CN 205272181 U 6/2016
CN 205275933 U 6/2016
CN 205412219 U 8/2016
CN 107261512 A 10/2017
CN 207477977 U 6/2018
CN 108374251 A 8/2018
CN 108568117 A 9/2018
CN 108939567 A 12/2018
CN 208193658 U 12/2018
CN 208242960 U 12/2018
CN 208244096 U 12/2018
CN 109763253 A 5/2019
JP S6156691 A 3/1984
JP H03193090 A 8/1991
KR 1020040021367 A 3/2004
WO 1997024483 A2 7/1997
WO 2019028981 A1 2/2019

* cited by examiner

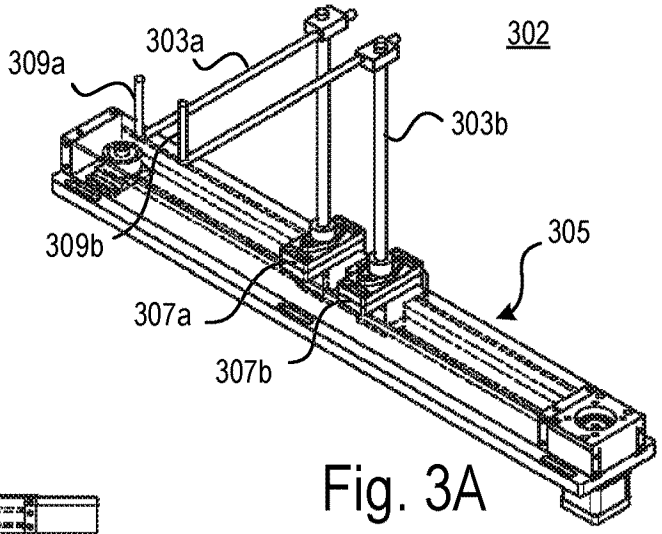
Fig. 3A
Fig. 3B
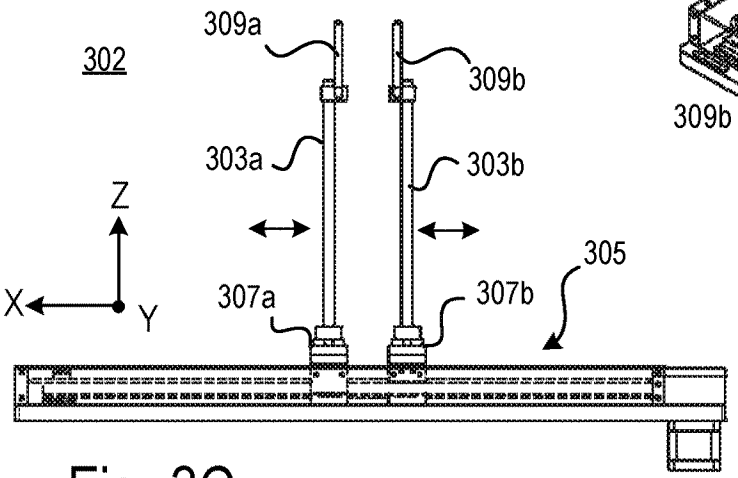
Fig. 3C
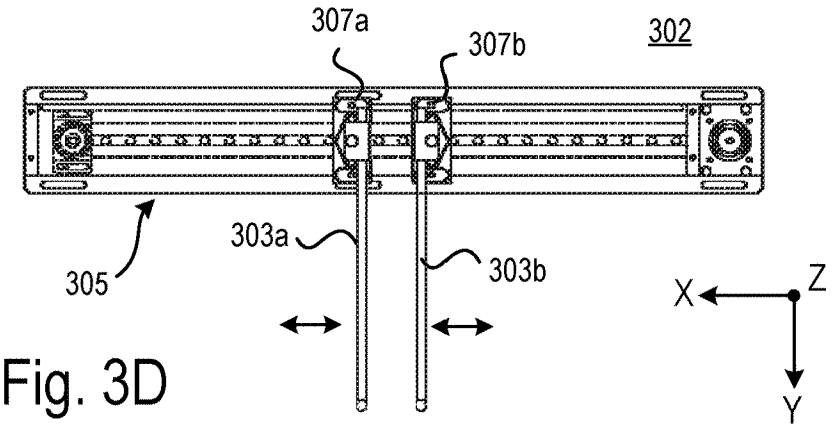
Fig. 3D

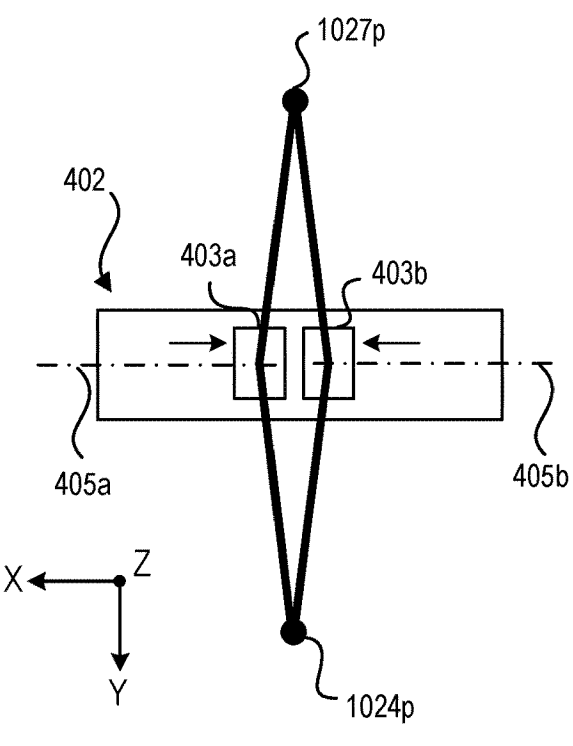
Fig. 10D
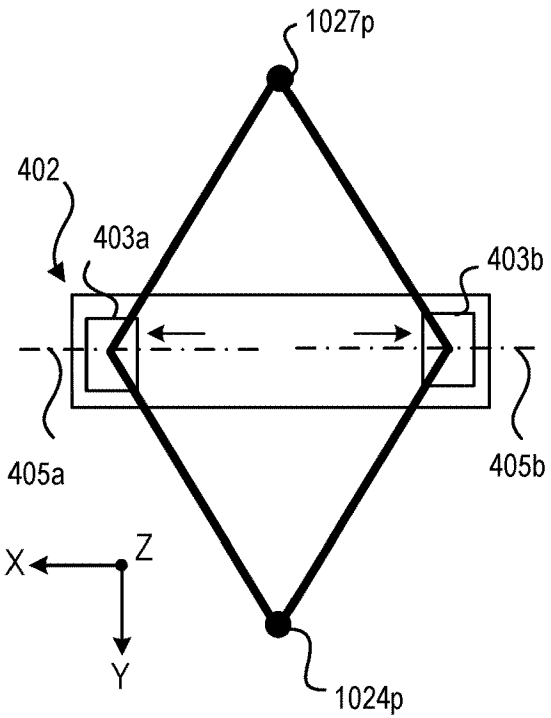
Fig. 10E
Fig. 10F

1531a

1531b

1572a

1572b

1573a

1573b

1575a

1575b

VARIABLE HAIR LENGTH APPARATUS FOR HAIR ROOTING

TECHNICAL FIELD

The disclosed subject matter relates to a hair rooting apparatus including a variable hair length module.

BACKGROUND

A hair rooting machine is used to root hair (which can be artificial) into a head of a doll. In this way, human hair is simulated by attaching (using a rooting technique) tufts of thread to the doll's head.

SUMMARY

In some general aspects, an apparatus includes: a variable hair length module configured to adjust the lengths of hair strands that are rooted in a head by a hair rooting machine from a supply of hair thread; and a control system. The variable hair length module includes two arms configured to move relative to each other along respective continuous paths. The control system is configured to input programs of instruction to the variable hair length module to automatically control the relative movement of the two arms during operation of the hair rooting machine to root hair strands into the head. The hair thread is configured to engage with each of the two arms such that a relative movement of the two arms varies the length of each hair strand continuously within a hair length range that is defined by two extreme lengths.

Implementations can include one or more of the following features. For example, the hair thread can be configured to engage with each of the two arms between a needle configured to root the hair thread in the head and a cutter configured to cut the hair thread to produce the hair strands. The two extreme lengths can be determined at least by the relative positions of the needle and the cutter. The control system can be configured to adjust one or more aspects of the motion of the needle and the variable hair length module. The control system can be configured to control the cutter to cut the hair thread at an appropriate time to produce the hair strands, each hair strand having any desired length that is between the two extreme lengths. A motion of the needle can be pre-programmed and is based on a desired hair rooting path and a stitch per inch requirement.

The hair length range can be given by a minimum length and a maximum length that define a continuous range of length of each hair strand.

The control system can be configured to change the hair length range between a set of distinct hair length ranges. A first hair length range is between four inches and six inches, and a second hair length range is between six inches and nine inches.

The head can be a hollow object.

The hair thread being configured to engage with each of the two arms can include the hair thread wrapping around each of the two arms or the hair thread surrounding the two arms.

The two extreme lengths can be pre-set based at least on a size of the head and the desired length of each hair strand.

The apparatus can also include a hair feeding device. The movement of the hair feeding device can be dependent on the state of the variable hair length module.

The control system can automatically control the relative movement of the two arms of the variable hair length module based on the programs of instruction and manual settings.

In other general aspects, a hair rooting apparatus includes: a needle configured to root hair thread into a head; a cutter configured to cut the rooted hair thread to produce hair strands; a hair feeding device configured to position the hair thread at the needle and the cutter; a variable hair length module configured to adjust a length of the hair strands rooted into the head, the variable hair length module including two arms configured to move relative to each other; and a control system configured to input programs of instruction to the variable hair length module to automatically control the relative movement of the two arms. The hair thread is configured to engage with each of the two arms such that the length of each hair strand is varied by the relative movement of the two arms.

Implementations can include one or more of the following features. For example, the hair rooting apparatus can include a mount configured to position the head relative to the needle. A position of the mount can be adjusted by an actuator, the position of the mount determining the position of the head relative to the needle.

The control system can be further configured to control one or more of a rooting speed of the needle and movement of the hair feeding device.

The hair rooting apparatus can include a pressing device configured to press the head to form a flat surface at a region of the head in which the needle roots the hair thread. The control system can be further configured to control movement of one or more of the mount and the pressing device. Each of the needle, the cutter, the mount, and the pressing device can be made of a rigid material including a metal.

The hair rooting apparatus can include a cutting post configured to engage the rooted hair thread to enable the cutter to cut the rooted hair thread.

In other general aspects, a hair rooting apparatus includes: a hair feeding device configured to guide a hair thread relative to a head; a needle including a hook, the needle configured to pierce the head and the hook configured to, at certain times during rooting, grab the hair thread from the hair feeding device; a trimming mechanism including a cutter configured to cut the hair thread to form a hair strand having a cut region at the cutter and a root region penetrating the head; a variable length module configured to adjust a length between the cut region and the root region between hair strands; and a control system in communication with the variable length module, the hair feeding device, and the needle. The control system is configured to adjust one or more aspects of the motion of the needle and one or more aspects of the motion of the hair feeding device based on the state of the variable length module.

Implementations can include one or more of the following features. For example, the control system can be in communication with the trimming mechanism and can be configured to adjust one or more aspects of the trimming mechanism based on the state of the variable length module.

The hair rooting apparatus can include a mount configured to hold the head. The control system can be in communication with the mount and can be configured to adjust the mount to thereby adjust the position of the head relative to the needle in between the moments when the needle pierces the head.

The control system can be configured to adjust one or more aspects of the motion of the needle include adjusting a speed at which the needle moves.

The needle can include a pointed tip that allows the needle to pierce the head and a hook configured to engage the hair thread.

In other general aspects, a method for rooting hair of variable lengths includes engaging hair thread with two arms of a variable hair length module; adjusting a relative position of the two arms between a maximum position that produces hair strands of a maximum length and a minimum position that produces hair strands of a minimum length, the relative position of the two arms allowing for a continuous range of lengths of a hair strand between the maximum length and the minimum length; rooting the hair thread into a head with a needle; and cutting the rooted hair thread to produce the hair strand of the length corresponding to the relative position of the two arms.

Implementations can include one or more of the following features. For example, the method can include adjusting a hair feeding device based on the relative position of the two arms, the hair feeding device configured to guide the hair thread relative to the head. The method can include adjusting a distance between the needle and a cutter configured to cut the rooted hair thread. Adjusting the distance between the needle and the cutter determines the maximum length and the minimum length of the hair strands.

In other general aspects, a hair rooting system includes: a first machine configured to operate in a first mode of operation on a first head being of a first type, the first machine including a base apparatus and a first set of transition devices, each transition device in the first set being configured for the first head; and a second machine configured to operate in a second mode of operation on a second head being of a second type, the second machine including the base apparatus and a second set of transition devices, each transition device in the second set configured for the second head, the second type being distinct from the first type. The second machine is formed by replacing the first set of transition devices with the second set of transition devices.

Implementations can include one or more of the following features. For example, each of the transition devices in the first set can include at least one of a holding apparatus configured to hold the first head, a motion apparatus configured to move the first head, and a needle apparatus configured to root the hair thread into the first head. Each of the transition devices in the second set can include at least one of a holding apparatus configured to hold the second head, a motion apparatus configured to move the second head, and a needle apparatus configured to root the hair thread into the second head. The first set of transition devices can include: a first mount configured to hold the first head; a first needle bar configured to hold a needle configured to root hair thread into the appropriate head; a first support sleeve configured to support the first needle bar; a first needle bar sleeve configured to house the first needle bar and the first support sleeve; and a first motion adapter configured to move the first support sleeve such that the needle oscillates to root the hair thread into the first head. The second set of transition devices can include: a second mount configured to hold the second head; a second needle bar configured to hold the needle configured to root the hair thread into the appropriate head; a second support sleeve configured to support the second needle bar; a second needle bar sleeve configured to house the second needle bar and the second support sleeve; and a second motion adapter configured to move the second support sleeve such that the needle oscillates to root the hair thread into the second head.

A position of the first mount can be configured to be adjusted by an actuator and a position of the second mount can be configured to be adjusted by the actuator such that the actuator is configured for both types of heads, the position of the first mount determining the position of the first head relative to the needle and the position of the second mount determining the position of the second head relative to the needle. The first motion adapter can include a wheel configured to rotate about a rotation axis and a crank positioned in a first position relative to the wheel to thereby cause the first support sleeve to move linearly to thereby move the needle to root the hair thread into the first head. The second motion adapter can include the wheel configured to rotate about the rotation axis and the crank positioned in a second position relative to the wheel to thereby cause the second support sleeve to move linearly to thereby move the needle to root the hair thread into the second head. The crank can attach to the wheel at a first radial location to form the first motion adapter, and the crank can attach to the wheel at a second radial location to form the second motion adapter, the second radial location being distinct from the first radial location. The first radial location can determine a first oscillation range of the first support sleeve, the first needle bar, and the needle; and the second radial location can determine a second oscillation range of the second support sleeve, the second needle bar, and the needle. Each of the first and second motion adapters can define a different rotational amplitude of the needle. A first size of the first needle bar can be different than a second size of the second needle bar, a first size of the first support sleeve can be different than a second size of the second support sleeve, and a first size of the first needle bar sleeve can be different than a second size of the second needle bar sleeve. Each of the first and second sizes of the needle bars, the support sleeves, and the needle bar sleeves can be dependent on the first and second motion adapters, respectively.

A first size of a tip of the first needle bar sleeve and a tip of the first needle bar can be different than a second size of a tip of the second needle bar sleeve a tip of the second needle bar. Each of the first and second sizes of the tips can depend on a first head size of the first head and a second head size of the second head that is different than the first head size, respectively.

Each of the first support sleeve and the second support sleeve can be made of a material that has a low friction coefficient to enable the first support sleeve to move relative to the first needle bar sleeve and the second support sleeve to move relative to the second needle bar sleeve, an inner surface of the first needle bar sleeve being flush with an outer surface of the first support sleeve, and an inner surface of the second needle bar sleeve being flush with an outer surface of the second support sleeve.

A first size of the first needle bar, a first size of the first support sleeve, and a first size of the first needle bar sleeve can be related to and depend on each other; and a second size of the second needle bar, a second size of the second support sleeve, and a second size of the second needle bar sleeve can be related to and depend on each other.

The base apparatus can include a trimming mechanism including a cutter configured to cut rooted hair thread to produce hair strands, the cutter configured for both of the types of heads. The base apparatus can include a hair feeding device configured for both types of heads, the hair feeding device configured to position the hair thread at a needle that interacts with the head at some moments, and at the cutter at other moments. The base apparatus can include a pressing device configured for both types of heads, the pressing device configured to press the head to form a flat surface at a region of the head in which a needle roots the hair thread. The base apparatus can include a variable hair length module configured to automatically adjust a length of hair strands rooted into the head in either of the modes of operation, the hair strands produced by cutting the rooted hair thread, the variable hair length module including two arms configured to move relative to each other.

The first type can be defined by a first head size and the second type can be defined by a second head size that is distinct from the first head size such that the size of the second head is distinct from the size of the first head. The first head size can be defined by a diameter that is within a range of 60 millimeters (mm) to 120 mm, and the second head size can be defined by a diameter that is within a range of 20 mm to 60 mm.

In other general aspects, a hair rooting apparatus includes a hair rooting system. The hair rooting system includes: a first machine configured to root hair thread into a first head being of a first type; and a second machine configured to root hair thread into a second head being of a second type. The first machine and the second machine both include a base apparatus, and the second machine is formed by replacing one or more first modules of the first machine with one or more second modules. The base apparatus includes a variable hair length module configured to adjust the lengths of hair strands that are rooted in the head of the appropriate type by the hair rooting system, the variable hair length module including two arms configured to move relative to each other along respective continuous paths.

Implementations can include one or more of the following features. For example, the first type can be defined by a first head size and the second type can be defined by a second head size that is distinct from the first head size.

The first modules can include: a first mount configured to hold the first head; a first needle bar configured to hold a needle configured to root hair thread into the appropriate head; a first support sleeve configured to support the first needle bar; a first needle bar sleeve configured to house the first needle bar and the first support sleeve; and a first motion adapter configured to move the first support sleeve such that the needle oscillates to root the hair thread into the first head. The second modules an include: a second mount configured to hold the second head; a second needle bar configured to hold the needle configured to root the hair thread into the appropriate head; a second support sleeve configured to support the second needle bar; a second needle bar sleeve configured to house the second needle bar and the second support sleeve; and a second motion adapter configured to move the second support sleeve such that the needle oscillates to root the hair thread into the second head.

The base apparatus can include one or more of: a cutter configured to cut the rooted hair thread to produce the hair strands; a hair feeding device configured to position the hair thread at a needle location at some moments and at the cutter at other moments; a pressing device configured to press the head to form a flat surface at a region of the head in which a needle roots the hair thread to the head; and a cutting post configured to engage the rooted hair thread to enable the cutter to cut the rooted hair thread.

The hair rooting apparatus can also include a control system configured to input first programs of instruction to the variable hair length module in the first machine and input second programs of instruction to the variable hair length module in the second machine to automatically control the relative movement of the two arms.

In other general aspects, a hair rooting system includes: a base apparatus including a set of standardized components and one or more interchange zones; one or more first modules, each first module including a first set of components configured to root hair thread in a first head being of a first type, each first module configured for attachment to and detachment from one of the interchange zones of the base apparatus; and one or more second modules, each second module including a second set of components configured to root hair thread in a second head being of a second type, each second module configured for attachment to and detachment from one of the interchange zones of the base apparatus. A first hair rooting configuration is formed by the attachment of the one or more first modules to respective interchange zones of the base apparatus to thereby form a first hair rooting machine configured to root the hair thread into the first head. A second hair rooting configuration is formed by the attachment of the one or more second modules to respective interchange zones of the base apparatus to thereby form a second hair rooting machine configured to root the hair thread into the second head.

Implementations can include one or more of the following features. For example, the one or more interchange zones can include: a holding zone configured to retain and move the head, and a rooting zone configured to root hair thread into the head.

The first modules can include: a first mount configured to hold the first head; a first needle bar configured to hold a needle configured to root hair thread into the appropriate head; a first support sleeve configured to support the first needle bar; a first needle bar sleeve configured to house the first needle bar and the first support sleeve; and a first motion adapter configured to move the first support sleeve such that the needle oscillates to root the hair thread into the first head. The second modules can include: a second mount configured to hold the second head; a second needle bar configured to hold the needle configured to root the hair thread into the appropriate head; a second support sleeve configured to support the second needle bar; a second needle bar sleeve configured to house the second needle bar and the second support sleeve; and a second motion adapter configured to move the second support sleeve such that the needle oscillates to root the hair thread into the second head.

The set of standardized components can include: a cutter configured to cut hair thread rooted into a head to produce the hair strands; a hair feeding device configured to position hair thread at a needle zone at some moments and at the cutter at other moments; a pressing device configured to press the head to form a flat surface at a region of the head in which a needle roots the hair thread; and a cutting post configured to engage the rooted hair thread to enable the cutter to cut the rooted hair thread.

The set of standardized components can further include a variable hair length module configured to adjust the lengths of hair strands that are rooted in the head of the appropriate type by the hair rooting system, the variable hair length module including two arms configured to move relative to each other along respective continuous paths.

The hair rooting system can also include a control system configured to automatically control each of the standardized components in the base apparatus, each of the first modules in the first hair rooting configuration, and each of the second modules in the second hair rooting configuration.

DESCRIPTION OF DRAWINGS

FIG. 3A is a perspective view of an implementation of the variable hair length module of FIG. 1.

FIG. 3B is a side view of the variable hair length module of FIG. 3A.

FIG. 3C is a front view of the variable hair length module of FIG. 3A.

FIG. 3D is a top view of the variable hair length module of FIG. 3A.

FIG. 10D is a top view of the variable hair length module of FIG. 4 when two arms of the variable hair length module are at an intermediate relative position from each other and a hair range is set for longer hair.

FIG. 10E is a top view of the variable hair length module of FIG. 4 when the two arms are at a maximum relative position from each other and a hair range is set for longer hair.

FIG. 10F is a top view of the variable hair length module of FIG. 4 when the two arms are at a minimum relative position from each other and a hair range is set for longer hair.

DESCRIPTION

Figure 1:
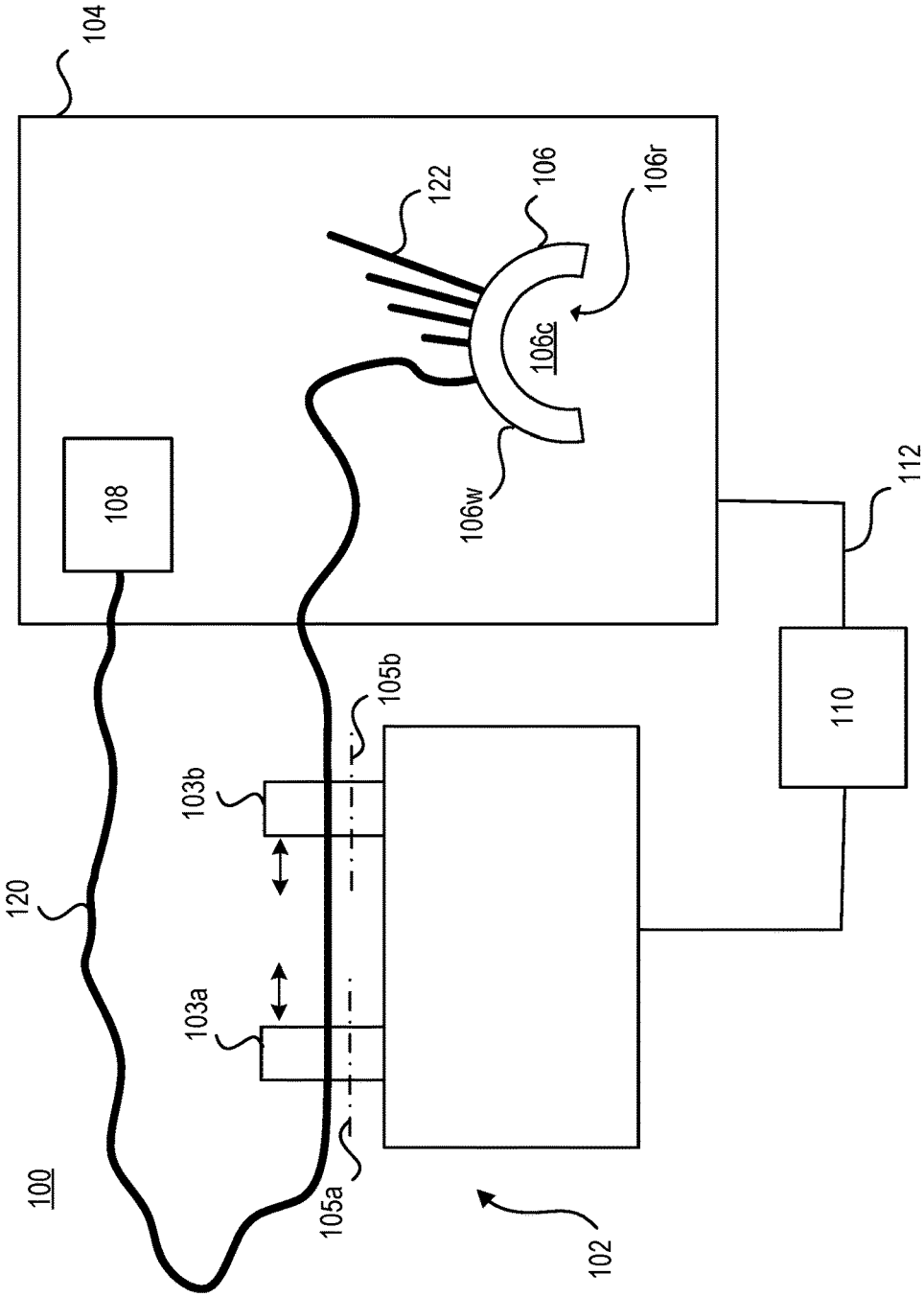
FIG. 1 is a block diagram of an apparatus that includes a variable hair length module and a control system.

Referring to FIG. 1, an apparatus 100 includes a variable hair length module 102 that is configured to adjust the length of hair strands 122 that are rooted in a head 106 during a hair rooting process applied to the head 106, and a control system 110 in communication with the variable hair length module 102. The hair strands 122 are rooted in the head 106 by a hair rooting machine 104 from a supply 108 of hair thread 120. The hair thread 120 can be made of any suitable material that simulates hair in texture, size, and colors. Moreover, the head 106 can be made of any material (such as a resilient plastic material) that is capable of being rooted by the hair rooting machine 104. As shown in FIG. 1, the head 106 is a hollow object that is a three-dimensional wall or form 106*w* through which the hair thread 120 can pass. The head 106 can take any suitable shape, depending on the design it is emulating. For example, the head 106 can be in the shape of a doll head. The head 106 can further include an open region 106*r* that enables access to a cavity 106*c* defined by the three-dimensional wall 106*w*.

The variable hair length module 102 includes two arms 103*a*, 103*b* that are configured to move relative to each other along respective continuous paths 105*a*, 105*b* during the hair rooting process performed by the hair rooting machine 104. While the paths 105*a*, 105*b* can be linear, as shown, it is possible for one or more of the paths 105*a*, 105*b* to have non-linear shapes. The hair thread 120 is configured to engage with each of the two arms 103*a*, 103*b* such that a relative movement of the two arms 103*a*, 103*b* varies the length of each hair strand 122 as the hair strands 122 are rooted into the head 106. For example, the hair thread 120 may be configured to engage with each of the two arms 103*a*, 103*b* by wrapping around each of the two arms 103*a*, 103*b* or by surrounding the two arms 103, 103*b*. The length of each hair strand 122 can be varied to a value within a hair length range that is defined by two extreme lengths, as discussed below. Moreover, the length of each hair strand 122 can be selected to be any value within the hair length range and the hair length range can be continuous because the paths 105*a*, 105*b* are continuous. To put it another way, each value of length is not limited to a set of distinct values, and is only limited to being any value within and including the two extreme lengths.

The control system 110 is configured to input programs of instruction to the variable hair length module 102 to automatically control the relative movement between the two arms 103*a*, 103*b* during operation of the hair rooting machine 104. In the example of FIG. 1, the control system 110 is in communication with the variable hair length module 102 and the hair rooting machine 104 via a data connection 112 that allows the control system 110 to automatically control the variable hair length module 102 and the hair rooting machine 104 during operation. Thus, the variable hair length module 102 does not require manual adjustment to enable the hair rooting machine 104 to root the hair strands 122 of variable lengths into the head 106. Moreover, the continuous paths 105*a*, 105*b* do not limit the variable hair length module 102 to only enable discrete lengths of the rooted hair strands 122. Rather, during operation of the hair rooting machine 104, the two arms 103*a*, 103*b* of the variable hair length module 102 that are automatically controlled by the control system 110 can move relative to each other along the respective continuous paths 105*a*, 105*b*, enabling the hair rooting machine 104 to automatically root the hair strands 122 of continuous variable lengths into the head 106.

Figure 2A:
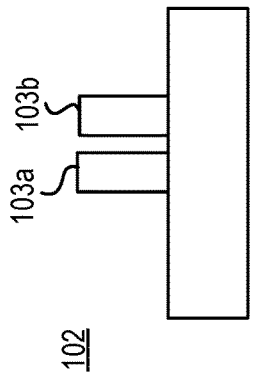
FIG. 2A is a block diagram of the variable hair length module of FIG. 1 configured to produce hair strands of minimum length.
Figure 2B:
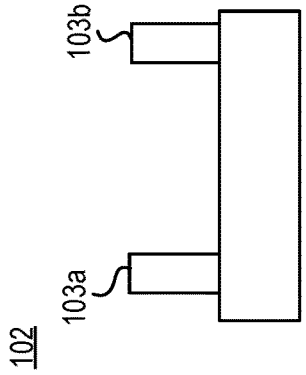
FIG. 2B is a block diagram of the variable hair length module of FIG. 1 configured to produce hair strands of maximum length.

The hair length range is fixed during the hair rooting process applied to a particular head 106. That is, the hair length range is set once the head 106 is positioned for hair rooting in the hair rooting machine 104. For example, as shown in FIGS. 2A and 2B, the hair length range can be given by a minimum length and a maximum length that define the continuous range of length of each hair strand 122 that can be applied to the head 106 during the hair rooting process. At the minimum length, as shown in FIG. 2A, the two arms 103*a*, 103*b* can be arranged at a position along each respective path 105*a*, 105*b* such that the two arms 103*a*, 103*b* are positioned closest to or nearest to each other. At a maximum length, as shown in FIG. 2B, the two arms 103*a*, 103*b* can be arranged at a position along each respective path 105*a*, 105*b* such that the two arms 103*a*, 103*b* are positioned farthest from each other. In this example, the control system 110 can be configured to continuously change the length of each hair strand 122 to any value between and including the minimum length and the maximum length.

Moreover, while not performing the hair rooting process, it is possible to change the hair length range (such as manually by a user or by the control system 110) between a set of distinct hair length ranges. This manual or control system function is separate from the discussion above related to the variable hair length resulting from the relative movement between the arms 103*a*, 103*b*. Instead, this function relates to the overall range of lengths of hair strand that is possible or made available for the relatively moving arms 103*a*, 103*b*. For example, in some implementations in which shorter hair is desired on the head 106, a short hair length range can be defined by a first extreme length of four inches and a second extreme length of six inches. This means that for a shorter hair design, such as a pixie style, crop style, or short bob, the hair strands 122 rooted into the head 106 can have any length from four to six inches. As another example, in other implementations in which longer hair is desired on the head 106, a long hair length range can be defined by an extreme length of six inches and an extreme length of nine inches. This means that for a longer hair design, such as a long layered style or a long shag style, the hair strands 122 rooted into the head 106 can have any length from six to nine inches. As a further example, the two extreme lengths of each hair strand 122 can be pre-set based at least on a size of the head 106 and the desired length of each hair strand 122. This is discussed in greater detail below with reference to FIG. 4 and FIGS. 10D-10F.

Referring to FIGS. 3A-3D, an implementation 302 of the variable hair length module 102 is shown. The variable hair length module 302 includes two arms 303*a*, 303*b* and a base in the form of a track 305 that defines a continuous (and linear) path along an X direction. Each arm 303*a*, 303*b* is configured to move relative to each other along the track 305 such that each arm 303*a*, 303*b* moves along the continuous path. It is alternatively possible for only one of the arms 303*a* or 303*b* to move relative to the other of the arms 303*b* or 303*a*, at various times, and depending on the application. In the example of FIGS. 3A-3D, each arm 303*a*, 303*b* includes a respective base portion 307*a*, 307*b* that is configured to movably attach the respective arm 303*a*, 303*b* to the track 305. Each arm 303*a*, 303*b* also includes a respective end portion 309*a*, 309*b* that extends along the Z direction. During operation, the hair thread (such as the hair thread 120 of FIG. 1) can engage with each of the two arms 303*a*, 303*b* by wrapping around each of the two end portions 309*a*, 309*b* of the arms 303*a*, 303*b* or by surrounding the two end portions 309*a*, 309*b* of the arms 303*a*, 303*b*. The variable hair length module 302 can be used with the hair rooting machine 104 and the control system 110 of FIG. 1.

Each of the two arms 303*a*, 303*b* can be controlled by the control system 110 (FIG. 1). The control system 110 can be configured to input instructions to the variable hair length module 302 that include moving each of the two arms 303*a*, 303*b* relative to each other along the continuous track 305. For example, the control system 110 can be pre-programmed to automatically control the movement of the two arms 303*a*, 303*b* relative to each other depending on a rooting location of the hair thread 120 that is being rooted into the head 106 to produce the hair strands 122. The control system 110 can include programs of instruction that are used for various sizes of the head 106 and desired lengths of the hair strands 122. In an example, a user can input a size of the head 106 and a desired range of lengths of the hair strands 122, and the control system 110 can automatically adjust the programs of instruction to the variable hair length module 302 to produce the desired hair strand 122 lengths on the head 106.

The control system 110 includes an electronic processor, an electronic storage, and an input/output (I/O) interface. The electronic processor is one or more processors suitable for the execution of a computer program such as a general or special purpose microprocessor, and any one or more processors of any kind of digital computer. Generally, a processor receives instructions and data from a read-only memory or a random access memory or both. The electronic processor can be any type of electronic processor. The electronic storage can be volatile memory, such as RANI, or non-volatile memory. In some implementations, the electronic storage can include both non-volatile and volatile portions or components. The electronic storage stores instructions, perhaps as a computer program, that, when executed, cause the processor to communicate with other components in the control system 110 or other components of the variable hair length module 302 and/or the hair rooting machine 104. The I/O interface is any kind of electronic interface that allows the control system 110 to receive and/or provide data and signals to other components of the variable hair length module 302 and/or the hair rooting machine 104, an operator, and/or an automated process running on another electronic device. For example, the I/O interface can include one or more of a touch screen or a communications interface.

Figure 4:
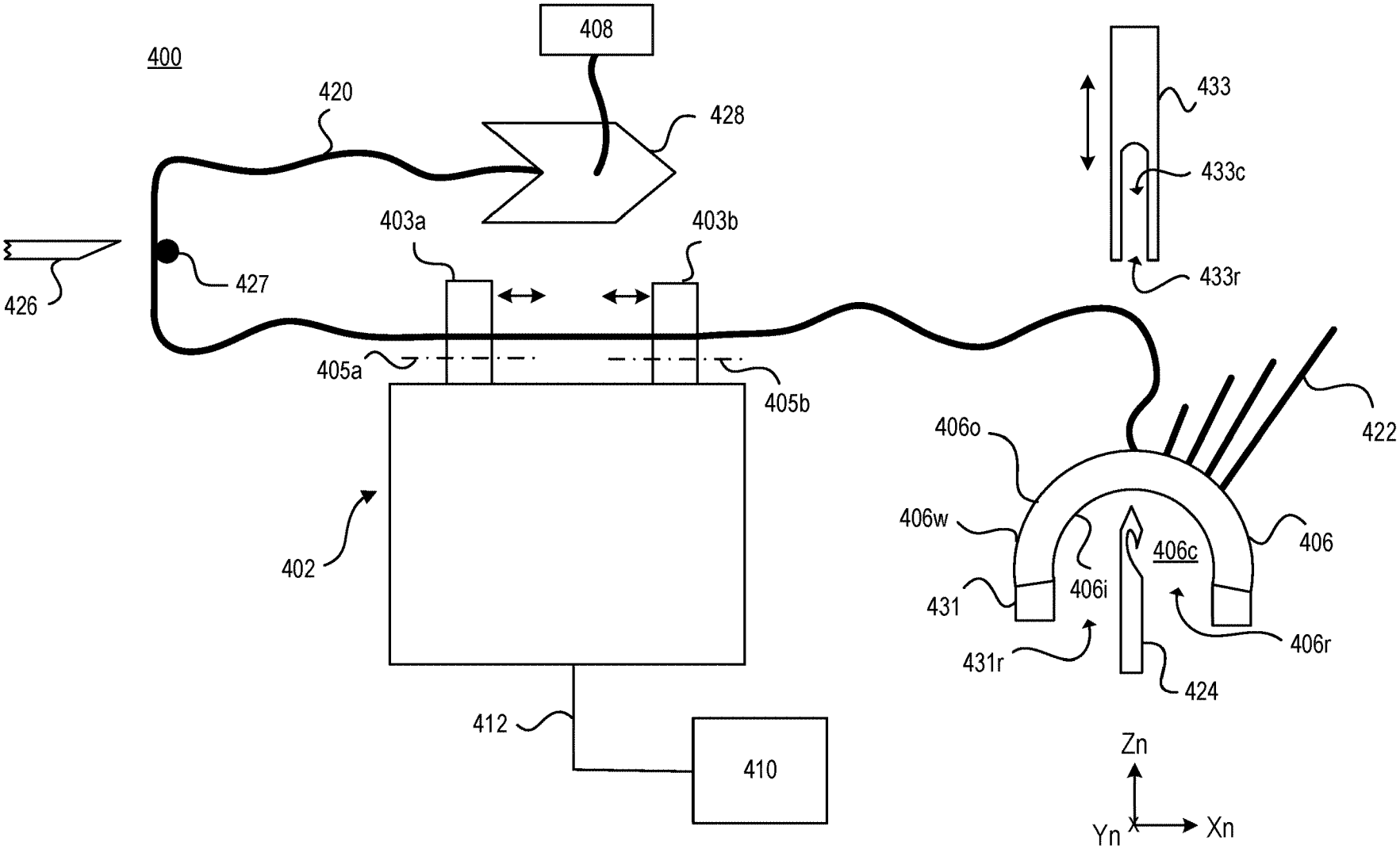
FIG. 4 is a block diagram of a hair rooting apparatus that includes an implementation of a variable hair length module, a control system, a needle, a cutter, and a hair feeding device.

Referring to FIG. 4, a hair rooting apparatus 400 includes a variable hair length module 402 that includes two arms 403*a*, 403*b* configured to move relative to each other on respective continuous paths 405*a*, 405*b*, and a control system 410 configured to input programs of instruction to the variable hair length module 402 to automatically control the relative movement of the two arms 403*a*, 403*b*. The variable hair length module 402 is an implementation of the variable hair length module 102 (FIG. 1) and 302 (FIGS. 3A-3D), and the control system 410 is an implementation of the control system 110 (FIG. 1). The control system 410 communicates with the variable hair length module 402 via the data connection 412 to automatically control the variable hair length module 402.

The hair rooting apparatus 400 also includes a needle 424 configured to root hair thread 420 into a head 406, a cutter 426 configured to cut the rooted hair thread 420 at a cutting location 427 to produce hair strands 422, and a hair feeding device 428 configured to position, at various moments, the hair thread 420 at one or more of the needle 424 and the cutting location 427. The hair thread 420 is configured to engage with each of the two arms 403*a*, 403*b* such that a length of each hair strand 422 is varied by the relative movement of the two arms 403*a*, 403*b*. In this way, the variable hair length module 402 automatically adjusts a length of the hair strands 422 rooted into the head 406.

As shown in FIG. 4, the head 406 is a hollow object that is a three-dimensional wall or form 406*w* through which the hair thread 420 can pass, the wall 406*w* including an inner surface 406*i* and an outer surface 406*o* and a cavity 406*c* being defined within the wall 406*w*. As such, the needle 424 can pierce the head 406 after passing through an open region 406*r* and from within the cavity 406*c* of the head 406 or at the inner surface 406*i* of the head 406 to root the hair thread 420 into the head 406. For example, the needle 424 can root the hair thread 420 into the head 406 at a rooting rate that is defined by a rooting speed of the needle 424. In addition, for example, the cutter 426 can be configured to cut the hair thread 420 at an appropriate time and at the cutting location 427 to produce the hair strands 422.

In some implementations, the hair rooting apparatus 400 includes a mount 431 that is configured to hold the head 406 and to position the head 406 relative to the needle 424. The mount 431 includes an open region 431*r* aligned with the open region 406*r* of the head 406. During operation, the needle 424 can pass through the open region 431*r* and the open region 406*r* to pierce the wall 406*w* of the head 406. The mount 431 can include a shape that is configured to hold the head 406 at the wall 406*w* of the head 406, such as a circular or cylindrical shape defined by the open region 431*r*. In this way, the mount 431 enables the needle 424 to access at least a portion of or the entirety of the wall 406*w* of the head 406 to root the hair thread 420 into the head 406. To move the head 406, the mount 431 is configured to translate along any of and/or rotate about any of the Xn, Yn, or Zn directions in the coordinate system of the hair rooting apparatus 400 (in which the Zn direction aligns with the axial direction of the needle 424). In this way, the head 406 can be translated and/or rotated relative to the needle 424 during operation of the hair rooting apparatus 400. In these implementations, the control system 410 can be in communication with an actuator that controls the motion of the mount 431. Specifically, the control system 410 can be configured to instruct the actuator to adjust the mount 431 to thereby adjust the position of the head 406 relative to the needle 424. For example, the control system 410 can adjust the mount 431 in between moments when the needle 424 pierces the head 406.

In some implementations, the hair rooting apparatus 400 includes a pressing device 433 that is configured to press the head 406 to form a flat surface at a region of the head 406 in which the needle 424 roots the hair thread 420. For example, when the needle 424 begins to pierce the wall 406*w* of the head 406 (by making contact with inner surface 406*i* along the Zn direction), the pressing device 433 is configured to be positioned at the outer surface 406*o* of the wall 406*w* of the head 406 to press the wall 406*w* along the −Zn direction, and form the flat surface at the region of the head 406 in which the needle 424 is rooting the hair thread 420. At other times when the needle 424 is not piercing the head 406, the pressing device 433 is positioned away from the head 406 so as not to interfere with other operations of the hair rooting apparatus 400. Further, the control system 410 can be in communication with the pressing device 433 and control the movement of the pressing device 433. Specifically, the control system 410 can adjust the position of the pressing device 433 relative to the head 406 at appropriate times during operation.

The pressing device 433 includes an open region 433*r* and a cavity 433*c* that is configured to receive the needle 424 at appropriate times during operation. The cavity 433*c* that receives the needle 424 enables the pressing device 433 to be positioned at the outer surface 406*o* of the head 406 to press the head 406 and form the flat surface at the region of the head 406 when the needle 424 pierces the wall 406*w* of the head 406. The pressing device 433 can be made of a rigid material that does not deform or bend when the pressing device 433 presses the head 406. For example, the pressing device 433 can be made of a metal.

Figure 5C:
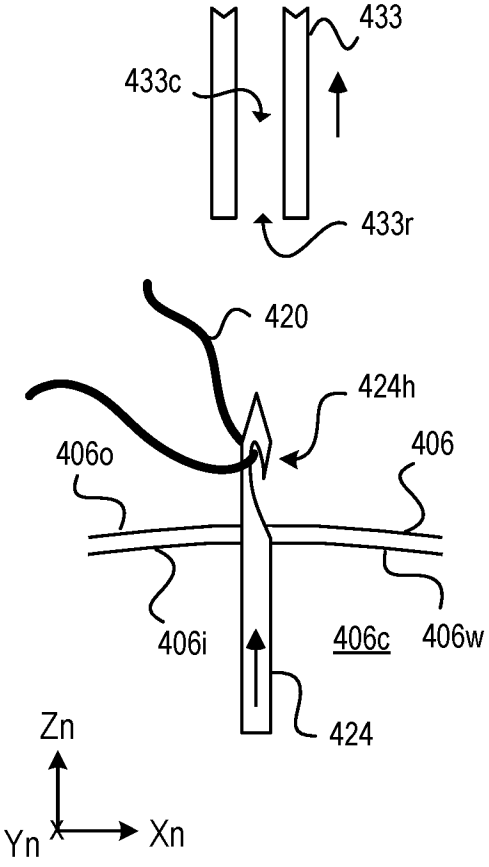
FIG. 5C is a side cross-sectional view of the needle, the head portion, and the pressing device of FIG. 5A, in which the needle has passed through the head portion and engages with a hair thread.
Figure 5B:
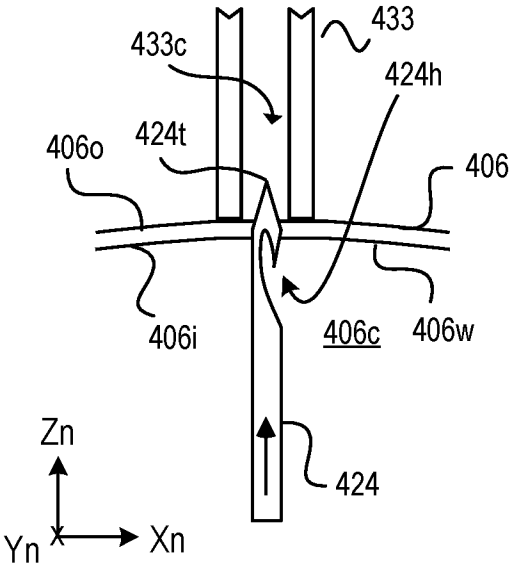
FIG. 5B is a side cross-sectional view of the needle, the head portion, and the pressing device of FIG. 5A, in which the needle is piercing the head.
Figure 5A:
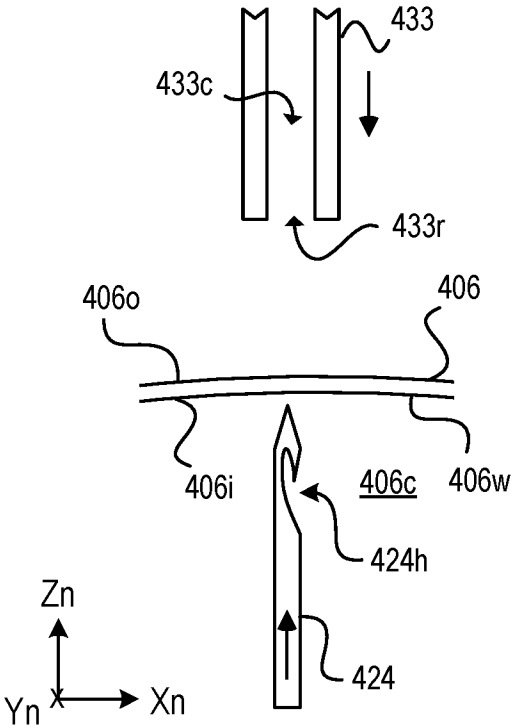
FIG. 5A is a side cross-sectional view of the needle, a portion of a head, and a pressing device of FIG. 4, in which the needle has not yet pierced the head.

Referring also to FIGS. 5A-5C, the needle 424 includes a hook 424*h* that is configured to, at certain times during rooting, grab the hair thread 420 from the hair feeding device 428. The hook 424*h* includes a pointed tip 424*t* (labeled in FIG. 5B) that allows the needle 424 to pierce the head 406. The hook 424*h* is defined by a recessed region that allows the needle 424 to grab the hair thread 420 from the hair feeding device 428. The needle 424 can be made of a rigid material that does not deform or bend when the needle 424 pierces the material of the head 406. For example, the needle 424 can be made of a metal.

As shown in FIG. 5A, the needle 424 has passed through the open region 406*r* along the Zn direction (the Zn direction defined relative to the axial direction of the needle 424) and the needle 424 is inside the cavity 406*c*. The Zn direction can correspond to a direction that is perpendicular to a tangent taken at the portion of the wall 406*w* of the head 406 at which the needle 424 pierces to thereby root the hair thread 420. At the same time, the pressing device 433 is moved along the −Zn direction toward the wall 406*w* of the head 406. As shown in FIG. 5B, the needle 424 moves along the Zn direction such that the pointed tip 424*t* of the hook 424*h* has pierced the wall 406*w* of the head 406. In addition, the pressing device 433, after being moved along the −Zn direction to the portion of the wall 406*w* at which the needle 424 has pierced the head 406, presses the wall 406*w* as the needle 424 pierces the wall 406*w* of the head 406.

As shown in FIG. 5C, the needle 424 continues to move along the Zn direction such that the hook 424*h* extends beyond the wall 406*w* to a position at which the recessed portion of the hook 424*h* can retain the hair thread 420. In addition, the pressing device 433 has moved along the −Zn direction to a position that is away from the head 406 so as not to interfere with the retention of the hair thread 420 by the hook 424*h*. As such, the hook 424*h* of the needle 424 engages with the hair thread 420 and grabs the hair thread 420 from the hair feeding device 428 (the pressing device 433 not interfering when the needle 424 grabs the hair thread 420). When the needle 424 moves back along the −Zn direction (after having grabbed the hair thread 420) to a position within the cavity 406, the needle 424 also pulls the hair thread 420 into the cavity 406 through the wall 406*w* of the head 406. In this way, the needle 424 roots the hair thread 420 into the head 406.

Referring again to FIG. 4, the needle 424 and the cutting location 427 (at which the cutter 426 periodically engages and cuts the hair thread 420) are positioned in the hair rooting apparatus 400 such that the hair thread 420 is configured to engage with each of the two arms 403*a*, 403*b* between the needle 424 and the cutting location 427. The two extreme lengths of each hair strand 422 are further determined by the relative positions of the needle 424 and the cutting location 427 in the hair rooting apparatus 400. For example, when the needle 424 is positioned farther away from the cutting location 427, the hair length range defined by two extreme lengths of each hair strand 422 is greater, and when the needle 424 is positioned closer to or nearer to the cutting location 427, the hair length range defined by the two extreme lengths of each hair strand 422 is smaller. In other words, when the desired hair length of each hair strand 422 is within a smaller range (such as when the size of the head 406 is small), the needle 424 and the cutting location 427 can be placed closer to or nearer to each other. Moreover, when the desired hair length of each hair strand is within a larger range (such as when the size of the head 406 is large), the needle 424 and the cutting location 427 can be placed farther from each other. For example, the needle 424 and the cutting location 427 can be positioned manually, such as by a user, relative to each other prior to hair rooting by the hair rooting apparatus 400 to define the two extreme lengths of each hair strand 422.

The hair feeding device 428 positions the hair thread 420 at the needle 424 at the appropriate time to enable the hair thread 420 to be rooted into the head 406. The hair feeding device 428 also positions the hair thread 420 at the cutting location 427 at the appropriate time to enable the rooted hair thread 420 to be cut at the cutting location 427 the cutter 426 to produce the hair strands 422. As such, the hair feeding device 428 can move relative to (such as toward or away from at various times) the needle 424, the cutting location 427, and the variable hair length module 402 to engage the hair thread 420 with each of the two arms 403*a*, 403*b* between the needle 424 and the cutting location 427. In the example of FIG. 4, a supply 408 of the hair thread 420 is coupled with the hair feeding device 428 such that the supply 408 continuously feeds the hair thread 420 to the hair feeding device 428 when the hair feeding device 428 moves relative to the needle 424, the cutting location 427, and the variable hair length module 402. Specifically, the supply 408 can move with the hair feeding device 428 as the hair feeding device 428 moves to continuously supply the hair feeding device 428 with the hair thread 420.

Figure 6:
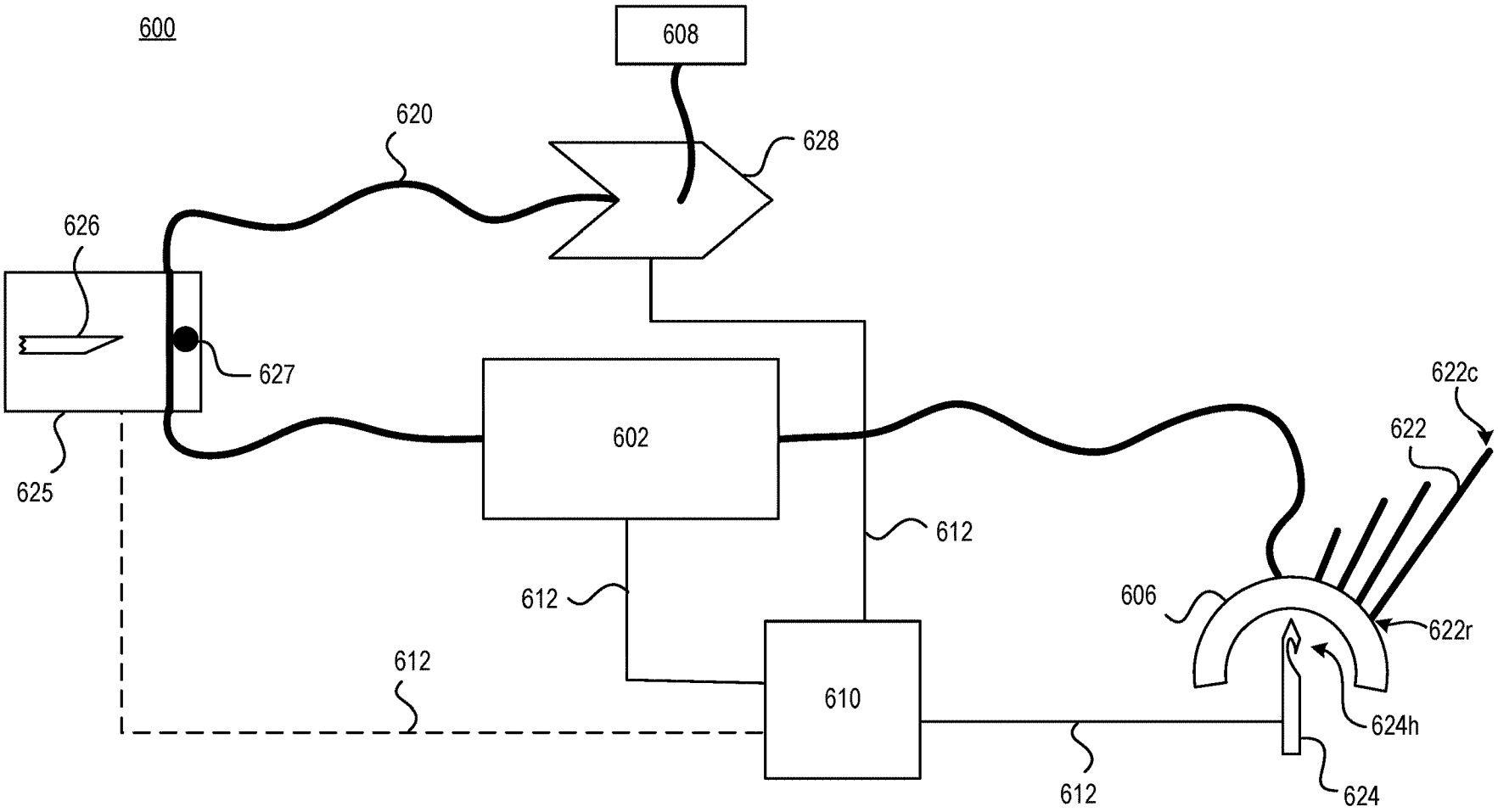
FIG. 6 is a block diagram of an implementation of a hair rooting apparatus that includes a variable hair length module, a control system, a needle, a trimming mechanism, and a hair feeding device.

Referring to FIG. 6, a hair rooting apparatus 600 includes a variable length module 602 configured to adjust a length between a cut region 622*c* and a root region 622*r* (at a head 606) between hair strands 622, and a control system 610 in communication with the variable length module 602. The control system 610 is an implementation of the control system 110 (FIG. 1) and the control system 410 (FIG. 4).

The hair rooting apparatus 600 also includes a hair feeding device 628 configured to guide a hair thread 620 relative to the head 606, a needle 624 configured to pierce the head 606 to root the hair thread 620 into the head 606, and a trimming mechanism 625. The control system 610 is also in communication with the hair feeding device 628 and the needle 624. The control system 610 communicates with the variable length module 602, the hair feeding device 628, and the trimming mechanism 625 respective data connections 612.

The needle 624 is an implementation of the needle 424 of FIG. 4. The needle 624 includes a hook 624*h* that is configured to, at certain times during rooting, grab the hair thread 620 from the hair feeding device 628. In this way, the needle 624 can root the hair thread 620 into the head 606, forming the root region 622*r* of each hair strand 622. The control system 610 is configured to adjust one or more aspects of the motion of the needle 624 based on the state of the variable length module 602. For example, the motion of the needle 624 can include a stitch per inch requirement and the control system 610 can increase or decrease the stitch per inch of the needle 624 depending on the state of the variable length module 602. As another example, the motion of the needle 624 can be pre-programmed and based on a desired hair rooting path and the stitch per inch requirement. In addition, the control system 610 can further be configured to control a rooting speed of the needle 624. For example, the control system 610 can be configured to increase or decrease the rooting speed of the needle 624 based on the state of the variable length module 602.

The trimming mechanism 625 includes a cutting location 627 and a cutter 626 configured to cut the hair thread 620 to form the hair strands 622 at various moments when the hair thread 620 is engaged at the cutting location 627. The cutter 626 is an implementation of the cutter 426 of FIG. 4. For example, the cutter 626 includes a sharp blade configured to cut the hair thread 620 at the cutting location 627, forming the cut region 622*c* of each hair strand 622. The control system 610 can also be in communication with the trimming mechanism 625 by way of a dedicated data connection 612. Moreover, the control system 610 can further be configured to adjust one or more aspects of the trimming mechanism 625 based on the state of the variable length module 602. For example, the control system 610 can be configured to control the cutter 626 of the trimming mechanism 625 to cut the hair thread 620 at the cutting location 627 at an appropriate time to form each hair strand 622. In this way, each hair strand 622 can include a desired length between each cut region 622*c* and each root region 622*r* of each hair strand 622.

The hair feeding device 628 is an implementation of the hair feeding device 428 of FIG. 4. The hair feeding device 628 guides the hair thread 620 relative to the head 606. Specifically, the hair feeding device 628 guides the hair thread 620 such that the hair thread 620 engages with the needle 624, the variable length module 602, and the trimming mechanism 625 during operation of the hair rooting apparatus 600. A supply 608 of the hair thread 620 is coupled with the hair feeding device 628 such that the supply 608 continuously feeds the hair thread 620 to the hair feeding device 628 when the hair feeding device 628 moves relative to the needle 624, the trimming mechanism 625, and the variable length module 602.

The control system 610 is configured to adjust one or more aspects of the motion of the hair feeding device 628 based on the state of the variable length module 602. For example, the control system 610 can be configured to instruct the hair feeding device 628 to engage the hair thread 620 with one or more of the needle 624, the variable length module 602, and the trimming mechanism 625 at appropriate times during operation of the hair rooting apparatus 600. As such, the hair thread 620 can be rooted into the head 606 by the needle 624 to form the root region 622*r* of each hair strand 622, the trimming mechanism 625 can engage with the hair thread 620 to form the cut region 622*c* of each hair strand 622, and the variable length module 602 can adjust the length between the cut region 622*c* and the root region 622*r* of each hair strand 622 to vary the length between the hair strands 622.

Figure 7A:
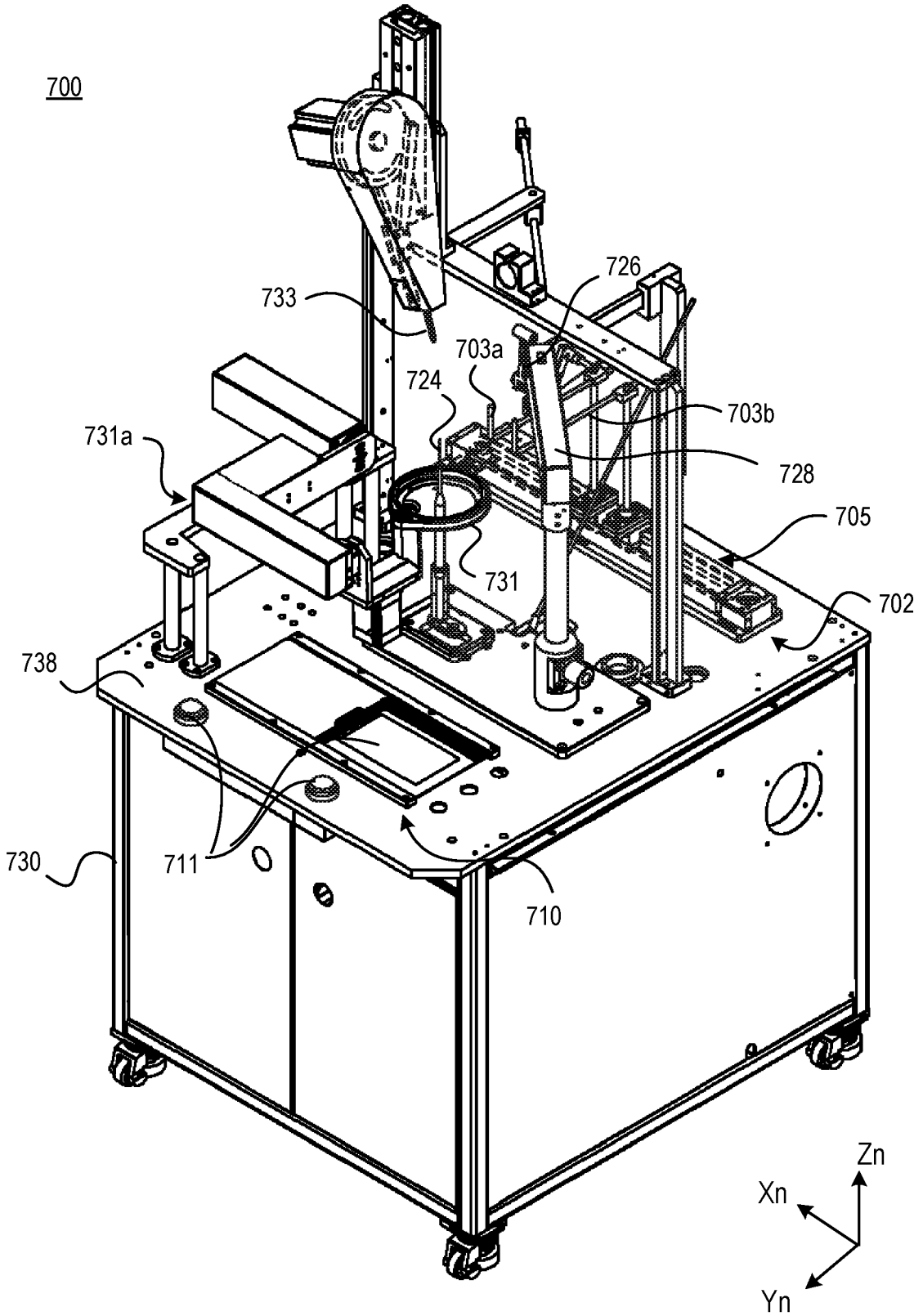
FIG. 7A is a perspective view of an implementation of a hair rooting apparatus that includes a variable hair length module, a control system, a needle, a cutter, a hair feeding device, a mount, and a pressing device.
Figure 7B:
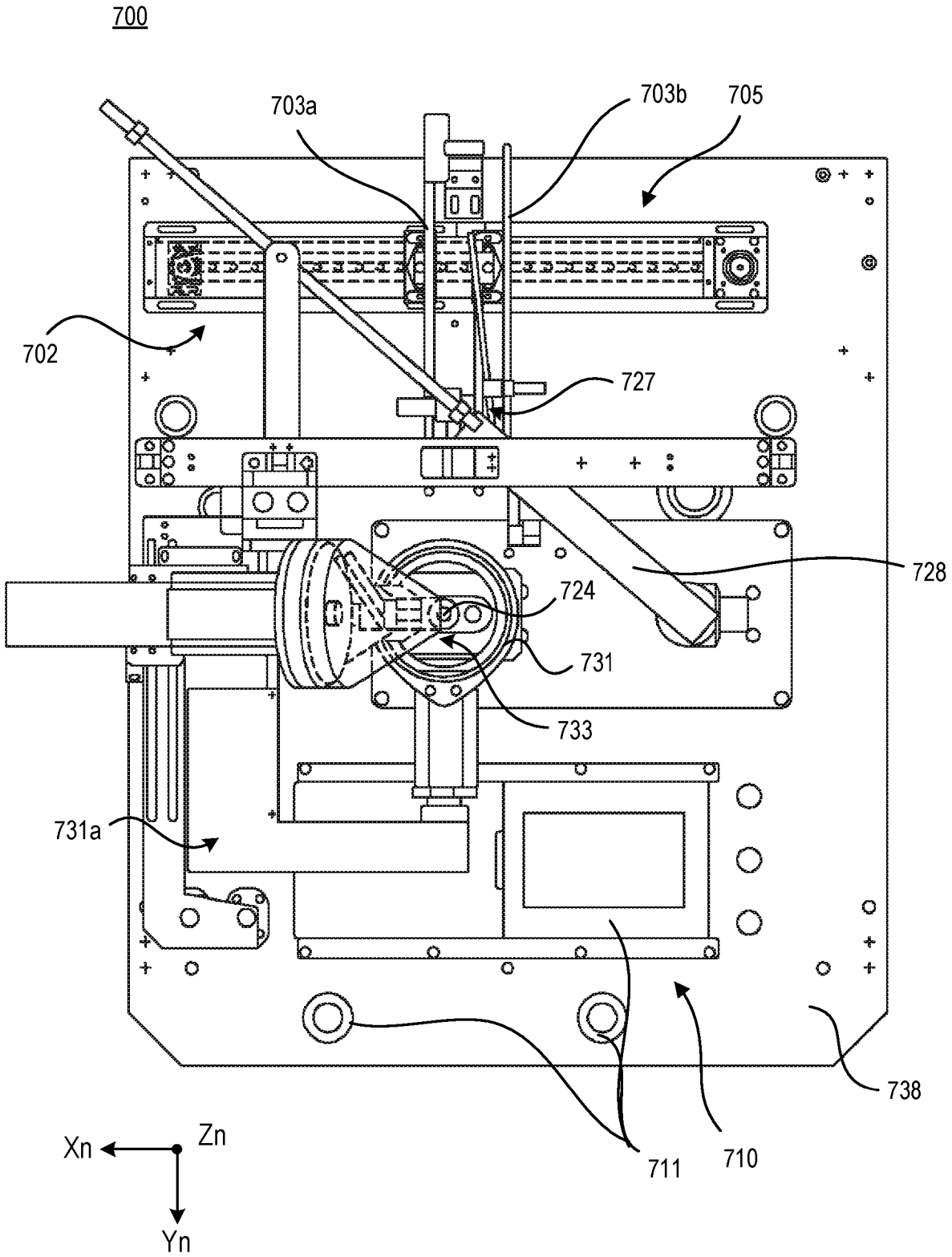
FIG. 7B is a top view of the implementation of the hair rooting apparatus of FIG. 7A.

Referring to FIGS. 7A and 7B, an implementation 700 of any of the apparatuses 100 (FIG. 1), 400 (FIG. 4), or 600 (FIG. 6) includes a variable hair length module 702, a control system 710, a needle 724, a cutter 726, and a hair feeding device 728. The hair rooting apparatus 700 can be operated with the control system 110 (FIG. 1), the control system 410 (FIG. 4), and the control system 610 (FIG. 6). The hair rooting apparatus 700 also includes a mount 731 and a pressing device 733. Each component of the hair rooting apparatus 700 is supported by a base 730 that includes a flat surface 738. Each of the components of the hair rooting apparatus 700 are configured to be fixed to the surface 738. For example, each of the components of the hair rooting apparatus 700 can be fixed to the surface 738 by mechanical connectors, such as screws or bolts.

The variable hair length module 702 is an implementation of the variable hair length module 102 (FIGS. 1, 2A, and 2B), the variable hair length module 302 (FIGS. 3A-3D), and the variable hair length module 402 (FIG. 4). The variable hair length module 702 includes two arms 703*a*, 703*b* that are configured to move relative to each other along a continuous track 705. Each of the arms 703*a*, 703*b* is positioned between the cutter 726 (and the cutting location 727) and the needle 724. Hair thread can engage with the two arms 703*a*, 703*b* by surrounding each of the two arms 703*a*, 703*b* or wrapping around each of the two arms 703*a*, 703*b* (such as described with reference to FIGS. 3A-3D). By the relative movement of the two arms 703*a*, 703*b*, the variable hair length module 702 adjusts the lengths of hair strands that are rooted into a head (such as the head 106 of FIG. 1, the head 406 of FIG. 4, or the head 606 of FIG. 6) mounted on the mount 731. As such, the lengths of the hair strands can be adjusted within a hair length range that is defined by two extreme lengths.

The needle 724 is an implementation of the needle 424 (FIGS. 4 and 5A-5C) and the needle 624 (FIG. 6). The cutter 726 is an implementation of the cutter 426 (FIG. 4) and the cutter 626 (FIG. 6). As such, the needle 726 is configured to root the hair thread into the head and the cutter 726 is configured to cut the rooted hair thread to produce the hair strands. The relative positions of the needle 724 and the cutter 726 also determine the two extreme lengths of the hair strands (as described with reference to FIG. 4).

The mount 731 is an implementation of the mount 431 (FIG. 4) and the pressing device 733 is an implementation of the pressing device 433 (FIG. 4). The mount 731 is configured to hold the head (not shown in FIGS. 7A and 7B) and position the head relative to the needle 724. The pressing device 733 is configured to press the head to form a flat surface at the region of the head in which the needle 724 roots the hair thread. The position of the mount 731 is adjusted by an actuator 731*a*. The actuator 731*a* is configured to adjust the mount 731 such that the mount 731 can translate along any of and/or rotate about any of the Xn, Yn, or Zn directions in the coordinate system of the hair rooting apparatus 700 (in which the Zn direction aligns with the axial direction of the needle 724). In this way, the mount 731 can be adjusted to adjust the position of the head relative to the needle 724.

The hair feeding device 728 is an implementation of the hair feeding device 428 (FIG. 4) and the hair feeding device 628 (FIG. 6). As such, the hair feeding device 728 guides the hair thread such that the hair thread engages with the needle 724, the variable hair length module 702, and the cutting location 727 during operation of the hair rooting apparatus 700. A supply (not shown in FIGS. 7A and 7B) of the hair thread is coupled with the hair feeding device 728 such that the supply continuously feeds the hair thread to the hair feeding device 728 during operation. In the example of FIGS. 7A and 7B, the hair feeding device 728 rotates about the Zn direction (in the Xn-Yn plane) to continuously guide the hair thread and engage the hair thread with the needle 724, the two arms 703*a*, 703*b* of the variable hair length module 702, and the cutting location 727.

The control system 710 includes an electronic processor, an electronic storage, and an input/output (I/O) interface 711 (described with reference to FIG. 1). The I/O interface 711 allows the control system 710 to receive and/or provide data and signals to other components of the hair rooting apparatus 700, an operator, and/or an automated process running on another electronic device. For example, the I/O interface 711 can include one or more of a touch screen or a communications interface. In the example of FIGS. 7A and 7B, the control system 710 controls the operation of the variable hair length module 702, the motion of the cutter 726, the motion of the needle 724, the motion of the hair feeding device 728, the motion of the mount 731, and the motion of the pressing device 733. At least some components of the control system 710 are stored within the base 730 (and are not visible in FIG. 7A), while the I/O interface is at least partly positioned on the surface 738.

Figure 8:
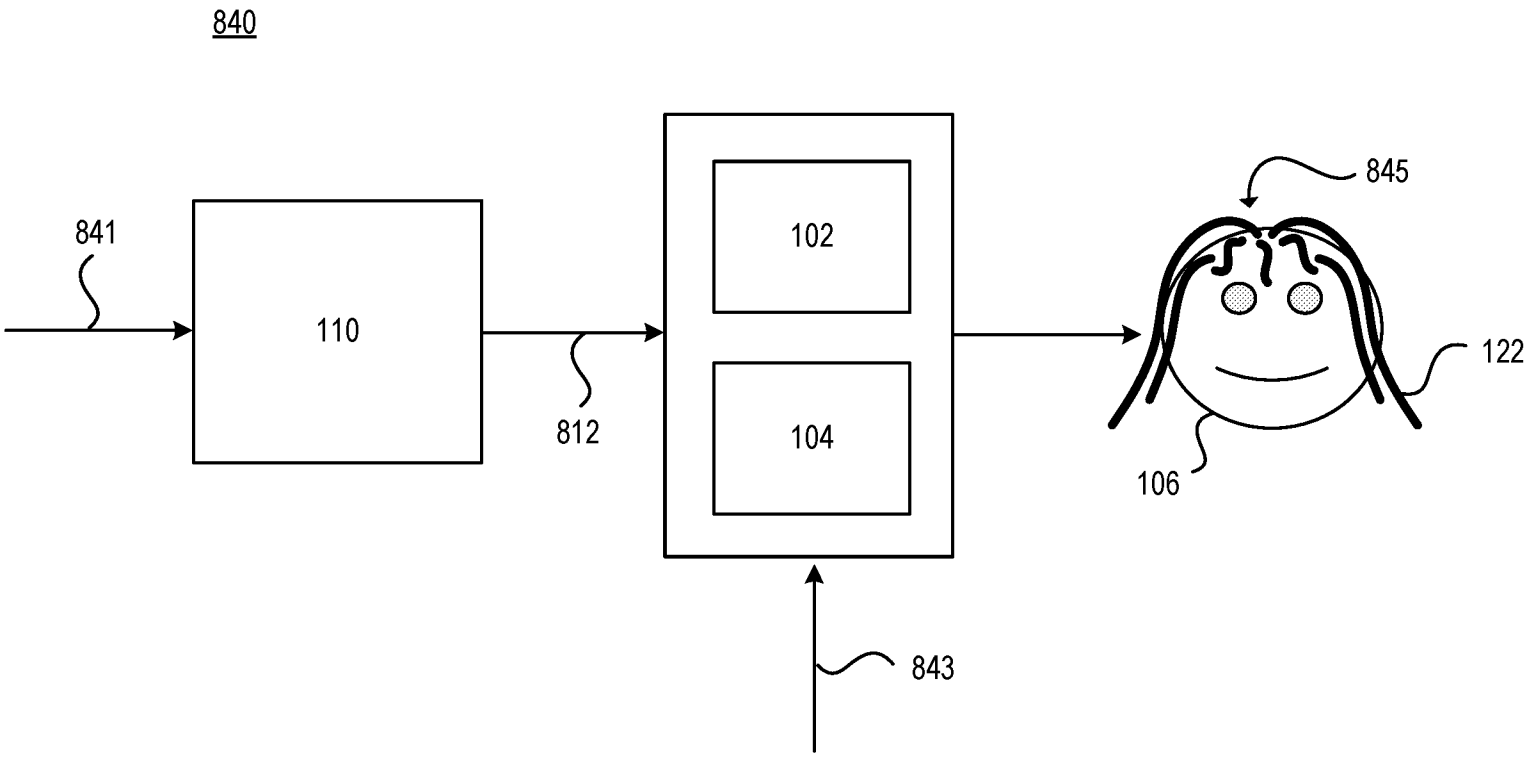
FIG. 8 is a block diagram of a hair rooting process that is performed by the apparatus of FIG. 1.

Referring to FIG. 8, a hair rooting process 840 is performed by the apparatus 100 (FIG. 1) or any of the other apparatuses 400, 600, or 700. Programs of instruction 841 are input to the control system 110. The programs of instruction 841 include programs of movement for the variable hair length module 102 and the hair rooting machine 104. Manual settings 843 are input for the variable hair length module 102 and the hair rooting machine 104 according to desired lengths of the hair strands 122. The control system 110 instructs movement of the variable hair length module 102 and the hair rooting machine 104 based on the programs of instruction 841 and the manual settings 843 through a data connection 812. The variable hair length module 102 and the hair rooting machine 104 root the hair thread 120 into the head 106 to form the hair strands 122 of variable lengths. A desired hair style 845 for the head 106 (formed from the hair strands 122 of variable lengths) is output from the hair rooting process 840.

The programs of instruction 841 include computer programs for the variable hair length module 102 and the hair rooting machine 104 that are input to the electronic processor of the control system 110 for execution of the computer programs and/or stored in the electronic storage of the control system 110. The programs of instruction 841 enable the automation of the variable hair length module 102 and the hair rooting machine 104. For example, the programs of instruction 841 include programs that instruct the movement of the two arms 103*a*, 103*b* of the variable hair length module 102 to move relative to each other along their continuous paths 105*a*, 105*b*. In another example, the programs of instruction 841 include programs that instruct the movement of the two arms 103*a*, 103*b* at appropriate times when the hair thread 120 is rooted into the head 106 to form the hair strands 122 of desired lengths at each region of the head 106. In this way, the programs of instruction 841 enable the variable hair length module 102 to automatically adjust the lengths of the hair strands 122 (by adjusting the relative position of the two arms 103*a*, 130*b*), such as at specific regions of the head to form the desired hair style 845. In another example, the programs of instruction 841 include programs that instruct each component of the hair rooting machine 104 to move at appropriate times in relation to each other component and the state of the variable hair length module 102.

The manual settings 843 include desired and/or appropriate settings that are manually input by a user for the variable hair length module 102 and the hair rooting machine 104. The manual settings 843 can be directly input to the variable hair length module 102 and the hair rooting machine 104. In other examples, the manual settings 843 can be input through the I/O interface of the control system 110 and executed by the electronic processor and/or stored in the electronic storage of the control system 110.

The manual settings 843 for the variable hair length module 102 can include a desired range of lengths of the hair strands 122 that is defined by a minimum and a maximum length of the hair strands 122. For example, the user can define the range of lengths of the hair strands 122 to include smaller lengths when the size of the head 106 is smaller or larger lengths when the size of the head 106 is larger. As such, the variable hair length module 102 operates according to the input range of lengths of the hair strands 122. In other words, the two arms 103*a*, 103*b* operate within a relative position from each other based on the input range of lengths of the hair strands 122. In addition, the manual settings 843 can include a size of the head.

The manual settings 843 can include settings relating to a movement of the needle (such as the needle 424 of FIG. 4, the needle 624 of FIG. 6, or the needle 724 of FIGS. 7A and 7B) such as a rooting speed of the needle or a stitch per inch requirement. The manual settings 843 can include settings relating to loading of the head 106 onto the mount (such as the mount 424 of FIG. 4 or 724 of FIGS. 7A and 7B). For example, the user can load the head 106 onto the mount. In another example, the head 106 can be loaded onto the mount by an automatic mechanism such as a robotic arm.

The control system 110 receives the programs of instruction 841 and executes the programs of instruction 841 in the electronic processor of the control system 841. During operation of the apparatus 100, the control system 841 automatically instructs the movement of the variable hair length module 102 and the hair rooting apparatus 104 based on the programs of instruction 841. In addition, the variable hair length module 102 and the hair rooting apparatus 104 automatically move during operation based on the manual settings 843 input by the user. The hair thread 120 is rooted into the head 106 to form the hair strands 122 of variable lengths based on the programs of instruction 841 and the manual settings 843. In this way, the desired hair style 845 for the head 106 that is formed from the hair strands 122 of variable lengths is produced by the apparatus 100.

Figure 9:
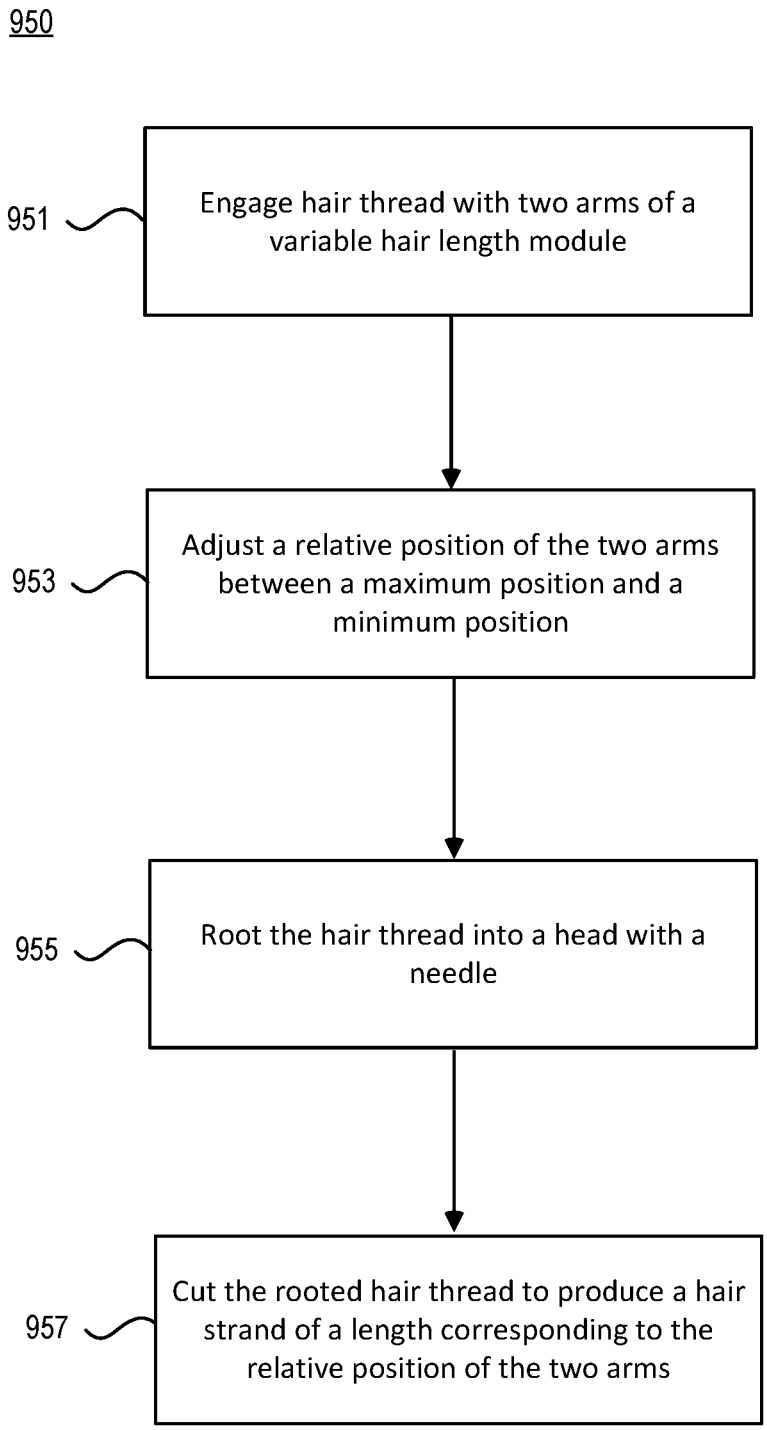
FIG. 9 is a procedure for rooting hair strands of variable lengths.

Referring to FIG. 9, a procedure 950 is performed for rooting hair strands of variable lengths into a head (such as the head 106, 406, 606). The procedure 950 can be performed with respect to the apparatus 100 (FIG. 1), the hair rooting apparatus 400 (FIG. 4), the hair rooting apparatus 600 (FIG. 6), or the hair rooting apparatus 700 (FIGS. 7A and 7B). The procedure 950 can also be performed with respect to any one of the variable hair length module 102 (FIG. 1), the variable hair length module 302 (FIGS. 3A-3D), the variable hair length module 402 (FIG. 4), the variable length module 602 (FIG. 6), and the variable hair length module 702 (FIGS. 7A and 7B). In the following, the procedure is described with respect to the hair rooting apparatus 400.

The procedure 950 includes engaging hair thread with two arms of a variable hair length module (951). For example, the hair thread 420 can engage with the two arms 403*a*, 403*b* of the variable hair length module 402 by wrapping the hair thread 420 around each of the two arms 403*a*, 403*b* or by surrounding each of the two arms 403*a*, 403*b* with the hair thread 420. In addition, the hair feeding device 428 can be configured to guide the hair thread 420 relative to the head 406. As such, the hair feeding device 428 can guide the hair thread 420 to wrap around or surround each of the two arms 403*a*, 403*b* between moments when the hair feeding device 428 positions the hair thread 420 at the needle 424 and the cutter 426.

Figure 10C:
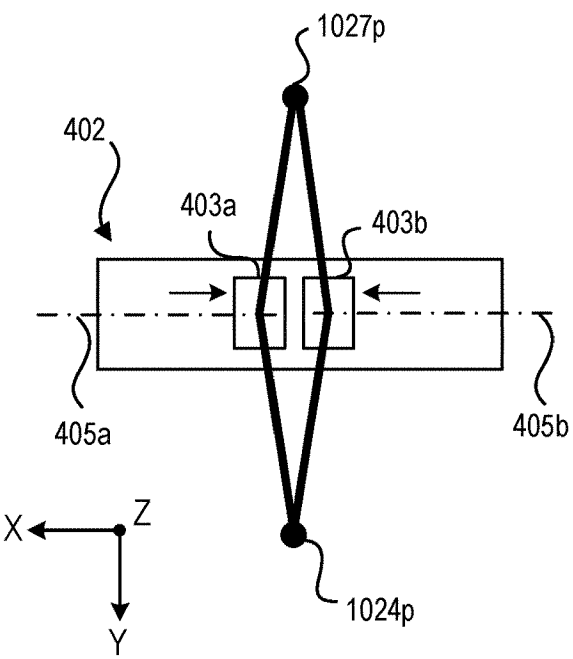
FIG. 10C is a top view of the variable hair length module of FIG. 4 when the two arms are at a minimum relative position from each other.
Figure 10B:
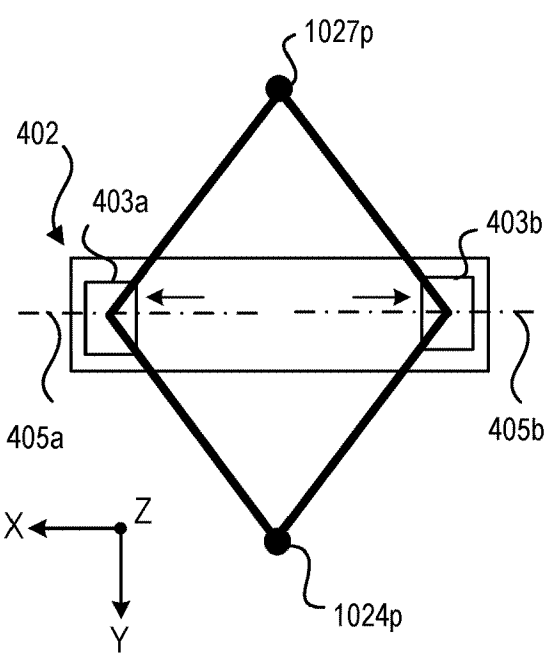
FIG. 10B is a top view of the variable hair length module of FIG. 4 when the two arms are at a maximum relative position from each other.
Figure 10A:
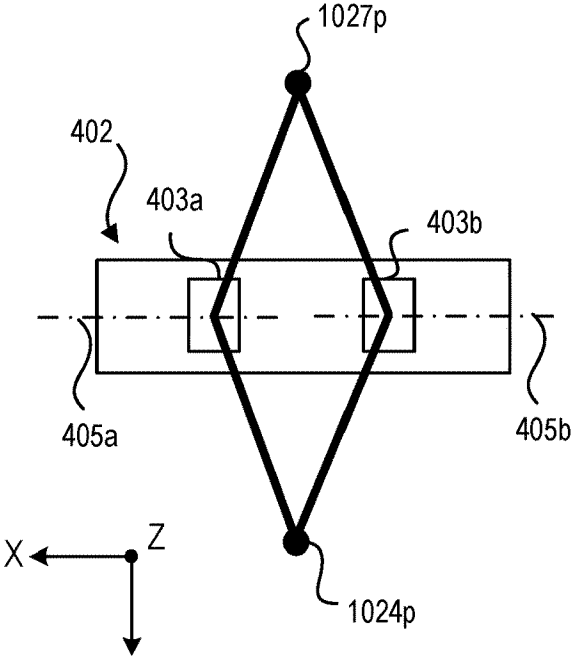
FIG. 10A is a top view of the variable hair length module of FIG. 4 when two arms of the variable hair length module are at an intermediate relative position from each other.

A relative position of the two arms 403*a*, 403*b* is adjusted between a maximum position and a minimum position (953). The maximum position produces hair strands 422 of maximum length and the minimum position produces hair strands 422 of minimum length. The relative position of the two arms 403*a*, 403*b* allows for a continuous range of lengths of each hair strand 422 that is between the maximum length and the minimum length. For example, referring also to FIGS. 10A-10C, the relative position of two arms 403*a*, 403*b* of the variable hair length module 402 is adjusted between a maximum position (FIG. 10B) and a minimum position (FIG. 10C). In the example of FIGS. 10A-10C, the hair thread 420 is also engaged at a position 1024*p* of the needle 424 and at a position 1027*p* of the cutting location 427.

For example, with reference to FIG. 10A, the two arms 403*a*, 403*b* are at a relative position that is between or intermediate of the maximum position and the minimum position at which the length of the hair strands 422 produced is between the maximum length and the minimum length. In FIG. 10B, the relative position of the two arms 403*a*, 403*b* is adjusted to the maximum position at which the length of the hair strands 422 produced is the maximum length. In FIG. 10C, the relative position of the two arms 403*a*, 403*b* is adjusted to the minimum position at which the length of the hair strands 422 produced is the minimum length. Because the two arms 403*a*, 403*b* are configured to move relative to each other along their respective continuous paths 405*a*, 405*b*, the relative position of the two arms 403*a*, 403*b* allows for a continuous range of lengths of each hair strand 422 that is between the maximum length (FIG. 10B) and the minimum length (FIG. 10C). For example, the control system 410 can instruct the variable hair length module 402 to adjust the relative position of the two arms 403*a*, 403*b* between the maximum and minimum lengths at appropriate times during operation of the hair rooting apparatus 400.

In addition, the hair feeding device 428 can be adjusted based on the relative position of the two arms 403*a*, 403*b* during operation. For example, the movement and/or position of the hair feeding device 428 can be adjusted when the two arms 403*a*, 403*b* move nearer to each other or farther from each other in order to continually engage the hair thread 420 with each of the two arms 403*a*, 403*b* during operation. Moreover, the distance between the position 1024*p* of the needle 424 that is configured to root the hair thread 420 into the head 406 and the position 1027*p* of the cutting location 427 (where the cutter 426 is configured to cut the hair thread 420) can be adjusted. Adjustment of the distance between the needle 424 and the cutting location 427 also determines the maximum length and minimum length of the hair strands 422. For example, when the distance between the position 1024*p* of the needle 424 and the position 1027*p* of the cutting location 427 is smaller, the maximum length and the minimum length of the hair strands 424 are both smaller. When the distance between the position 1024*p* of the needle 424 and the position 1027*p* of the cutting location 427 is larger, the maximum length and the minimum length of the hair strands 424 are both larger.

The hair thread is rooted into the head with the needle (955). The hair thread 420 can be rooted into the head 406 with the needle 424. The control system 410 can adjust the speed of the needle 424 and/or the stitch per inch requirement of the needle 424 during operation. In operation, with additional reference to FIGS. 5A-5C, the needle 424 can pass through the open region 406*r* of the head along the Zn direction into the cavity 406*c* of the head. The needle 424 can move along the Zn direction and the pointed tip 424*t* of the needle 424 can pierce the wall 406*w* of the head 406 such that the hook 424*h* of the needle is above (along the +Zn direction) the outer surface 406*o* of the head 406. The hook 424*h* of the needle 424 can grab that hair thread 420 from the hair feeding device 428 and move along the −Zn direction (after having grabbed the hair thread 420) to root the hair thread 420 into the head 406. In some implementations, the pressing device 433 can be configured to press the wall 406*w* of the head 406 as the needle 424 pierces the wall 406*w* of the head 406 to allow the needle 424 to pierce a flat region of the head 406.

The rooted hair thread is cut to produce the hair strand of the length corresponding to the relative position of the two arms (957). For example, the cutter 426 cuts the rooted hair thread 420 that is engaged at the cutting location 427 to produce the hair strand 422 of the length corresponding to the relative position of the two arms 403*a*, 403*b*. In addition, the control system 410 can instruct the cutter 426 to cut the rooted hair thread 420 at an appropriate time during operation of the hair rooting apparatus 400. For example, referring also to FIGS. 10A-10C, when the two arms 403*a*, 403*b* are at a relative position that is between or intermediate of the maximum position and the minimum position (FIG. 10A), the cutter 426 can cut the hair thread 420 engaged at the cutting location 427 to produce a hair strand 422 with a length that is between the maximum length and the minimum length. When the two arms 403*a*, 403*b* are at the maximum position (FIG. 10B), the cutter 426 can cut the hair thread 420 to produce a hair strand 422 with a length that is the maximum length. When the two arms 403*a*, 403*b* are at a relative position that is the minimum position, the cutter 426 can cut the hair thread 420 to produce a hair strand 422 with a length that is the minimum length. In this way, the hair rooting apparatus 400 that includes the variable hair length module 402 roots hair strands 422 of variable lengths into the head 406.

In some situations during hair rooting, the relative position of the two arms 403*a*, 403*b* can be held constant in between hair thread rootings (957) or for a set number of hair rootings (957). In these situations, the area of the head 406 that is being rooted has hair strands 422 of equal length.

Referring to FIGS. 10D-10F, and as mentioned above, the hair length range can be changed between a set of distinct hair length ranges and during the down time between hair rooting processes applied to different heads 106. The hair length range can be adjusted manually by a user, or under control of the control system 110. The hair length range can be adjusted by adjusting a distance between the position 1024*p* of the needle 424 and the position 1027*p* of the cutting location 427, as shown. In this case, the hair length range of FIGS. 10D-10F is longer than the hair length range of FIGS. 10A-10C. Thus, the settings in FIGS. 10A-10C could be used in implementations in which shorter hair is desired on the head 406, while the settings in FIGS. 10D-10F can be used in implementations in which longer hair is desired on the head 406. These settings can be adjusted during hair rooting in a single head 406 or in between hair rooting for distinct heads.

In one example, prior to hair rooting in a single head 406, the distance between the position 1024*p* of the needle 424 and the position 1027*p* of the cutting location 427 is adjusted manually, such as by a user, to define a minimum extreme length of the hair strands 422. Specifically, the needle 424 and the cutting location 427 can be positioned nearer to each other (such as in FIGS. 10A-10C) prior to operation to define the minimum extreme length. During operation, the minimum extreme length is also determined by the relative position of the two arms 403*a*, 403*b*, the two arms 403*a*, 403*b* adjusted automatically to adjust their relative position. Specifically, the two arms 403*a*, 403*b* are at a minimum relative position (as shown in FIG. 10C) from each other when the length of the hair strands 422 produced is the minimum extreme length. Moreover, when the two arms 403*a*, 403*b* are at a maximum relative position (as shown in FIG. 10B) from each other, the length of the hair strands 422 produced is the maximum extreme length. In this way, the distance between the position 1024*p* of the needle 424 and the position 1027*p* of the cutting location 427 and the relative position of the two arms 403*a*, 403*b* define the minimum and maximum extreme lengths of the produced hair strands 422.

Referring to FIGS. 11A-11H, an implementation of a hair rooting procedure (such as the procedure 950) is performed by an implementation 1100 of the hair rooting apparatus 400 (FIG. 4). The hair rooting apparatus 1100 is similar to the hair rooting apparatus 400, except the hair rooting apparatus 1100 also includes a cutting post 1132 at the cutting location 427 configured to engage the hair thread 420 during hair rooting to enable cutting of the hair thread 420. The cutting post 1132 can be made of a rigid material, such as a metal, that does not deform or bend when the hair thread 420 is engaged with the cutting post 1132. For simplicity, the supply 408 and the data connection 412 are not shown in FIGS. 11A-11H but it is noted that the supply 408 is in communication with the hair feeding device 428 during hair rooting. In other implementations, the hair rooting apparatus 100 can also include a mount (such as the mount 431 of FIG. 4) and/or a pressing device (such as the pressing device 433 of FIGS. 4 and 5A-5C).

Figure 11A:
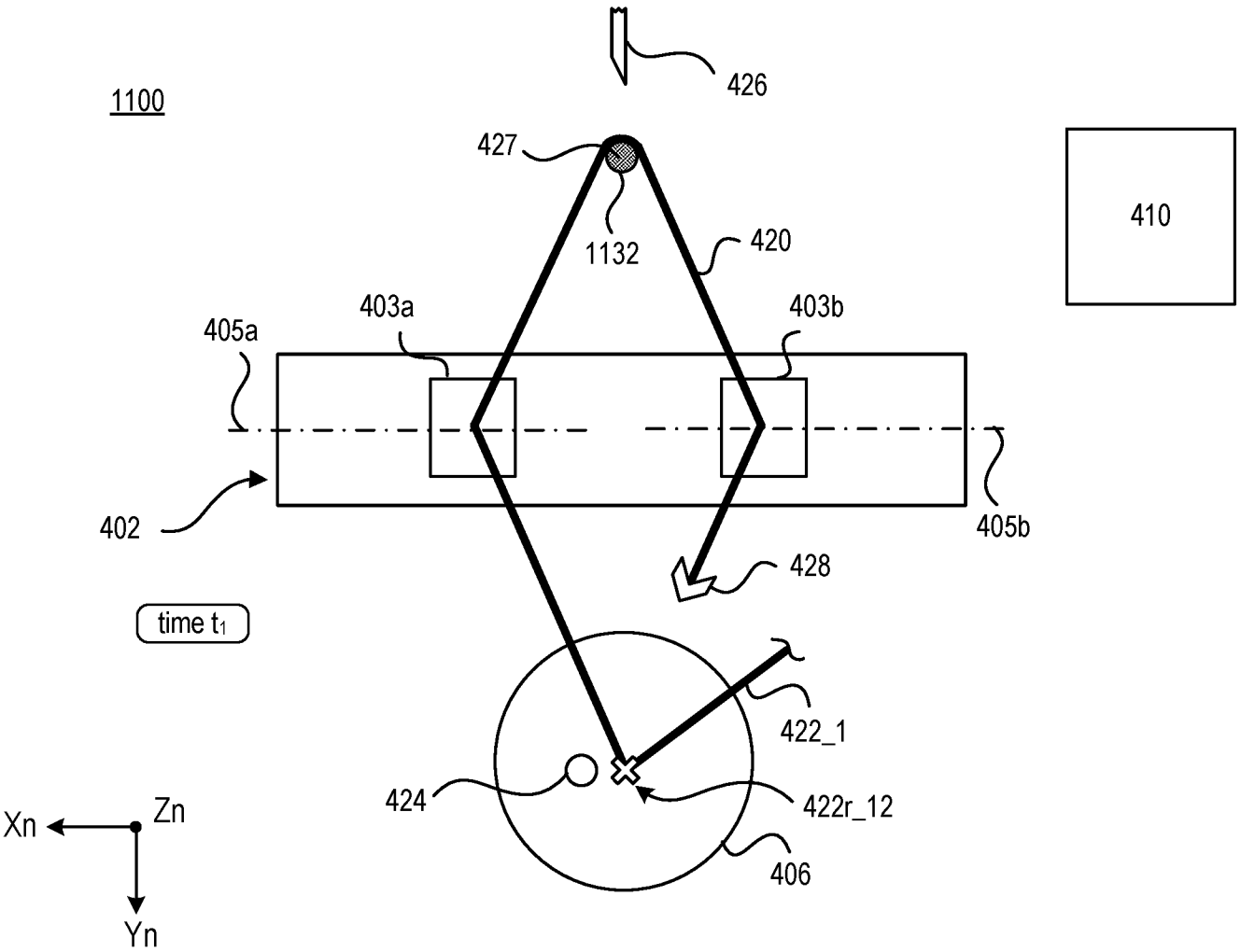
FIGS. 11A-11H are top views of a block diagram of an implementation of a hair rooting apparatus that includes the variable hair length module, the control system, the needle, the cutter, and the hair feeding device of FIG. 4 when the hair rooting apparatus produces hair strands on a head.

In FIG. 11A, the hair rooting apparatus 1100 performs at a time $t_1$ at which a first hair strand 422_1 is produced. The hair strand 422_1 is rooted at a root region 422*r*_12 of the hair strand 422_1 into a first region of the head 406 (shown as a cross shape). The needle 424 (shown as a circle shape) is positioned at a second region of the head 406 that is different from the first region of the head 406. The hair feeding device 428 engages the hair thread 420 with each of the two arms 403*a*, 403*b* of the variable hair length module 402. The two arms 403*a*, 403*b* are at a relative position from each other in which desired hair strand 422 lengths are produced. The relative movement of the two arms 403*a*, 403*b* enables the length of each hair strand 422 to vary continuously within the maximum and minimum lengths (as shown in FIGS. 10A-10C). The hair feeding device 428 also engages the hair thread 420 with the cutting post 1132. For example, the hair feeding device 428 has wrapped the hair thread 420 around each of the two arms 403*a*, 403*b* and the cutting post 1132 to engage the hair thread 420 with each of the two arms 403*a*, 403*b* and the cutting post 1132. In addition, the cutter 426 is not engaged with the cutting post 1132 and, thus, the hair thread 420 is not cut by the cutter 426 at this time.

The control system 410 is in communication with the variable hair length module 402 via a data connection (not shown in FIGS. 11A-11H). At appropriate times during the hair rooting process, the control system 410 instructs the variable hair length module 402 such that the two arms 403*a*, 403*b* are at a relative position that produces hair strands 422 of desired length. The control system 410 can also be in communication with the hair feeding device 428 and instruct the hair feeding device 428 to move. In this way, the hair feeding device 428 can engage the hair thread 420 with components of the hair rooting apparatus 1100 at appropriate times. The control system 410 can be in communication with the needle 424 and, at appropriate times, instruct the needle 424 to stitch at a required speed or according to a stitch per inch requirement. In addition, when the hair rooting apparatus 1100 includes a mount that holds the head 406 (such as the mount 431), the control system 410 can be in communication with the mount to adjust the head 406 relative to the needle 424 at appropriate times.

Figure 11B:
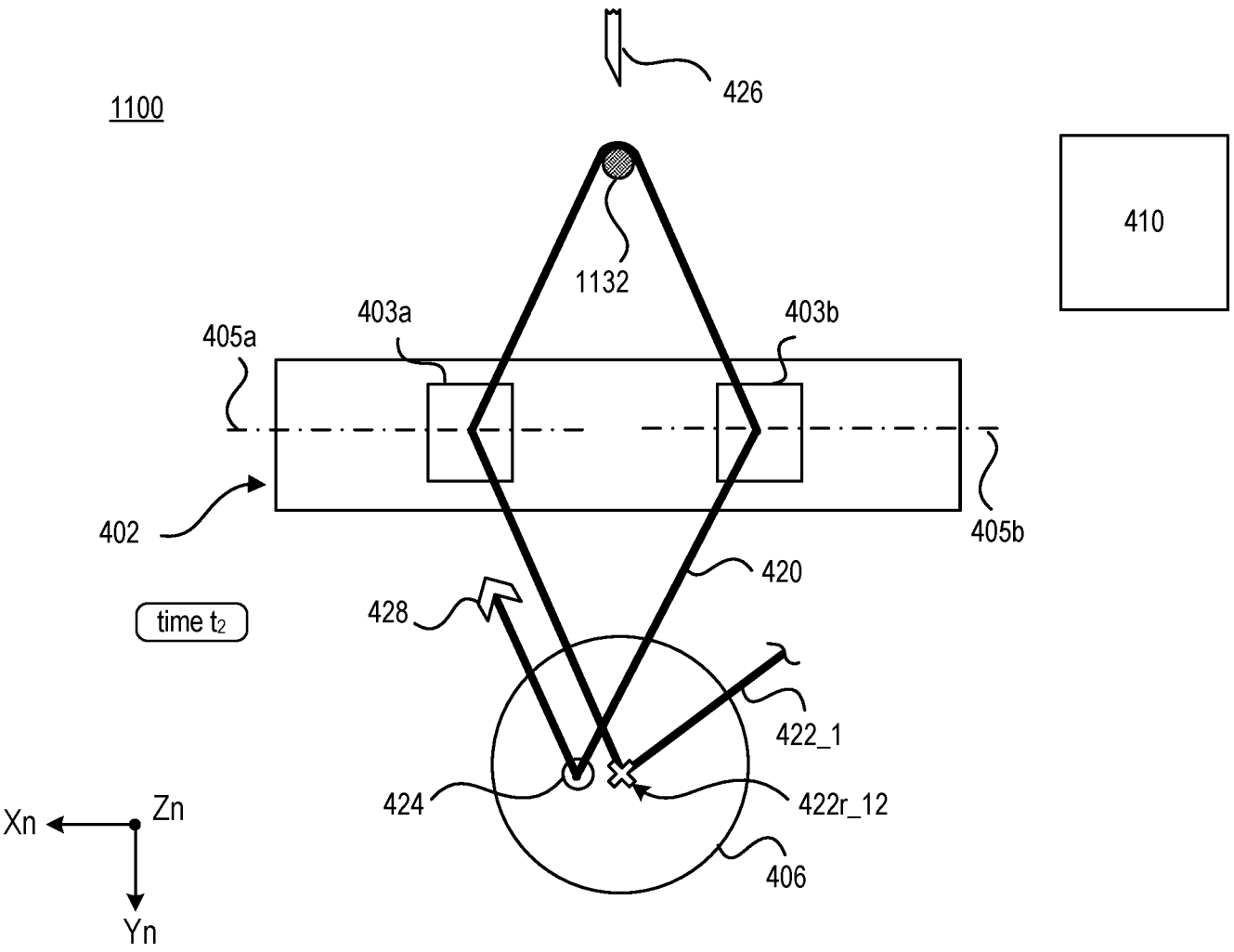

In FIG. 11B, the hair rooting apparatus 1100 performs at a time $t_2$ (subsequent to time $t_1$) at which the hair feeding device 428 has just engaged the hair thread 420 with the needle 424 (as shown in FIGS. 5A-5B). The hook 424*h* of the needle 424 has just grabbed the hair thread 420 and the needle 424 is moving down along the −Zn direction into the cavity 406*c* of the head 406. In this way, the needle 424 pulls the hair thread 420 into the head 406.

Figure 11C:
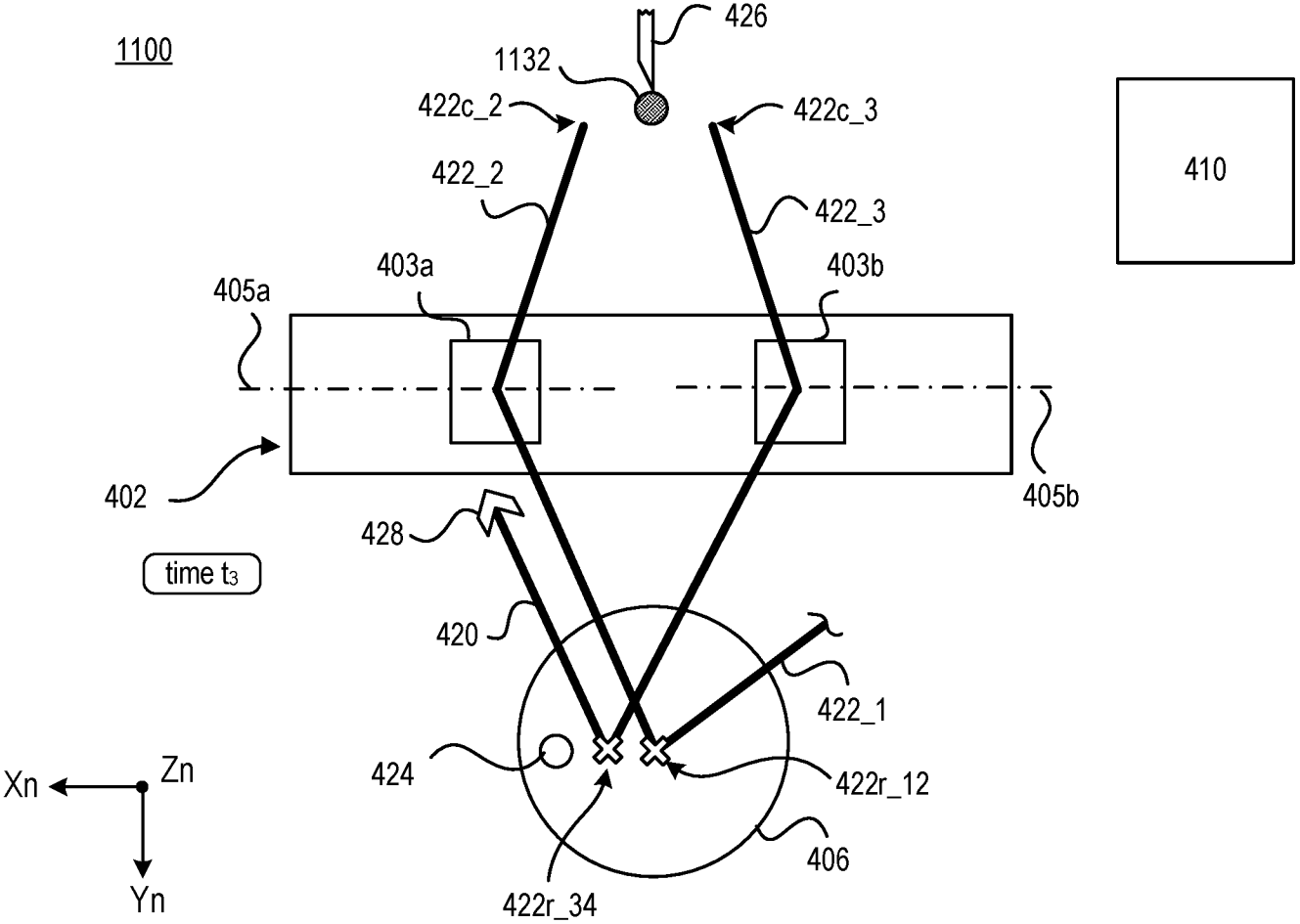

In FIG. 11C, the hair rooting apparatus 1100 performs at a time $t_3$ (subsequent to time $t_2$) at which the needle 424 has rooted the hair thread 420 into the head 406 at the second region and the cutter 426 has just cut the hair thread 420 to produce two hair strands 422_2, 422_3. Specifically, the cutter 426 moves to engage with the cutting post 1132 and cuts the hair thread 420 that is wrapped around the cutting post 1132 to produce the hair strands 422_2, 422_3. The hair strand 422_2 is rooted at the root region 422*r*_12 and cut at the cut region 422*c*_2. In this way, the hair strands 422_1 and 422_2 are rooted at the same region of the head 406, or in other words, the hair strands 422_1 and 422_2 share the same root region 422*r*_12. The hair strand 422_3 is rooted at the root region 422*r*_34 and cut at the cut region 422*c*_3. Moreover, the needle 424 is moving or has moved to a third region of the head 406 that is different from the first region (at which the hair strands 422_1, 422_2 have been produced) and the second region (at which the hair strand 422_3 has been produced) of the head 406.

Figure 11D:
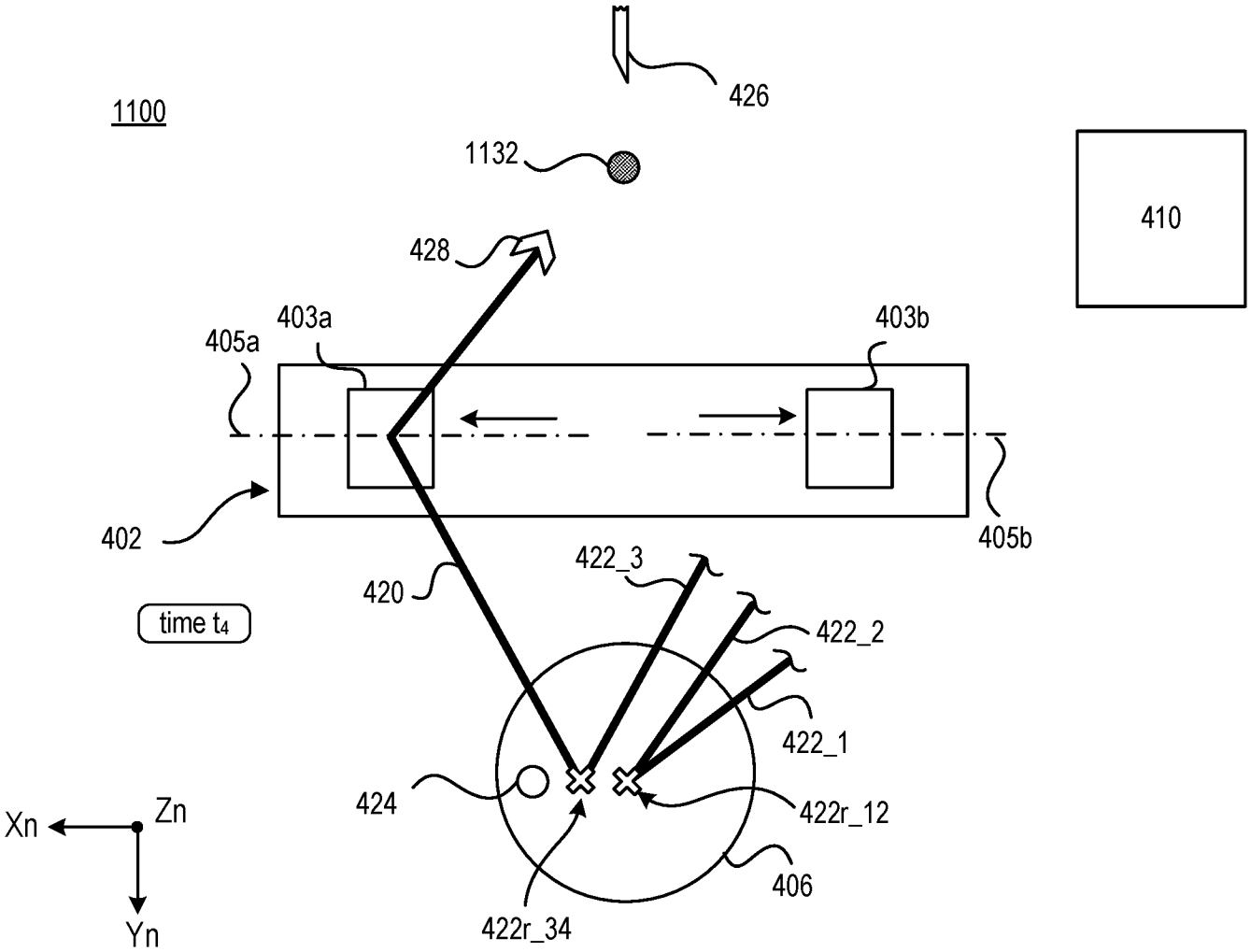
Figure 11E:
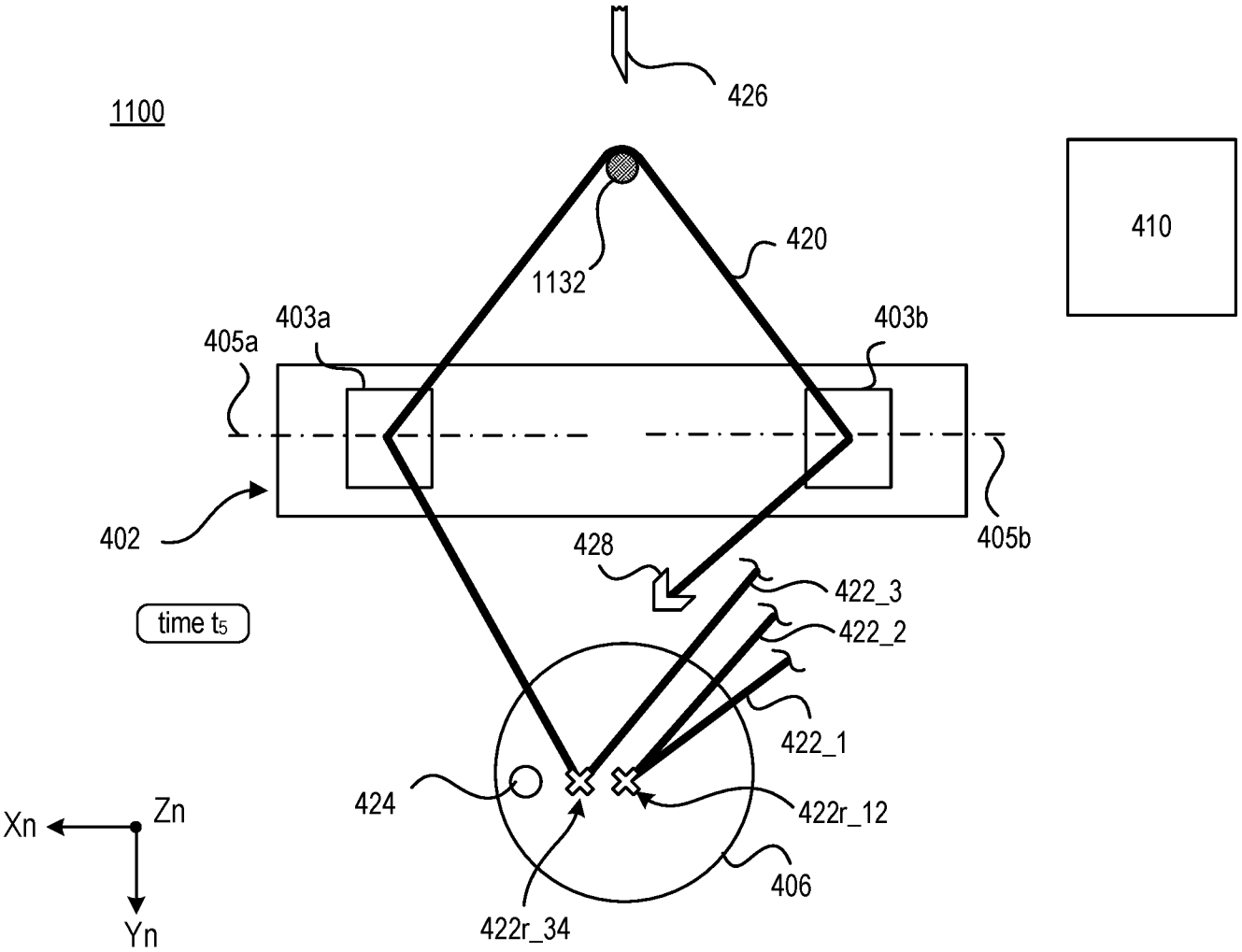

In FIG. 11D, the hair rooting apparatus 1100 performs at a time $t_4$ (subsequent to time $t_3$) at which the hair feeding device 428 has engaged the hair thread 420 with the arm 403*a* of the variable hair length module 402 and is approaching the cutting post 1132. The hair strands 422_1, 422_2, and 422_3 have been produced. At this time, if a different length for the next hair strand to be cut is desired and instructed, then the two arms 403*a*, 403*b* are adjusted (as shown in FIGS. 10A-10C) to a different relative position from each other at which the desired hair strand 422 lengths can be produced at the respective regions of the head 406. In FIG. 11E, the hair the hair rooting apparatus 1100 performs at a time $t_5$ (subsequent to time $t_4$) at which the hair feeding device 428 has just engaged the hair thread 420 with the cutting post 1132 and the arm 403*b* of the variable hair length module 402. The arms 403*a*, 403*b* have been or are currently being adjusted to the appropriate relative position from each other at which the desired hair strand 422 lengths can be produced.

Figure 11F:
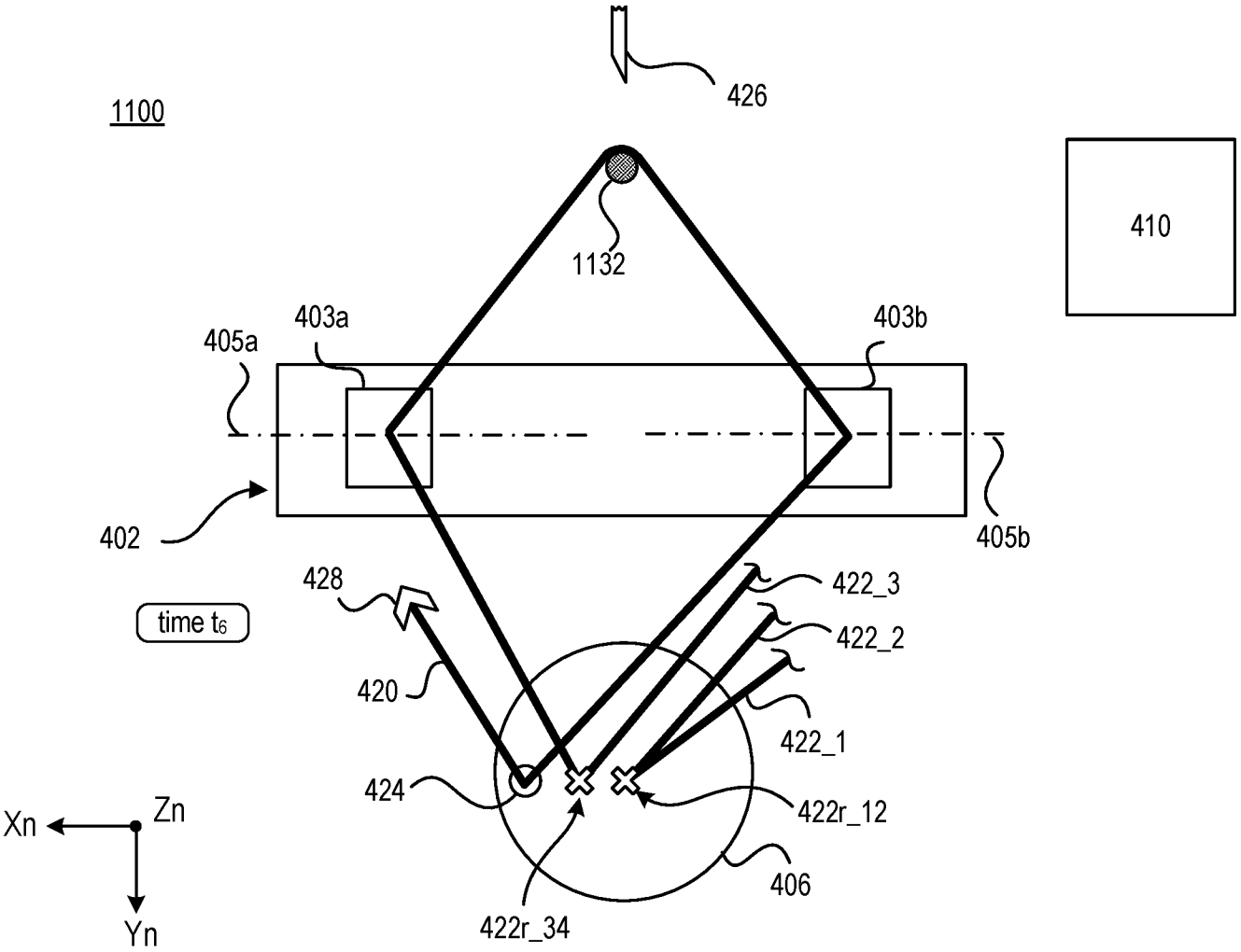
Figure 11G:
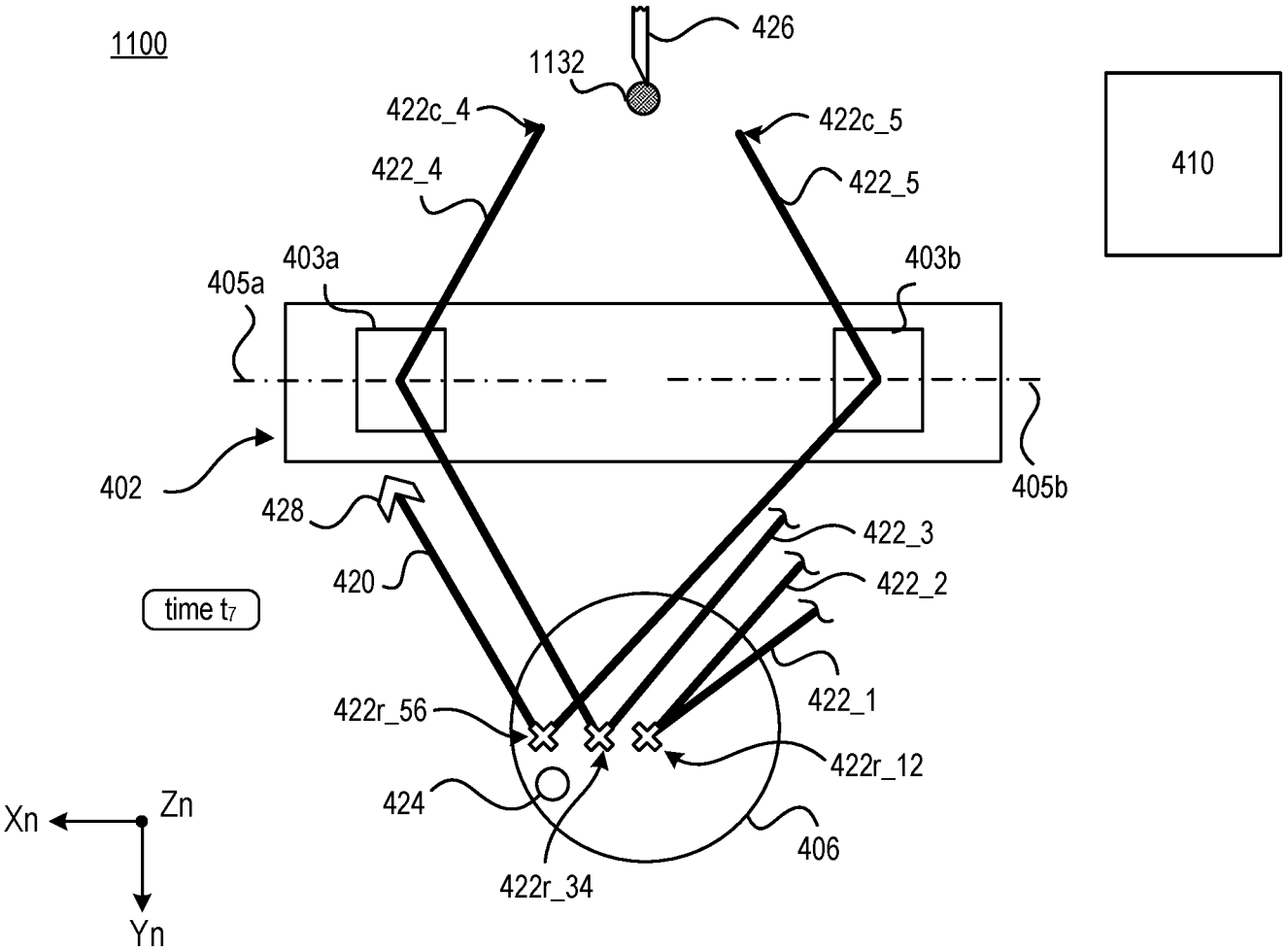

In FIG. 11F, the hair rooting apparatus 1100 performs at a time $t_6$ (subsequent to time $t_5$) at which the hair feeding device 428 has just engaged the hair thread 420 with the needle 424 (as shown in FIGS. 5A-5B). The needle 424 pulls the hair thread 420 into the head 406 at the third region of the head 406. In FIG. 11G, the hair rooting apparatus 1100 performs at a time $t_7$ (subsequent to time $t_6$) at which the needle 424 has rooted the hair thread 420 into the head 406 at the third region and the cutter 426 has cut the hair thread 420 by engaging with the cutting post 1132 to produce two hair strands 422_4, 422_5. The hair strand 422_4 is rooted at the root region 422*r*_34 and cut at the cut region 422*c*_4. In this way, the hair strands 422_3 and 422_4 are rooted at the same region of the head 406, or in other words, the hair strands 422_3 and 422_4 share the same root region 422*r*_34. The hair strand 422_5 is rooted at the root region 422*r*_56 and cut at the cut region 422*c*_5. Moreover, the needle 424 moves to a fourth region of the head 406 that is different from the first region (at which the hair strands 422_1, 422_2 have been produced), the second region (at which the hair strands 422_3, 422_4 have been produced), and the third region (at which the hair strand 422_5 has been produced) of the head 406.

Figure 11H:
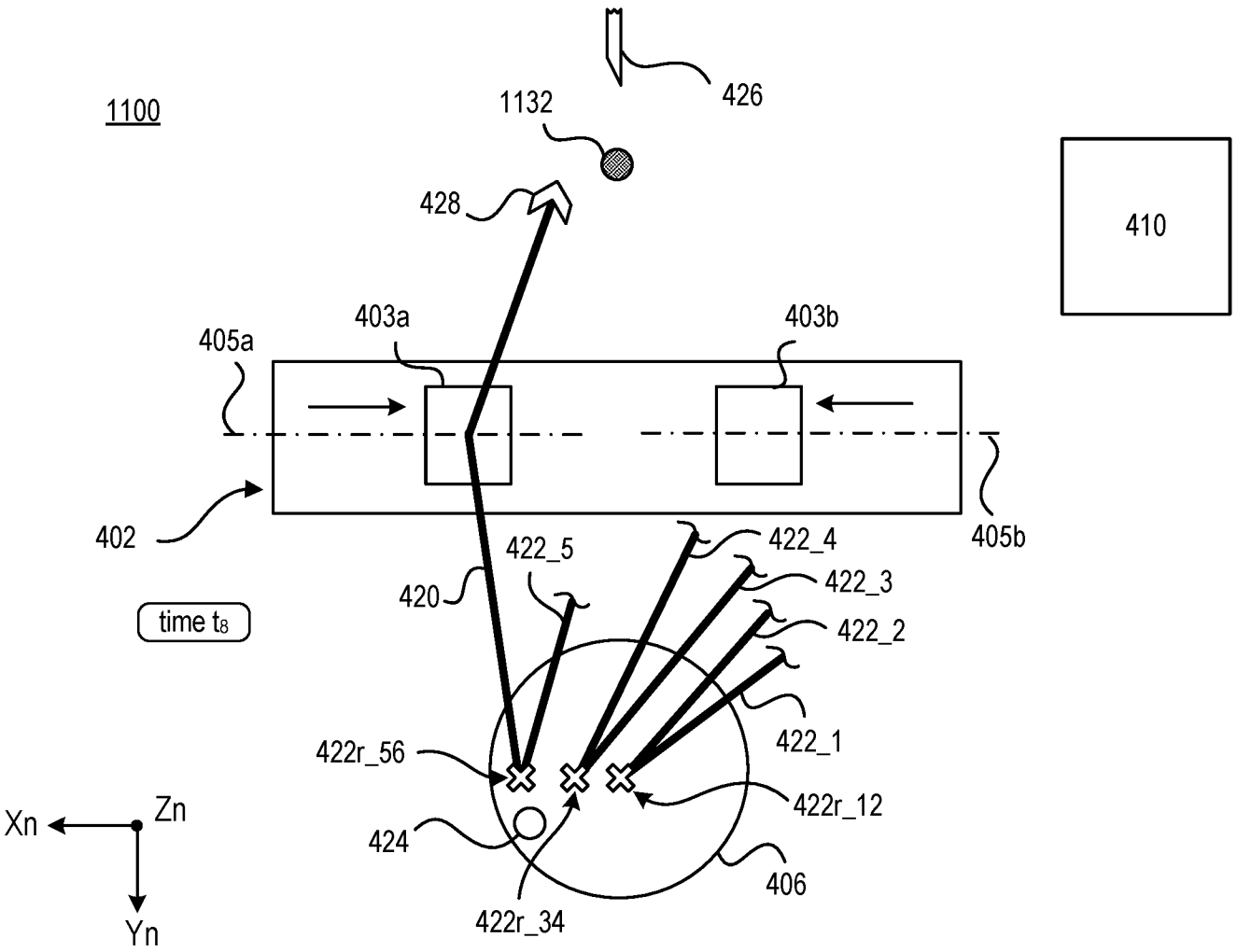

In FIG. 11H, the hair rooting apparatus 1100 performs at a time $t_8$ (subsequent to time $t_7$) at which the hair feeding device 428 has just engaged the hair thread 420 with the arm 403*a* of the variable hair length module 402. The hair strands 422_1, 422_2, 422_3, 422_4, and 422_5 have been produced. At this time, if a different length of hair strand is desired, then the two arms 403*a*, 403*b* are adjusted again (as shown in FIGS. 10A-10C) to a different relative position from each other to produce the desired hair strand 422 lengths at the next respective regions of the head 406. This hair rooting process performed by the hair rooting apparatus 1100 can be repeated in the described sequence of steps to root the entire region of the head 406. In this way, the hair rooting apparatus 1100 produces a desired hair style for the head 406 formed from the hair strands 422 of variable lengths.

It can be noted that subsequent to time $t_3$ (FIG. 11C) and prior to time $t_4$ (FIG. 11D), or in other words, between time $t_3$ and time $t_4$, the relative position of the two arms 403*a*, 403*b* is adjusted. Specifically, the two arms 403*a*, 403*b* are moved away from each other along their respective continuous paths 405*a*, 405*b* such that the distance between the two arms 403*a*, 403*b* is greater at time $t_4$ than the distance between the two arms 403*a*, 403*b* at time $t_3$. In this way, the hair strands 422_4, 422_5 that are formed subsequent to time $t_4$ and prior to time $t_8$ (when the relative position between the two arms 403, 403*b* can be adjusted again, as shown in FIG. 11H) have a longer length than the hair strands 422_2, 422_3 that were formed at time $t_3$ when the two arms 403*a*, 403*b* were nearer to each other. Moreover, the relative position of the two arms 403*a*, 403*b* is adjusted again subsequent to time $t_7$ (FIG. 11G) and prior to time $t_8$ (FIG. 11H) such that the distance between the two arms 403*a*, 403*b* is smaller at time $t_8$ than the distance between the two arms at time $t_7$. In this way, the next two hair strands that are yet to be formed will have a shorter length than the hair strands 422_4, 422_5 produced at time $t_7$. As such, the variable hair length module 402 enables the hair rooting apparatus 1100 to produce the hair strands 422 of variable desired lengths.

Figure 12:
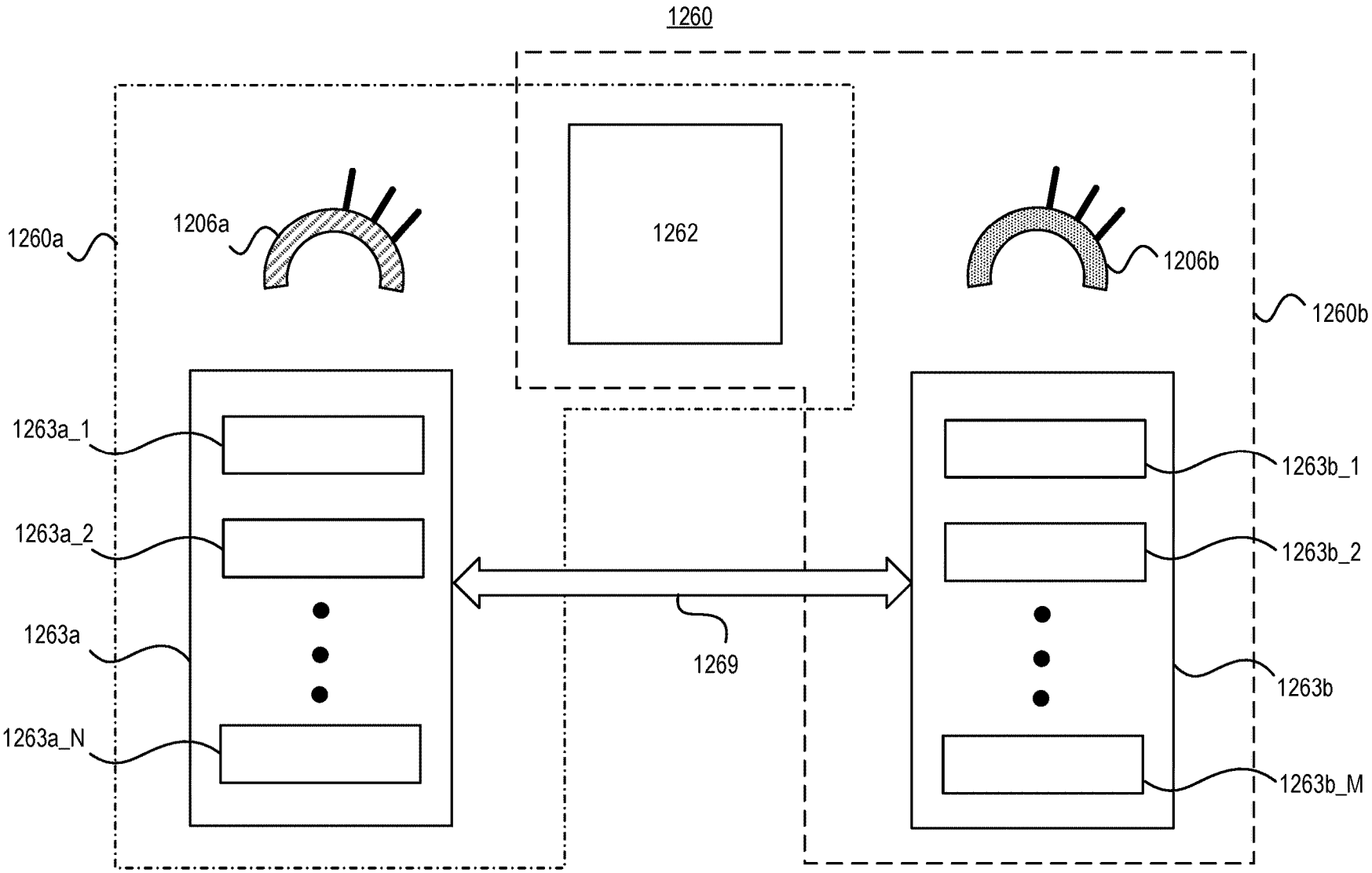
FIG. 12 is a block diagram of a hair rooting system that includes a first machine configured to operate in a first mode of operation on a first head of a first type and a second machine configured to operate in a second mode of operation on a second head of a second type that is distinct from the first type.

Referring to FIG. 12, a hair rooting system 1260 includes a first machine 1260*a* (denoted by a dot-dash outline) configured to operate in a first mode of operation on a first head 1206*a* and a second machine 1260*b* (denoted by a dashed-line outline) configured to operate in a second mode of operation on a second head 1206*b*. The first head 1206*a* is a first type of head and the second head 1206*b* is a second type of head that is distinct from the first type of head. The first machine 1260*a* includes a base apparatus 1262 and a first set of transition devices 1263*a* that includes N transition devices 1263*a*_1 to 1263*a* N (or first modules 1263*a*_1 to 1263*a* N), where N is an integer number equal to or greater than one. Each transition device 1263*a*_1 to 1263*a* N in the first set 1263*a* is configured for the first head 1206*a*. The second machine 1260*b* also includes the base apparatus 1262 and a second set of transition devices 1263*b* (or second modules 1263*b*_1 to 1263*b* M) that includes M transition devices 1263*b*_1 to 1263*b* M, where M is an integer number equal to or greater than one. Each transition device 1263*b*_1 to 1263*b* M in the second set 1263*a* is configured for the second head 1206*a*.

The second machine 1260*b* is formed by replacing the first set of transition devices 1263*a* with the second set of transition devices 1263*b* (shown with an arrow 1269 in FIG. 12). In other words, the hair rooting system 1260 can be considered a convertible machine that is capable of rooting hair thread into two distinct types of heads (including the first and second heads 1206*a*, 1206*b*). Specifically, when the first set of transition devices 1263*a* are placed in the hair rooting system 1260 to form the first machine 1260*a* (that includes the base apparatus 1262) that operates in the first mode of operation, the hair rooting system 1260 is configured to root hair thread into the first head 1206*a* that is the first type. When the second set of transition devices 1263*b* are placed in the hair rooting system 1260 to form the second machine 1260*b* (that includes the base apparatus 1262) that operates in the second mode of operation, the hair rooting system 1260 is configured to root hair thread into the second head 1206*b* that is the second type.

In one example, the first type of head can be defined by a first head size and the second type of head can be defined by a second head size that is distinct from the first head size. In other words, the size of the second head is distinct from the size of the first head. For example, the first head size can be defined by a diameter that is within a range of 60 millimeters (mm) to 120 mm, and the second head size can be defined by a diameter that is within a range of 20 mm to 60 mm. In this way, the hair rooting system 1260 is capable of rooting hair thread into heads 1206*a* and 1206*b* of distinct sizes.

In some implementations, the base apparatus 1262 includes a variable hair length module (such as the variable hair length module 102, 302, 402, or 702) configured to automatically adjust a length of hair strands rooted into the appropriate head 1206*a*, 1206*b* in either of the modes of operation. Specifically, the variable hair length module can include two arms configured to move relative to each other along respective paths. In these implementations, the hair strands of variable lengths are produced by cutting the rooted hair thread.

Figure 13:
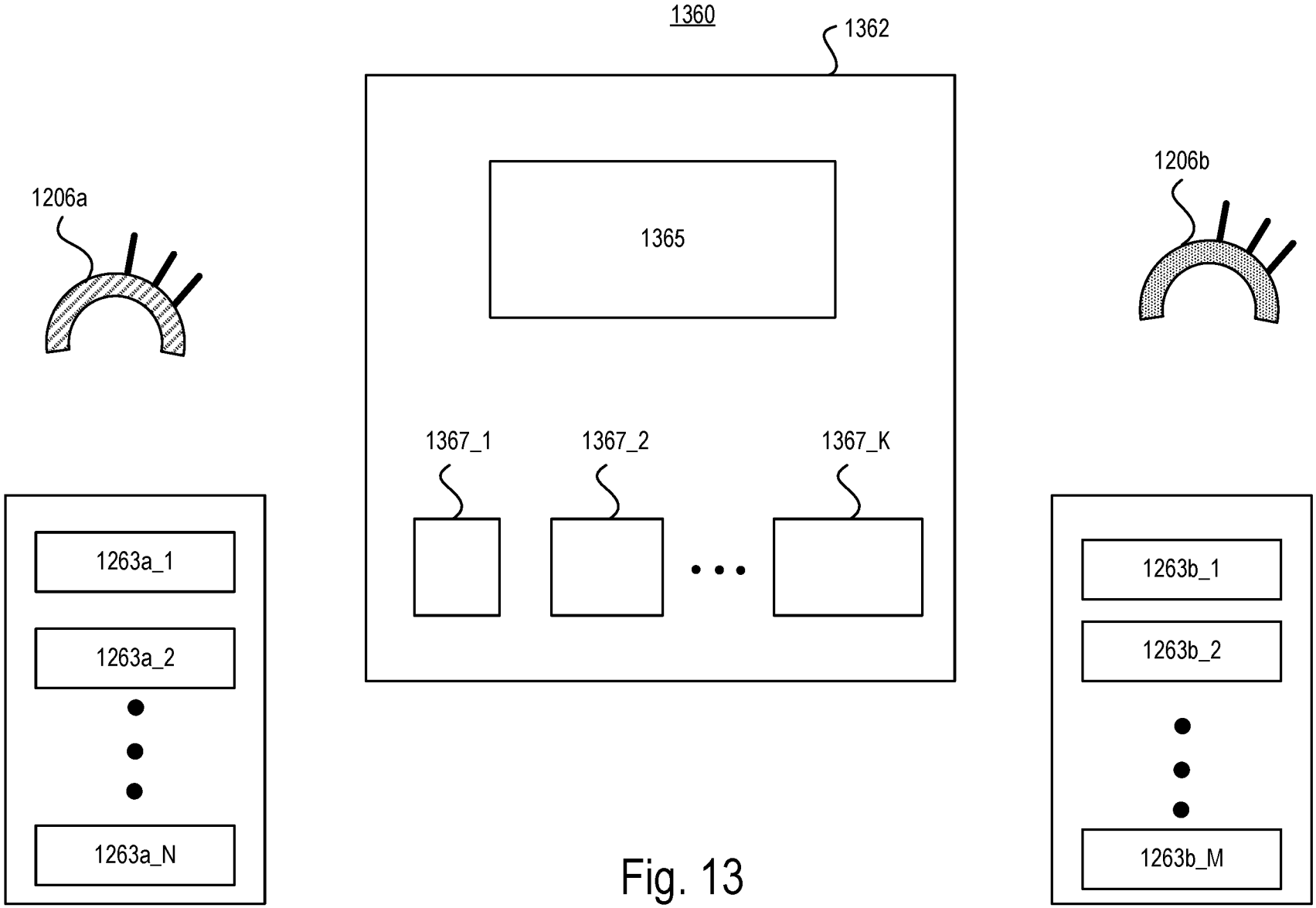
FIG. 13 is a block diagram of an implementation of the hair rooting system of FIG. 12.

Referring to FIG. 13, an implementation 1360 of the hair rooting system 1260 (FIG. 12) includes the N transition devices 1263*a*_1 to 1263*a* N (or first modules 1263*a*_1 to 1263*a* N), the M transition devices 1263*b*_1 to 1263*b* M (or second modules 1263*b*_1 to 1263*b* M), and an implementation 1362 of the base apparatus 1262. In this implementation, each first module 1263*a*_1 to 1263*a* N includes a first set of components configured to root hair thread in the first head 1206*a* being of the first type, and each second module 1263*b*_1 to 1263*b* M includes a second set of components configured to root hair thread in the second head 1206*b* being of the second type.

The base apparatus 1362 includes a set 1365 of standardized components and one or more interchange zones 1367_1 to 1367_K, where K is an integer number equal to or greater than one. Each interchange zone 1367_1 to 1367_K is configured to receive and attach to respective components of the first and second modules 1263*a*_1 to 1263*a* N and 1236*b*_1 to 1263*b* M. Moreover, each first module 1263*a*_1 to 1263*a* N is configured for attachment to and detachment from one of the interchange zones 1367_1 to 1367_K of the base apparatus 1362. Similarly, each second module 1263*b*_1 to 1263*b* M is configured for attachment to and detachment from one of the interchange zones 1367_1 to 1367_K of the base apparatus 1362.

In one example, the one or more interchange zones 1367_1 to 1367_K can include a holding zone configured to retain and move (for example, translate and/or rotate) the appropriate head 1206*a*, 1206*b*; and a rooting zone configured to root hair thread into the appropriate head 1206*a*, 1206*b*. Specifically, the holding zone can include attachments for the respective first and second modules 1263*a*_1 to 1263*a* N and 1263*b*_1 to 1263*b* M that relate to holding the appropriate head 1206*a*, 1206*b*. For example, the holding zone can include an attachment for a mount (such as the mount 431 of FIG. 4 and the mount 731 of FIGS. 7A and 7B) configured to hold the appropriate head 1206*a*, 1206*b*. The rooting zone can include attachments for the respective first and second modules 1263*a*_1 to 1263*a* N and 1263*b*_1 to 1263*b* M that relate to rooting hair thread into the appropriate head 1206*a*, 1206*b*. For example, the rooting zone can include attachments for one or more components configured to hold a needle configured to root hair thread into the appropriate head 1206*a*, 1206*b* and/or move the needle to root the hair thread into the appropriate head 1206*a*, 1206*b*.

The set of standardized components 1365 of the base apparatus 1362 can include any one or more apparatuses or devices that relate to rooting hair thread into the appropriate head. In one example, the set of standardized components 1365 can include a trimming mechanism including a cutter configured to cut rooted hair thread to produce hair strands, such as the trimming mechanism 625 that includes the cutter 626, as shown in FIG. 6. In this example, the cutter is configured for both of the types of heads 1206*a*, 1206*b*. Furthermore, the set of standardized components 1365 can include, for example, a hair feeding device (such as the hair feeding device 428 of FIG. 4, the hair feeding device 628 of FIG. 6, and the hair feeding device 728 of FIGS. 7A and 7B) configured to position the hair thread at a needle that interacts with the head at some moments, and at the cutter at other moments. The hair feeding device is also configured for both types of heads 1206*a*, 1206*b*. Moreover, for example, the set of standardized components 1365 can include a cutting post (such as the cutting post 1132 of FIGS. 11A-11H) configured to engage the rooted hair thread to enable the cutter to cut the rooted hair thread. In still another example, the set of standardized components 1365 can include a pressing device (such as the pressing device 433 of FIGS. 4 and 5A-5C) configured to press the appropriate head 1206*a*, 1206*b* to form a flat surface at a region of the head 1206*a*, 1206*b* in which a needle roots the hair thread. In this example, the pressing device is configured for both types of heads 1206*a*, 1206*b*.

A first hair rooting configuration is formed by the attachment of the one or more first modules 1263*a*_1 to 1263*a* N to respective interchange zones 1367_1 to 1367_K of the base apparatus 1362 to thereby form a first hair rooting machine (such as the first machine 1260*a* of FIG. 12 that operates in the first mode of operation) configured to root the hair thread into the first head 1206*a*. A second hair rooting configuration is formed by the attachment of the one or more second modules 1263*b*_1 to 1263*b* M to respective interchange zones 1367_1 to 1367_K of the base apparatus 1362 to thereby form a second hair rooting machine (such as the second machine 1260*b* of FIG. 12 that operates in the second mode of operation) configured to root the hair thread into the second head 1206*b*. In this way, the hair rooting system 1360 is configured to root hair thread into heads of different types (namely, the first type and the second type in this implementation).

Figure 14A:
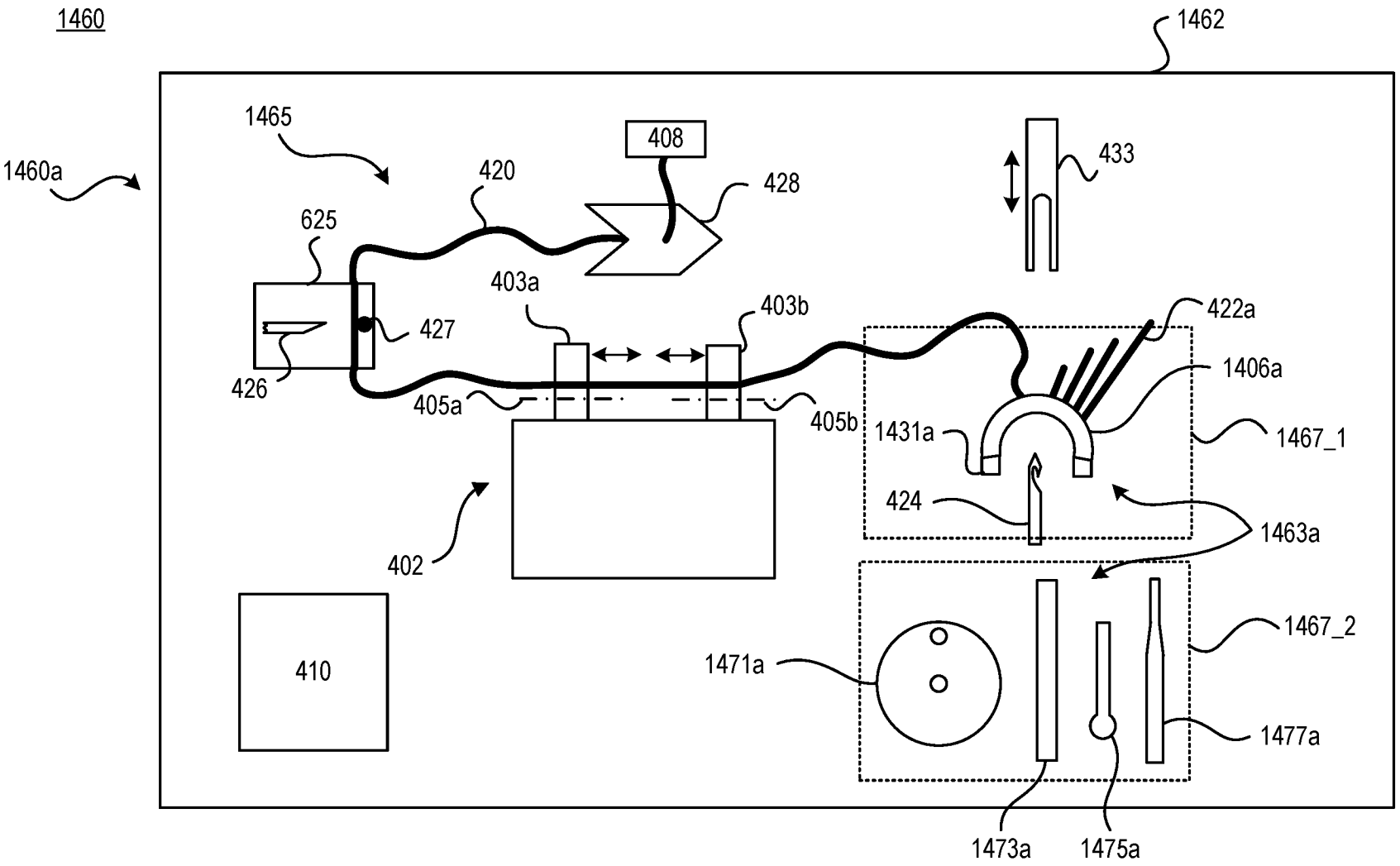
FIG. 14A is an implementation of the first machine of the hair rooting system of FIG. 12 that includes a base apparatus including the variable hair length module of FIG. 4 and first modules attached to respective interchange zones of the base apparatus, each first module configured to root hair thread in a first head being of a first type.
Figure 14B:
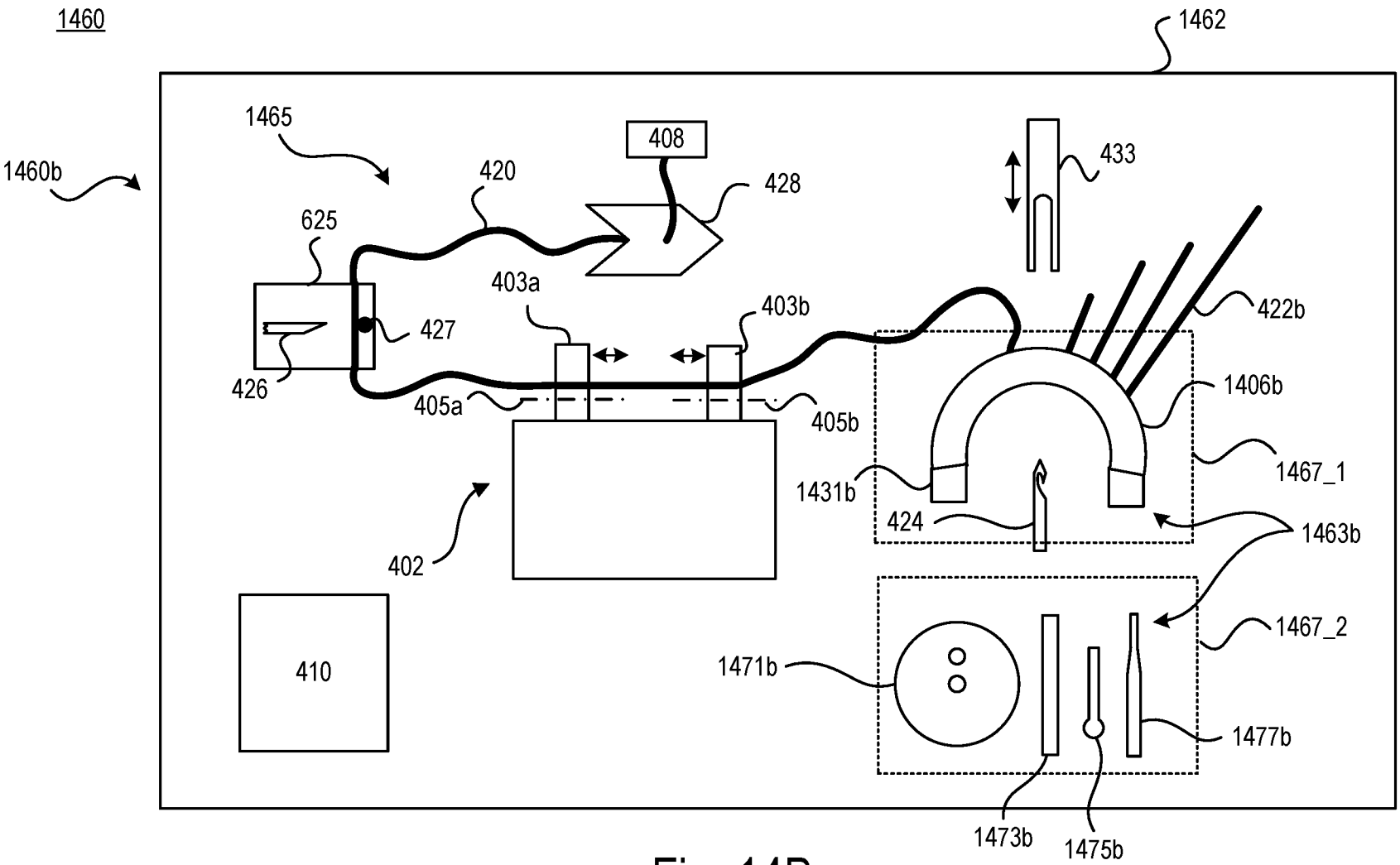
FIG. 14B is an implementation of the second machine of the hair rooting system of FIG. 12 that includes the base apparatus of FIG. 14A and second modules attached to the respective interchange zones of the base apparatus, each second module configured to root hair thread in a second head being of a second type.

Referring to FIGS. 14A and 14B, an implementation 1460 of the hair rooting system 1360 (FIG. 13) includes a first hair rooting machine 1460*a* configured to root hair thread 420 into a first head 1406*a* of a first type and a second hair rooting machine 1460*b* configured to root hair thread 420 into a second head 1406*b* of a second type, respectively. The hair rooting system 1460 includes a base apparatus 1462 including two interchange zones 1467_1 and 1467_2 and a set of standardized components 1465. In the example of FIGS. 14A and 14B, the interchange zone 1467_1 is a holding zone configured to retain and move the appropriate head 1406*a*, 1406*b*; and the interchange zone 1467_2 is a rooting zone configured to root the hair thread 420 into the appropriate head 1406*a*, 1406*b*. The hair rooting system 1460 also includes a set of first modules 1463*a* (or a first set of transition devices) configured for the first head 1406*a* (FIG. 14A), and a set of second modules 1463*b* (or a second set of transitions devices) configured for the second head 1406*b* (FIG. 14B). Each of the first and second modules in the sets 1463*a*, 1463*b* are configured for attachment to and detachment from one of the interchange zones 1467_1, 1467_2 of the base apparatus 1462. In the example of FIGS. 14A and 14B, the first head 1406*a* that is the first type is defined by a first head size and the second head 1406*b* that is the second type is defined by a second head size that is distinct from the first head size. Specifically, the first head size is smaller than the second head size such that the size of the second head 1406*b* is distinct from the size of the first head 1406*a*.

In the example of FIGS. 14A and 14B, the set of standardized components 1465 of the base apparatus 1465 includes the trimming mechanism 625 (FIG. 6) including the cutter 426 (FIG. 4) configured to cut the hair thread 420 rooted into the appropriate head 1406*a*, 1406*b* to produce respective hair strands 422*a*, 422*b*; the hair feeding device 428 (FIG. 4) configured to position the hair thread 420 at a needle zone (at which the needle 424 is located) at some moments and at the cutter 426 at other moments; the cutting post 427 (FIG. 4) configured to engage the rooted hair thread 420 to enable the cutter 426 to cut the rooted hair thread 420; and the pressing device 433 (FIG. 4) configured to press the appropriate head 1406*a*, 1406*b* to form a flat surface at a region of the head 1406*a*, 1406*b* in which the needle 424 roots the hair thread 420.

Moreover, the set of standardized components 1465 includes the variable hair length module 402 (FIG. 4) configured to adjust the lengths of hair strands 422*a*, 422*b* that are rooted in the head 1406*a*, 1406*b* of the appropriate type by the hair rooting system 1460. The variable hair length module 402 includes the two arms 403*a*, 403*b* configured to move relative to each other along respective continuous paths 405*a*, 405*b*. Furthermore, in this example, the set of standardized components 1465 includes the supply 408 of the hair thread 420 that is coupled with the hair feeding device 428. Specifically, as described above, the supply 408 continuously feeds the hair thread 420 to the hair feeding device 428 when the hair feeding device 428 moves relative to the needle 424, the cutter 426, and the variable hair length module 402.

The hair rooting system 1460 also includes the control system 410. The control system 410 is configured to automatically control each of the standardized components 1465 in the base apparatus 1462. Specifically, the control system 410 can properly and appropriately control each of the standardized components 1465 in both of the first hair rooting machine 1460*a* and the second hair rooting machine 1460*b*. Moreover, the control system 410 is configured to input first programs of instruction to the variable hair length module 402 in the first machine 1460*a* and input second programs of instruction to the variable hair length module 402 in the second machine 1460*b* to automatically control the relative movement of the two arms 403*a*, 403*b*. In this way, the control system 410 can appropriately control each of the standardized components 1465 of the base apparatus 1462 in both of the first machine 1406*a* and the second machine 1406*b* to root the hair thread 420 into both types of heads 1406*a*, 1406*b*.

With reference to FIG. 14A, the first modules (or transition devices) in the set 1463*a* can include at least one of a holding apparatus configured to hold the first head 1406*a*, a motion apparatus configured to move the first head 1406*a*, and a needle apparatus configured to root the hair thread into the first head 1406*a*. In the example of FIG. 14A, the set of first modules 1463*a* includes a first mount 1431*a* configured to hold the first head 1406*a*; a first needle bar 1475*a* configured to hold the needle 424 that is configured to root the hair thread 420 into the first head 1406*a*; a first support sleeve 1473*a* configured to support the first needle bar 1475*a*; a first needle bar sleeve 1477*a* configured to house the first needle bar 1475*a* and the first support sleeve 1473*a*; and a first motion adapter 1471*a* configured to move the first support sleeve 1473*a* such that the needle 424 oscillates to root the hair thread 420 into the first head 1406*a*. Specifically, the first mount 1431*a* is configured to attach to and detach from the holding zone 1467_1; and the first needle bar 1475*a*, the first support sleeve 1473*a*, the first needle bar sleeve 1477*a*, and the first motion adapter 1471*a* are configured to attach to and detach from the rooting zone 1467_2.

With reference to FIG. 14B, the second modules (or transition devices) in the set 1463*b* can include at least one of a holding apparatus configured to hold the second head 1406*b*, a motion apparatus configured to move the second head 1406*b*, and a needle apparatus configured to root the hair thread into the second head 1406*b*. In the example of FIG. 14B, the set of second modules 1463*b* includes a second mount 1431*b* configured to hold the second head 1406*b*; a second needle bar 1475*b* configured to hold the needle 424 that is configured to root the hair thread 420 into the second head 1406*b*; a second support sleeve 1473*b* configured to support the second needle bar 1475*b*; a second needle bar sleeve 1477*b* configured to house the second needle bar 1475*b* and the second support sleeve 1473*b*; and a second motion adapter 1471*b* configured to move the second support sleeve 1473*b* such that the needle 424 oscillates to root the hair thread 420 into the second head 1406*b*. Specifically, the second mount 1431*b* is configured to attach to and detach from the holding zone 1467_1; and the second needle bar 1475*b*, the second support sleeve 1473*b*, the second needle bar sleeve 1477*b*, and the second motion adapter 1471*b* are configured to attach to and detach from the rooting zone 1467_2.

A first hair rooting configuration is formed by the attachment of the one or more first modules in the set 1463*a* to respective interchange zones 1467_1, 1467_2 of the base apparatus 1462 to thereby form the first hair rooting machine 1460*a*, the first machine 1460*a* being configured to root the hair thread 420 into the first head 1406*a* by operating in a first mode of operation (FIG. 14A). Similarly, a second hair rooting configuration is formed by the attachment of the one or more second modules in the set 1463*b* to respective interchange zones 1467_1, 1467_2 of the base apparatus 1462 to thereby form the second hair rooting machine 1460*b*, the second machine 1460*b* being configured to root the hair thread 420 into the second head 1406*b* by operating in a second mode of operation (FIG. 14B). In other words, for operation of the hair rooting system 1460 in the second hair rooting configuration, the second machine 1460*b* can be formed by replacing the set of first modules 1463*a* (or first set of transition devices) with the set of second modules 1463*b* (or the second set of transition devices) to root the hair thread 420 into the second head 1406*b*. Moreover, for operation of the hair rooting system 1460 in the first hair rooting configuration, the first machine 1460*a* can be formed (or formed again) by replacing the set of second modules 1463*b* (or second set of transition devices) with the set of first modules 1463*a* (or the first set of transition devices) to root the hair thread 420 into the first head 1406*a*. In this way, the hair rooting system 1460 is configured to root hair thread 420 into heads 1406*a*, 1406*b* of distinct or different types (or different head sizes in the example of FIGS. 14A and 14B).

In the example of FIGS. 14A and 14B, the control system 410 can also be configured to automatically control each of the first modules 1463*a* in the first hair rooting configuration, and each of the second modules 1463*b* in the second hair rooting configuration. Thus, during operation of the hair rooting system 1460, the control system 410 can automatically control each of the standardized components 1465 in the base apparatus 1462, each of the first modules 1463*a* in the first hair rooting configuration, and each of the second modules 1463*b* in the second hair rooting configuration. For example, the control system 410 can be pre-programmed to automatically control each of the standardized components 1465, each of the first modules 1463*a*, and each of the second modules 1463*b* during operation of the hair rooting system 1460. Specifically, the control system 410 can include programs of instruction that are used for various head sizes of each head 1406*a*, 1406*b* and desired lengths of the respective hair strands 422*a*, 422*b*.

Figures 15A, 15B:
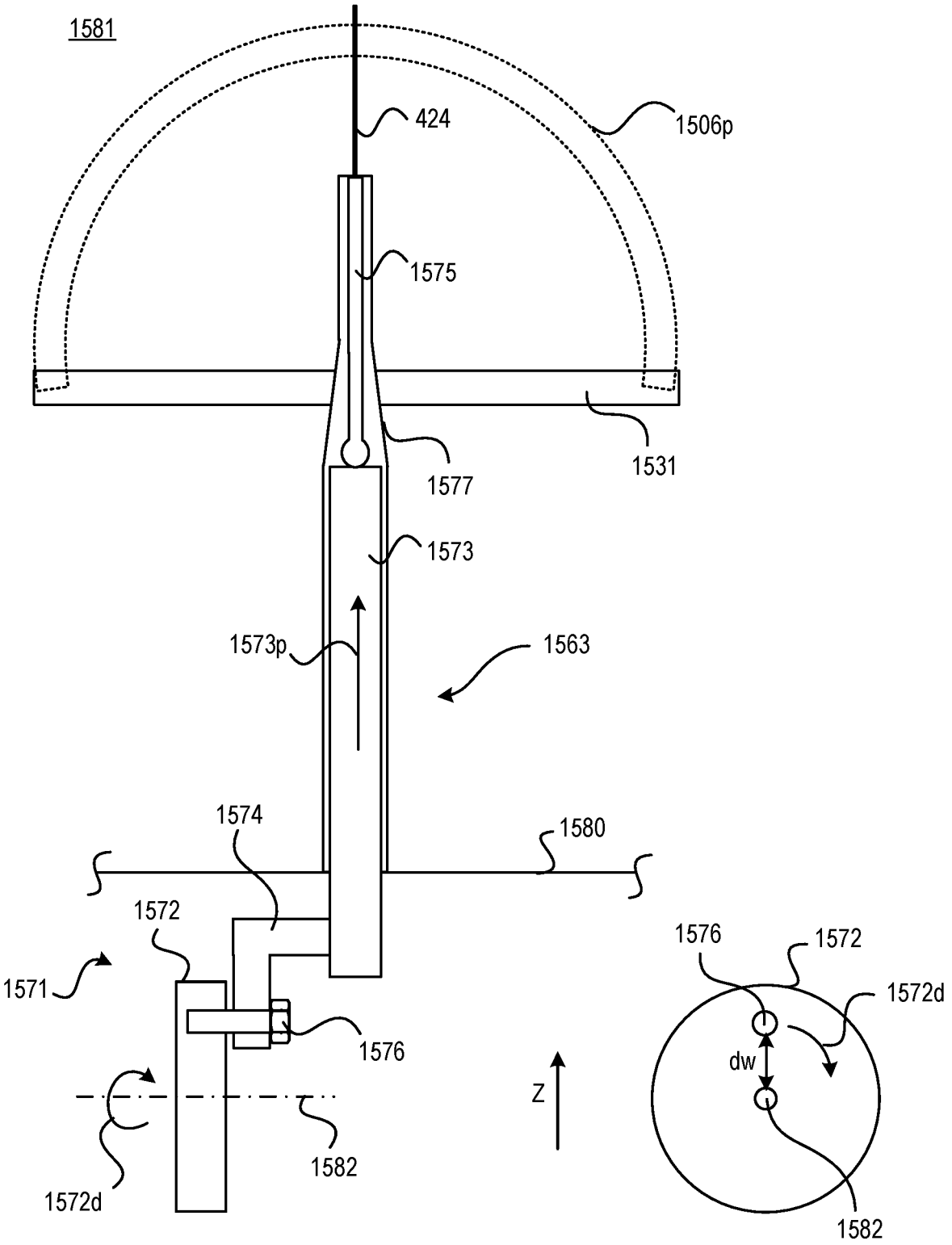
FIG. 15A is a schematic of an assembly of modules or transition devices when a needle is at a position configured to penetrate a head for rooting hair thread into the head, the assembly including a mount, a support sleeve, a needle bar sleeve, a needle bar, and a motion adapter.
FIG. 15B is a wheel of the motion adapter of FIG. 15A configured to rotate about a rotation axis when the needle is at the position of FIG. 15A.
Figure 15C:
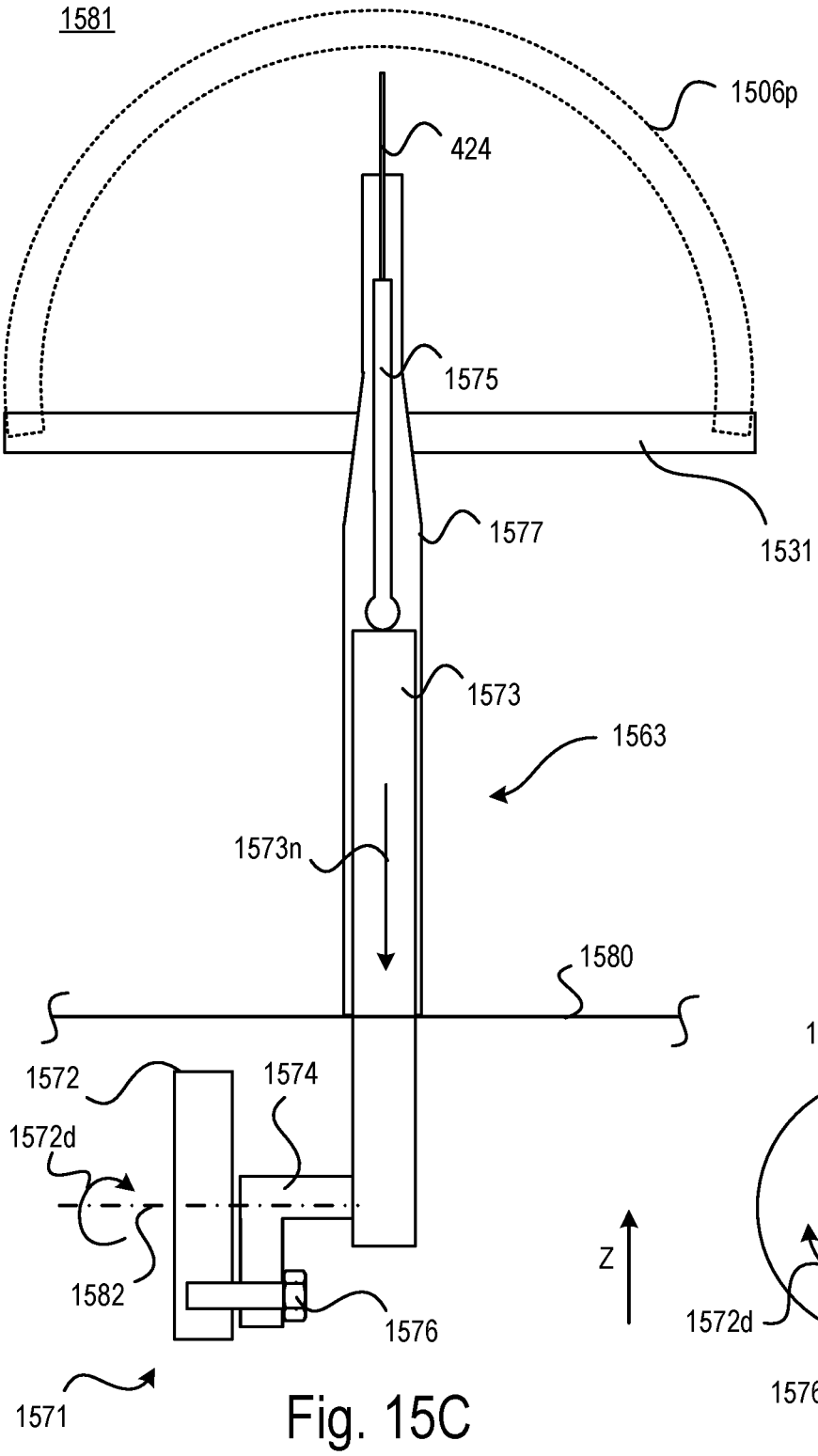
FIG. 15C is a schematic of the assembly of modules or transition devices of FIG. 15A when the needle is at a position inside the cavity of the head such that a position of the head can be adjusted relative to the needle.

Referring to FIGS. 15A-15D, an assembly 1581 of modules or transition devices 1563 is configured to oscillate the needle 424 along the Z direction to root hair thread into a head that is mounted at a head position 1506*p*. With reference to FIG. 15A, the needle 424 is at a position configured to penetrate the head for rooting of the hair thread. With reference to FIG. 15C, the needle 424 is at a position inside the cavity of the head such that the head position 1506*p* of the head can be adjusted relative to the needle 424.

The assembly 1581 is part of a hair rooting system, such as the hair rooting system 1260, 1360, 1460, that includes a base apparatus, such as the base apparatus 1262, 1362, 1462. Each of the modules 1563 are configured to be attached to and detached from interchange zones of the associated base apparatus of the hair rooting system, including, in this example, a rooting zone configured to root hair thread into the head and a holding zone configured to retain and move the head. The set of modules or transition devices 1563 includes an implementation 1531 of the mount 1431*a*, 1431*b* (FIGS. 14A and 14B); an implementation 1573 of the support sleeve 1473*a*, 1473*b*; an implementation 1575 of the needle bar 1475*a*, 1475*b*; an implementation 1577 of the needle bar sleeve 1477*a*, 1477*b*; and an implementation 1571 of the motion adapter 1471*a*, 1471*b*.

In the example of FIGS. 15A-15D, the motion adapter 1571 includes a wheel 1572 configured to rotate about a rotation axis 1582 and a crank 1574 positioned relative to the wheel 1572. The wheel 1572 can be rotated or moved by, for example, a rotational motor. The crank 1574 is attached to the wheel 1572 by a mechanical connector such as, for example, a screw or a bolt 1576. The crank 1574 is attached to the wheel 1572 (by the screw 1576) at a radial location that is a distance dw from the rotation axis 1582 (or center) of the wheel 1572. The crank 1574 is configured to be a rotational-to-linear motion adapter such that the crank 1574 converts rotational movement of the wheel 1572 (that is about a direction 1572*d* shown by an arrow) to linear movement along the Z-direction. The converted linear movement of the crank along the Z-direction causes linear movement along the Z direction of the support sleeve 1573 (that is along a direction 1573*d* shown by an arrow). Moreover, a radial location of the attached crank 1574 on the wheel 1572 determines the oscillation range of the support sleeve 1573, the oscillation range defined as the distance between a highest point in the Z-direction and a lowest point in the Z-direction at which the support sleeve 1573 is moved by the motion adapter 1571.

The support sleeve 1573 is configured to support the needle bar 1575 that holds the needle 424. In other words, the movement of the support sleeve 1573 and the needle bar 1575 is coupled such that the support sleeve 1573 and the needle bar 1575 move or oscillate simultaneously. Thus, when the support sleeve 1573 is moved by the motion adapter 1571 along the Z-direction, the needle bar 1575 also moves with (or is moved by) the support sleeve 1573 along the Z-direction. Moreover, as the needle bar 1575 moves or oscillates, the needle 424 (that the needle bar 1575 holds) moves or oscillates in the Z-direction to root hair thread into the head that is mounted at the head position 1506*p*. In this way, the support sleeve 1573 enables interlocking of the hair threads with the needle 424 to root the hair thread into the head. Additionally, because the motion of the support sleeve 1573, the needle bar 1575, and the needle 424 is coupled, the radial location (that is the distance dw from the rotation axis 1582 of the wheel 1572) determines the oscillation range of the support sleeve 1573, the needle bar 1575, and the needle 424.

In the example of FIGS. 15A-15D, the support sleeve 1573 and the needle bar 1575 are housed within the needle bar sleeve 1577. The needle bar sleeve 1577 is mounted on or attached to a flat surface 1580, which can be a table, such that the needle bar sleeve 1577 does not move as the motion adapter 1571 causes the support sleeve 1573 to move or oscillate along the Z-direction. In this example, the motion adapter 1571 is positioned below or underneath the table 1580, and the hair thread is rooted at a location above the table 1580. The support sleeve 1573 and the needle bar 1575 are configured to move relative to the needle bar sleeve 1577 as the wheel 1572 rotates about the rotation axis 1582 to move the support sleeve 1573. Because the support sleeve 1573 and the needle bar 1575 are housed within the needle bar sleeve 1577, a size of the needle bar 1575, a size of the support sleeve 1573, and a size of the needle bar sleeve 1577 are related and depend on each other. For example, the support sleeve 1577 and the needle bar sleeve 1577 can both have a cylindrical shape such that the outer cylindrical surface of the support sleeve 1577 is flush with the inner cylindrical surface of the needle bar sleeve 1577.

The mount 1531 is configured to hold the head relative to the needle 424. Specifically, a position of the mount 1531 can be adjusted by an actuator (not shown in FIG. 15A) to determine the position 1506*p* of the head relative to the needle 424. In this way, the needle 424 can access the entire head to thereby root the hair thread into the head. Moreover, the position of the mount 1531 along the Z-direction relative to the needle 424 can be selected such that the needle 424 pierces the head (that is mounted on the mount 1531) at moments when the support sleeve 1573 is at the highest position along the Z-direction, and the needle 424 does not pierce the head at other moments when the support sleeve 1573 is at the lowest position along the Z-direction.

In one example, when the outer surface of the support sleeve 1573 and the inner surface of the needle bar sleeve 1577 are flush with each other, the surfaces of the support sleeve 1573 and the needle bar sleeve 1577 can move or oscillate directly against each other causing friction. Accordingly, the support sleeve 1573 can be made of a rigid material such as, for example, copper, that has low friction properties which enable smooth movement between the support sleeve 1573 and the needle bar sleeve 1577 during oscillation of the support sleeve 1573. The mount 1531, the motion adapter 1571, the needle bar sleeve 1577, and the needle bar 1575 can be made of a rigid material such as, for example, steel, that does not deform or bend when external forces are applied.

During operation of the assembly 1581 and the hair rooting system, the wheel 1572 of the motion adapter 1571 is rotated about the rotation axis 1582 (in the direction 1572*d*) by, for example, a motor. The crank 1574 converts the rotational movement of the wheel 1572 to linear movement along the Z-direction. The linear movement produced by the crank 1574 moves or oscillates the support sleeve 1573 along the direction 1573*p* (FIG. 15A) and along the opposite direction 1573*n* (FIG. 15C) relative to the needle bar sleeve 1577. The linear movement of the support sleeve 1573 also moves or oscillates the needle bar 1575 (and, thus, the needle 424) along the directions 1573*p*, 1573*n*.

Figure 15D:
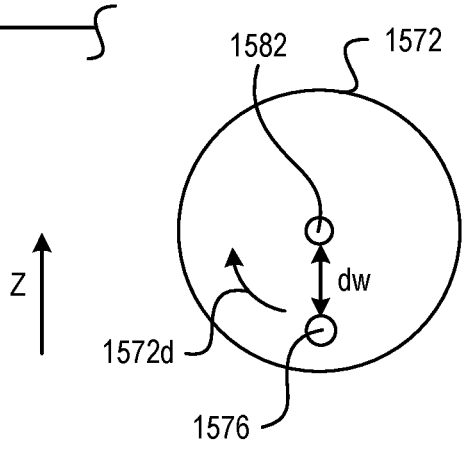
FIG. 15D is the wheel of the motion adapter of FIG. 15B when the needle is at the position of FIG. 15C.

Specifically, as shown in FIGS. 15A and 15B, when the wheel 1572 is rotated such that the screw 1576 is at the highest position in the direction 1573*p* (or the positive Z-direction), the support sleeve 1573 is also at the highest position such that the needle 424 pierces the head and the hair thread can be interlocked with the needle 424 to root the hair thread. As shown in FIGS. 15C and 15D, when the wheel 1572 is rotated such that the screw 1576 is at the lowest position in the direction 1573*n* (or the negative Z-direction), the support sleeve 1573 is also at the lowest position such that the needle 424 does not pierce or engage with the head, and the position 1506*p* of the head can be changed or adjusted by adjusting the position of the mount 1531. In this way, the needle 424 is moved or oscillated along the directions 1573*p*, 1573*n* to root the hair thread into the head.

The assembly 1581 of modules 1563 is described with respect to one set of modules 1563. However, the set of modules 1563 can be another set of modules, such as the first set of modules 1463*a* (FIG. 14A) or the second set of modules 1463*b* (FIG. 14B). In other words, the set of modules 1563 is configured to be replaced with another set of modules such that the assembly 1581 is configured to root hair thread into a plurality of distinct heads (including the first head 1406*a* and the second head 1406*b*), each head being a distinct head type. Details of the first and second modules (or transition devices) configured for the assembly 1581 are provided next.

Figure 16A:
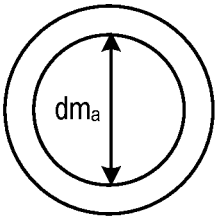
FIG. 16A is a first mount configured to hold a first head of a first type.
Figure 16B:
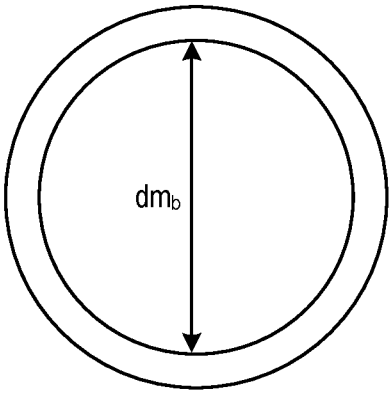
FIG. 16B is a second mount configured to hold a second head of a second type.
Figure 16C:
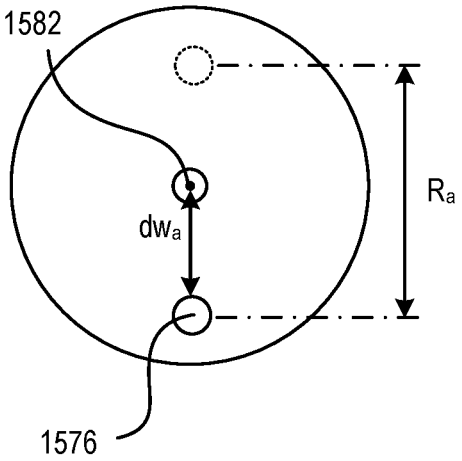
FIG. 16C is a first wheel of a first motion adapter configured to move a first support sleeve such that a needle oscillates to root hair thread into the first head.
Figure 16D:
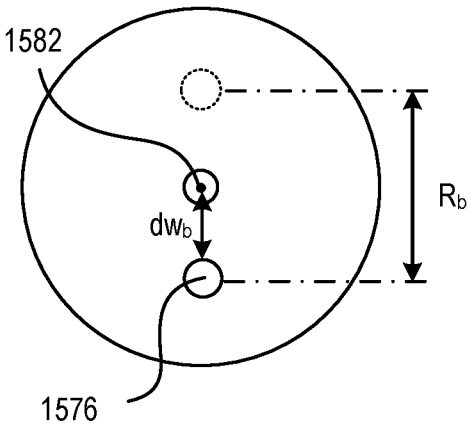
FIG. 16D is a second wheel of a second motion adapter configured to move a second support sleeve such that the needle oscillates to root hair thread into the second head.

Referring to FIGS. 16A-16J, a first set of modules (or transition devices) includes a first mount 1531*a* (FIG. 16A), a first needle bar 1575*a* (FIG. 16I), a first support sleeve 1573*a* (FIG. 16G), a first needle bar sleeve 1577*a* (FIG. 16E), and a first motion adapter that includes a wheel 1572*a* (FIG. 16C); and a second set of modules (or transition devices) includes a second mount 1531*b* (FIG. 16B), a second needle bar 1575*b* (FIG. 16J), a second sleeve 1573*b* (FIG. 16H), a second needle bar sleeve 1577*b* (FIG. 16F), and a second motion adapter that includes a wheel 1572*b* (FIG. 16D). The first set of modules is an implementation of the first set of modules 1463*a* (FIG. 14A), and the second set of modules is an implementation of the second set of modules 1463*b* (FIG. 14B).

The first set of modules is configured for a first head of a first type (such as the first head 1406*a* of FIG. 14A) and the second set of modules is configured for a second type of head of a second type (such as the second head 1406*b* of FIG. 14B). In the example of FIGS. 16A-16J, the first head 1406*a* is defined by a first head size that is smaller than a second head size of the second head 1406*b*. The first and second modules are configured to be assembled with each other (as in the assembly 1581 of FIGS. 15A and 15C), respectively, such that hair thread can be rooted into both of the first and second distinct heads 1406*a*, 1406*b*.

With reference to FIGS. 16A and 16B, the first mount 1531*a* configured for the first head 1406*a* has a first size that is different than a second size of the second mount 1531*b* configured for the second head 1406*b*. Specifically, because the first head 1406*a* is smaller than the second head 1406*b* (in this example), the first mount 1531*a* is smaller than the second mount 1531*b*. In other words, the first mount 1531*a* has a diameter $dm_s$ that is smaller or less than a diameter $dm_b$ of the second mount 1531*b*. In some implementations, an actuator (not shown) that is configured for both types of heads 1406*a*, 1406*b* is configured to adjust a position of the first mount 1531*a* (when the first set of modules are being used to root hair thread into the first head 1406*a*) and a position of the second mount 1531*b* (when the second set of modules are being used to root hair thread into the second head 1406*b*). The position of the first mount 1531*b* determines the position of the first head 1406*a* relative to the needle 424, and the position of the second mount 1531*b* determines the position of the second head 1406*b* relative to the needle 424. Thus, the actuator can adjust the position of the appropriate head 1406*a*, 1406*b* during the hair rooting process such that the needle 424 has access to the entire head region.

With reference to FIGS. 16C and 16D, the first motion adapter includes a crank (such as the crank 1574 of FIGS. 15A and 15C) positioned in a first position relative to the first wheel 1572*a*, and the first wheel 1572*a* that is configured to rotate about the rotation axis 1582. The second motion adapter includes the crank positioned in a second position relative to the second wheel 1572*b*, and the second wheel 1572*b* that is configured to rotate about the rotation axis 1582. Specifically, the crank attaches to the first wheel 1572*a* at the screw 1576 which is positioned at a first radial location on the first wheel 1572*a* (when the hair rooting system is formed into the first machine), and the crank attaches to the second wheel 1572*b* at the screw 1576 which is positioned at a second radial location that is distinct from the first radial location on the second wheel 1572*b* (when the hair rooting system is formed into the second machine). In this way, a first motion adapter is formed to root hair thread into the first head 1406*a* and a second motion adapter is formed to root hair thread into the second head 1406*b*.

In one implementation, the first wheel 1572*a* and the second wheel 1572*b* are the same wheel, except that the crank is positioned in different or distinct positions relative to the wheel depending on the appropriate configuration to root hair thread into the appropriate head 1406*a*, 1406*b*. In other words, the position of the crank relative to the wheel can be interchanged by changing the position of the screw 1576 relative to the rotation axis 1582 of the wheel. In other implementations, the first wheel 1572*a* and the second wheel 1572*b* are separate and distinct wheels.

Figure 16F:
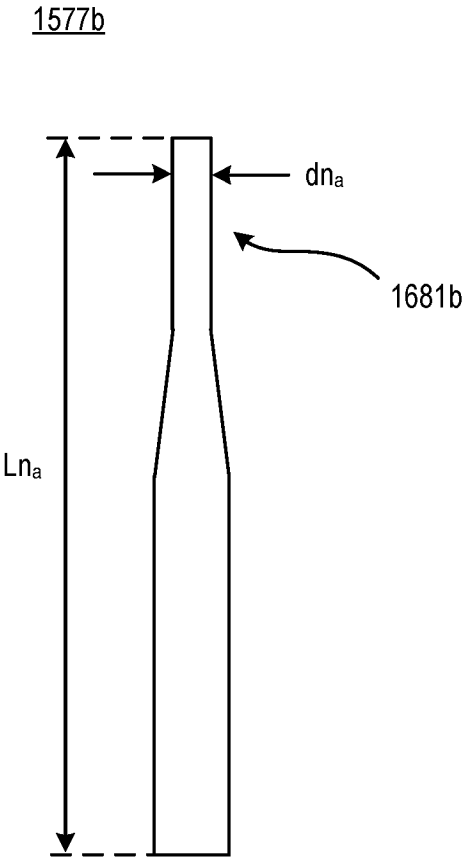
FIG. 16F is a second needle bar sleeve configured to house a second needle bar and a second support sleeve, the second needle bar sleeve configured for the second head.
Figure 16E:
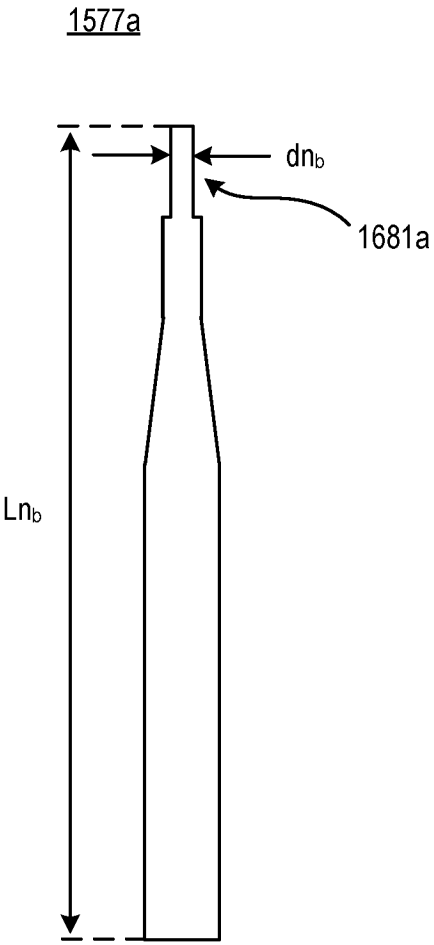
FIG. 16E is a first needle bar sleeve configured to house a first needle bar and a first support sleeve, the first needle bar sleeve configured for the first head.

With reference to FIGS. 16E and 16F, the first needle bar sleeve 1577*a* that is configured for the first head 1406*a* has a first size that is different than a second size of the second needle bar sleeve configured for the second head 1406*b*. Specifically, the first needle bar sleeve 1577*a* (FIG. 16E) has a length $Ln_a$ and a tip 1681*a* that has a size or diameter $dn_a$. The second needle bar sleeve 1577*b* (FIG. 16F) has a length Ln b and a tip 1681*b* that has a size or diameter $dn_b$. Each of the first and second needle bar sleeves 1577*a*, 1577*b* is a hollow cylindrical structure that extends along an axial direction. In other examples, the first and second needle bar sleeves 1577*a*, 1577*b* can have different shapes, such as a hollow polygonal shape that extends along an axial direction.

The length $Ln_b$ of the second needle bar sleeve 1577*b* is smaller than (or different than) the length $Ln_a$ of the first needle bar sleeve 1577*a*. This is because the distance $dw_a$, $dw_b$ between the position of the crank in each motion adapter (which is at the respective radial location relative to the rotation axis 1582) and the rotation axis 1582 is directly related to the required length of each needle bar sleeve 1577*a*, 1577*b*. Thus, because the distance $dw_a$ between the first radial position of the first motion adapter (FIG. 16C) and the rotation axis 1582 is greater or larger than the distance $dw_b$ between the second radial position of the second motion adapter (FIG. 16D) and the rotation axis 1582, the length $Ln_a$ of the first needle bar sleeve 1577*b* is greater or larger than the length $Ln_b$ of the second needle bar sleeve 1577*b*. In this way, each of the first and second sizes of the needle bar sleeves 1577*a*, 1577*b* is dependent on the first and second motion adapters, respectively.

Additionally, the diameter $dn_b$ of the tip 1681*b* of the second needle bar sleeve 1577*b* is larger than (or different than) the diameter $dn_a$ of the tip 1681*a* of the first needle bar sleeve 1577*a*. This is because the size (or diameter) of the tip 1681*a*, 1681*b* of each needle bar sleeve 1577*a*, 1577*b* is directly related to the size of each head 1406*a*, 1406*b*. Specifically, when the head 1406*a*, 1406*b* is a smaller size, the neck hole of the head 1406*a*, 1406*b* (through which the needle 424 is inserted for hair rooting) is also smaller. As such, the size of the tip 1681*a*, 1681*b* of each needle bar sleeve 1577*a*, 1577*b* is configured to fit through the neck hole of the head 1406*a*, 1406*b* and inside or within the cavity of the head 1406*a*, 1406*b*, respectively. Thus, the size or diameter $dn_a$ of the tip 1681*a* of the first needle bar sleeve 1577*a* is smaller or less than the size or diameter $dn_b$ of the tip 1681*b* of the second needle bar sleeve 1577*b* because the head size of the first head 1406*a* is smaller than the head size of the second head 1406*b*. In this way, each of the first and second sizes or diameters $dn_a$, $dn_b$ depends on the first head size of the first head 1406*a* and the second head size of the second head 1406*b* that is different (or larger than, in this example) than the first head size, respectively.

Figure 16G:
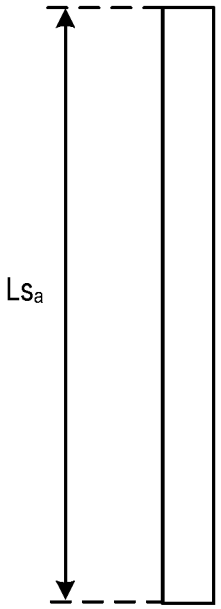
FIG. 16G is a first support sleeve configured to support a first needle bar, the first support sleeve configured for the first head.
Figure 16H:
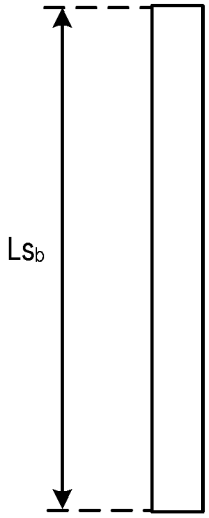
FIG. 16H is a second support sleeve configured to support a second needle bar, the second support sleeve configured for the second head.
Figure 16I:
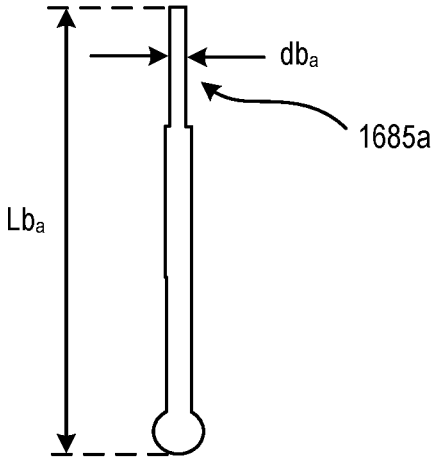
FIG. 16I is a first needle bar configured to hold the needle, the first needle bar configured for the first head.

With reference to FIGS. 16G and 16H, the first support sleeve 1573*a* (FIG. 16G) configured for the first head 1406*a* has a size that is different than a size of the second support sleeve 1573*b* (FIG. 16H) configured for the second head 1406*b*. Each of the first and second support sleeves 1573*a*, 1573*b* is a hollow cylindrical structure that extends along an axial direction. In other examples, the first and second support sleeves 1573*a*, 1573*b* can have different shapes, such as a hollow polygonal shape that extends along an axial direction.

Specifically, the first support sleeve 1573*a* has a length $Ls_a$ that is larger than a length $Ls_b$ of the second support sleeve 1573*b*. This is because the distance $dw_a$, $dw_b$ between the position of the crank in each motion adapter and the rotation axis 1582 is directly related to the required length of each support sleeve 1573*a*, 1573*b*. Thus, because the distance $dw_a$ is greater or larger than the distance $dw_b$ (and also the length $Ln_a$ of the first needle bar sleeve 1577*a* is greater than the length $Ln_b$ of the second needle bar sleeve 1577*b*), the length $Ls_a$ of the first support sleeve 1573*b* is greater or larger than the length $Ls_b$ of the second support sleeve 1573*b*. In this way, each of the first and second sizes of the support sleeves 1573*a*, 1573*b* is dependent on the first and second motion adapters, respectively.

Figure 16J:
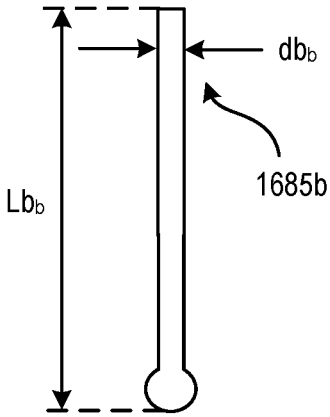
FIG. 16J is a second needle bar configured to hold the needle, the second needle bar configured for the second head.

With reference to FIGS. 161 and 16J, the first needle bar 1575*a* (FIG. 16I) configured for the first head 1406*a* has a size that is different than a size of the second needle bar 1575*b* (FIG. 16J) configured for the second head 1406*b*. Each of the first and second needle bars 1575*a*, 1575*b* is a cylindrical structure that extends along an axial direction, the cylindrical structure being configured to hold the needle 424 for hair rooting. In other examples, the first and second needle bars 1575*a*, 1575*b* can have different shapes, such as a polygonal shape that extends along an axial direction and is configured to hold the needle 424.

Specifically, the first needle bar 1575*a* has a length $Lb_a$ that is larger than a length $Lb_b$ of the second needle bar 1575*b*. This is because the distance $dw_a$, $dw_b$ (FIGS. 16C and 16D) between the position of the crank in each motion adapter and the rotation axis 1582 is directly related to the required length of each needle bar 1575*a*, 1575*b*. Thus, because the distance $dw_a$ is greater or larger than the distance $dw_b$ (and also the length $Ln_a$ of the first needle bar sleeve 1577*a* is greater than the length $Ln_b$ of the second needle bar sleeve 1577*b*), the length $Lb_a$ of the first needle bar 1575*b* is greater or larger than the length $Lb_b$ of the second needle bar 1575*b*. In this way, each of the first and second sizes of the needle bars 1575*a*, 1575*b* is dependent on the first and second motion adapters, respectively.

The first needle bar 1575*a* includes a tip 1685*a* (defined by an inlet) that has a diameter $db_a$ and the second needle bar 1575*b* includes a tip 1685*b* that has a diameter $db_b$. The diameter $db_b$ of the tip 1685*b* of the second needle bar 1575*b* is larger than (or different than) the diameter $db_a$ of the tip 1685*a* of the first needle bar 1575*a*. As described above, the size (or diameter) of the tip 1681*a*, 1681*b* of each needle bar sleeve 1577*a*, 1577*b* (FIGS. 16E and 16F) is directly related to the size of each head 1406*a*, 1406*b*. Specifically, the size or diameter $dn_a$ of the tip 1681*a* of the first needle bar sleeve 1577*a* is smaller or less than the size or diameter $dn_b$ of the tip 1681*b* of the second needle bar sleeve 1577*b* because the head size of the first head 1406*a* is smaller than the head size of the second head 1406*b*. As such, because each needle bar 1575*a*, 1575*b* is configured to fit inside or be housed within the respective needle bar sleeve 1577*a*, 1577*b*, the size or diameter $db_a$ of the tip 1685*a* of the first needle bar 1575*a* is smaller or less than the size or diameter $db_b$ of the tip 1685*b* of the second needle bar 1575*b*.

Moreover, because the first needle bar 1575*a* and the first support sleeve 1573*a* are fitted inside or housed within the first needle bar sleeve 1577*a*, the first size of the first needle bar 1575*a*, the first size of the first support sleeve 1573*a*, and the first size of the first needle bar sleeve 1577*a* are related to and depend on each other. Similarly, because the second needle bar 1575*b* and the second support sleeve 1573*b* are fitted inside or housed within the second needle bar sleeve 1577*b*, the second size of the second needle bar 1575*b*, the second size of the second support sleeve 1573*b*, and the second size of the second needle bar sleeve 1577*b* are related to and depend on each other.

Referring also to FIGS. 15A-15D, during operation, each of the first modules (including the first mount 1531*a*, the first motion adapter including the first wheel 1572*a*, the first needle bar sleeve 1577*a*, the first support sleeve 1573*a*, and the first needle bar 1575*a*) is attached to appropriate interchange zones of a base apparatus, such as the base apparatus 1462 of FIG. 14A, to form a first hair rooting machine (such as the first machine 1460*a* of FIG. 14A) that is configured to root the hair thread into the first head 1406*a*. Similarly, each of the second modules (including the second mount 1531*b*, the second motion adapter including the second wheel 1572*b*, the second needle bar sleeve 1577*b*, the second support sleeve 1573*b*, and the second needle bar 1575*b*) is attached to appropriate interchange zones of the base apparatus to form a second hair rooting machine (such as the second machine 1460*b* of FIG. 14B) that is configured to root the hair thread into the second head 1406*b*.

To root hair thread into the appropriate head 1406*a*, 1406*b*, the respective support sleeve 1573*a*, 1573*b* and the respective needle bar 1575*a*, 1575*b* move or oscillate (by the motion adapters) along the Z-direction to oscillate the needle 424. When the needle 424 oscillates during operation of the hair rooting system, each of the first and second motion adapters define a different rotational amplitude of the needle 424. Specifically, in the first hair rooting machine, the first radial location determines a first oscillation range R a (FIG. 16C) of the first support sleeve 1573*a*, which is also the oscillation range R a of the first needle bar 1575*a* and the needle 424. The first oscillation range R a of the first support sleeve 1573*a*, the first needle bar 1575*a*, and the needle 424 is two times the distance $dw_a$ between the position of the crank in the first motion adapter and the rotation axis 1582. In the second hair rooting machine, the second radial location determines a second oscillation range Rb (FIG. 16D) of the second support sleeve 1573*b*, which is also the oscillation range Rb of the second needle bar 1575*b* and the needle 424. The second oscillation range Rb is two times the distance $dw_b$ between the position of the crank in the second motion adapter and the rotation axis 1582. In this way, the oscillation range of the needle 424 in each of the first and second hair rooting machines is determined at least by the radial location or position of the attached crank in the respective motion adapter.

Other implementations are within the scope of the claims. For example, with reference to FIG. 4, in other implementations, the needle 424 can pierce the head 406 from outside the head 406 or at the outer surface 406*o* of the head 406 to root the hair thread 420 into the head 406.

What is claimed is:

1. An apparatus comprising:

a variable hair length module configured to adjust lengths of hair strands that are rooted in a head by a hair rooting machine from a supply of hair thread, the variable hair length module comprising two arms configured to move relative to each other along respective continuous paths; and a control system configured to input programs of instruction to the variable hair length module to automatically control the relative movement of the two arms during operation of the hair rooting machine to root hair strands into the head;

wherein the hair thread is configured to engage with each of the two arms such that a relative movement of the two arms varies the length of each hair strand continuously within a hair length range that is defined by two extreme lengths.

2. The apparatus of claim 1, wherein the hair thread is configured to engage with each of the two arms between a needle configured to root the hair thread in the head and a cutter configured to cut the hair thread to produce the hair strands.

3. The apparatus of claim 2, wherein the two extreme lengths are determined at least by relative positions of the needle and the cutter.

4. The apparatus of claim 2, wherein the control system is further configured to adjust one or more aspects of motion of the needle and the variable hair length module.

5. The apparatus of claim 2, wherein the control system is further configured to control the cutter to cut the hair thread at an appropriate time to produce the hair strands, each hair strand having any desired length that is between the two extreme lengths.

6. The apparatus of claim 2, wherein a motion of the needle is pre-programmed and is based on a desired hair rooting path and a stitch per inch requirement.

7. The apparatus of claim 1, wherein the hair length range is given by a minimum length and a maximum length that define a continuous range of length of each hair strand.

8. The apparatus of claim 1, wherein the control system is configured to change the hair length range between a set of distinct hair length ranges, wherein a first hair length range is between four inches and six inches, and a second hair length range is between six inches and nine inches.

9. The apparatus of claim 1, wherein the hair thread being configured to engage with each of the two arms includes the hair thread wrapping around each of the two arms or the hair thread surrounding the two arms.

10. The apparatus of claim 1, wherein the two extreme lengths are pre-set based at least on a size of the head and a desired length of each hair strand.

11. The apparatus of claim 1, further comprising a hair feeding device, wherein movement of the hair feeding device is dependent on a state of the variable hair length module.

12. The apparatus of claim 1, wherein the control system automatically controls the relative movement of the two arms of the variable hair length module based on programs of instruction and manual settings.

13. The apparatus of claim 1, wherein the head is a hollow object.

14. A hair rooting apparatus comprising:

a needle configured to root hair thread into a head;

a cutter configured to cut the rooted hair thread to produce hair strands;

a hair feeding device configured to position the hair thread at the needle and the cutter;

a variable hair length module configured to adjust a length of the hair strands rooted into the head, the variable hair length module comprising two arms configured to move relative to each other; and a control system configured to input programs of instruction to the variable hair length module to automatically control relative movement of the two arms;

wherein the hair thread is configured to engage with each of the two arms such that the length of each hair strand is varied by the relative movement of the two arms.

15. The hair rooting apparatus of claim 14, further comprising a mount configured to position the head relative to the needle;

wherein a position of the mount is adjusted by an actuator, the position of the mount determining the position of the head relative to the needle.

16. The hair rooting apparatus of claim 15, further comprising a pressing device configured to press the head to form a flat surface at a region of the head in which the needle roots the hair thread.

17. The hair rooting apparatus of claim 16, wherein the control system is further configured to control movement of one or more of the mount and the pressing device.

18. The hair rooting apparatus of claim 16, wherein each of the needle, the cutter, the mount, and the pressing device is made of a rigid material including a metal.

19. The hair rooting apparatus of claim 14, wherein the control system is further configured to control one or more of a rooting speed of the needle and movement of the hair feeding device.

20. The hair rooting apparatus of claim 14, further comprising a cutting post configured to engage rooted hair thread to enable the cutter to cut the rooted hair thread.

21. A hair rooting apparatus comprising:

a hair feeding device configured to guide a hair thread relative to a head;

a needle including a hook, the needle configured to pierce the head and the hook configured to, at certain times during rooting, grab the hair thread from the hair feeding device;

a trimming mechanism including a cutter configured to cut the hair thread to form a hair strand having a cut region at the cutter and a root region penetrating the head;

a variable length module configured to adjust a length between the cut region and the root region between hair strands; and a control system in communication with the variable length module, the hair feeding device, and the needle, the control system configured to adjust one or more aspects of motion of the needle and one or more aspects of motion of the hair feeding device based on a state of the variable length module.

22. The hair rooting apparatus of claim 21, wherein the control system is in communication with the trimming mechanism and is configured to adjust one or more aspects of the trimming mechanism based on the state of the variable length module.

23. The hair rooting apparatus of claim 21, further comprising a mount configured to hold the head, wherein the control system is in communication with the mount and is configured to adjust the mount to thereby adjust a position of the head relative to the needle in between moments when the needle pierces the head.

24. The hair rooting apparatus of claim 21, wherein the control system is configured to adjust one or more aspects of the motion of the needle include adjusting a speed at which the needle moves.

* * * * *